US008042909B2

(12) United States Patent
Sakai et al.

(10) Patent No.: US 8,042,909 B2
(45) Date of Patent: Oct. 25, 2011

(54) INK CARTRIDGE ATTACHMENT/DETACHMENT DEVICE, RECORDING APPARATUS, LIQUID EJECTION APPARATUS, AND LIQUID CONTAINER

(75) Inventors: Yasuto Sakai, Nagano-ken (JP); Satoshi Shinada, Nagano-ken (JP); Tokujiro Okuno, Nagano-ken (JP); Satoshi Kobayashi, Nagano-ken (JP); Shuichi Kadota, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 967 days.

(21) Appl. No.: 11/968,265

(22) Filed: Jan. 2, 2008

(65) Prior Publication Data

US 2008/0136879 A1 Jun. 12, 2008

Related U.S. Application Data

(63) Continuation of application No. 11/019,510, filed on Dec. 21, 2004, now Pat. No. 7,455,397.

(30) Foreign Application Priority Data

| | | |
|---|---|---|
| Dec. 22, 2003 | (JP) | 2003-424832 |
| Feb. 6, 2004 | (JP) | 2004-031295 |
| Feb. 9, 2004 | (JP) | 2004-032152 |
| Aug. 25, 2004 | (JP) | 2004-244780 |

(51) Int. Cl.
*B41J 2/14* (2006.01)
*B41J 2/175* (2006.01)

(52) U.S. Cl. ..... 347/49; 347/86

(58) Field of Classification Search ..... 347/37, 347/86, 87; 237/49, 85
See application file for complete search history.

(56) References Cited

U.S. PATENT DOCUMENTS

| | | | | |
|---|---|---|---|---|
| 4,447,820 | A | 5/1984 | Terasawa | |
| 5,971,534 | A | 10/1999 | Sasaki et al. | |
| 6,247,805 | B1 | 6/2001 | Iwaya | |
| 6,250,750 | B1 * | 6/2001 | Miyazawa et al. | 347/87 |
| 6,264,318 | B1 | 7/2001 | Oda et al. | |
| 6,476,926 | B1 | 11/2002 | Yano et al. | |

(Continued)

FOREIGN PATENT DOCUMENTS

DE 3249979 C2 1/1983

(Continued)

OTHER PUBLICATIONS

Search Report from European Patent Appln. 04030484.2-2304, dated Aug. 22, 2006.

(Continued)

*Primary Examiner* — Anh T. N. Vo
(74) *Attorney, Agent, or Firm* — Stroock & Stroock & Lavan LLP

(57) ABSTRACT

A liquid container for a liquid ejection apparatus includes: a case having a liquid containing portion in its interior; a supply portion which is formed on a first side wall of the case, and through which a liquid in the liquid containing portion can flow to an exterior; a contact portion, which can contact a part of a slider of the liquid ejection apparatus to move the slider in a direction in which the liquid container is inserted; and an engagement portion, which is configured to engage a lock portion of the slider. The contact portion and the engagement portion are formed on a second side wall of the case, the second side wall intersecting the first side wall.

33 Claims, 42 Drawing Sheets

U.S. PATENT DOCUMENTS

| | | | | |
|---|---|---|---|---|
| 6,779,880 | B1 * | 8/2004 | Kulpa et al. | 347/86 |
| 6,832,830 | B2 | 12/2004 | Seino et al. | |
| 6,908,182 | B2 | 6/2005 | Nakazawa et al. | |
| 7,226,154 | B2 | 6/2007 | Seino et al. | |
| 7,575,300 | B2 * | 8/2009 | Kobayashi | 347/49 |
| 7,575,310 | B2 * | 8/2009 | Kobayashi | 347/86 |
| 7,686,422 | B2 * | 3/2010 | Kobayashi | 347/49 |
| 7,712,881 | B2 * | 5/2010 | Kobayashi | 347/86 |
| 2002/0196312 | A1 | 12/2002 | Ishizawa et al. | |
| 2003/0067521 | A1 | 4/2003 | Kaga et al. | |
| 2003/0194897 | A1 | 10/2003 | Nishioka | |
| 2007/0206076 | A1 | 9/2007 | Seino et al. | |
| 2008/0002003 | A1 * | 1/2008 | Kobayashi | 347/86 |
| 2009/0251512 | A1 * | 10/2009 | Nozawa et al. | 347/86 |

FOREIGN PATENT DOCUMENTS

| | | | |
|---|---|---|---|
| EP | 0 498 117 | A2 | 8/1992 |
| EP | 0 577 390 | A2 | 1/1994 |
| EP | 0 778 145 | A1 | 6/1997 |
| EP | 0 863 014 | A2 | 9/1998 |
| EP | 0 872 355 | A2 | 10/1998 |
| EP | 0 872 355 | A3 | 4/2000 |
| EP | 1 122 073 | A2 | 8/2001 |
| EP | 1 199 179 | A1 | 4/2002 |
| EP | 1 219 437 | A2 | 7/2002 |
| EP | 1 346 834 | A2 | 9/2003 |
| EP | 1 348 556 | A1 | 10/2003 |
| EP | 1 380 428 | A2 | 1/2004 |
| EP | 1 454 753 | A1 | 9/2004 |
| EP | 1 498 272 | A1 | 1/2005 |
| EP | 1 504 906 | A2 | 2/2005 |
| GB | 2 323 817 | A | 10/1998 |
| GB | 2 343 145 | A | 5/2000 |
| GB | 2 387 567 | A | 10/2003 |
| GB | 2 406 544 | A | 4/2005 |
| JP | 01-141750 | A | 6/1989 |
| JP | 03-184873 | A | 8/1991 |
| JP | 04-235040 | A | 8/1992 |
| JP | 06-015835 | A | 1/1994 |
| JP | 07-246716 | A | 9/1995 |
| JP | 08-108546 | A | 4/1996 |
| JP | 09-123479 | A | 5/1997 |
| JP | 10-329331 | A | 12/1998 |
| JP | 11-070663 | | 3/1999 |
| JP | 11-157094 | A | 6/1999 |
| JP | 11-277763 | A | 10/1999 |
| JP | 11-348303 | A | 12/1999 |
| JP | 2002-001979 | A | 1/2002 |
| JP | 2002-283583 | A | 10/2002 |
| JP | 2002-370373 | A | 12/2002 |
| JP | 2003-341100 | A | 12/2003 |
| WO | 00/74939 | A1 | 12/2000 |

OTHER PUBLICATIONS

Search Report, from German patent appln. No. 10 2004 061 829.1-27, dated Apr. 13, 2006 (with English translation).

Combined Search and Examination Report in British Patent Appln. No. GB 0 526 510.3, dated Mar. 31, 2006.

Search and Examination Report issued in British patent application GB0428071.5, dated Oct. 3, 2005.

Search and Examination Report issued in British patent application GB0517438.8, dated Oct. 11, 2005.

Combined Search and Examination Report in corresponding application No. GB 0428071.5.

Extended European Search Report from patent appln. No. 07016755.6 (Feb. 13, 2008).

* cited by examiner 611
622
36
48
54
53
621
101
103
104
102
37
30
60(61)

INK CARTRIDGE ATTACHMENT/DETACHMENT DEVICE, RECORDING APPARATUS, LIQUID EJECTION APPARATUS, AND LIQUID CONTAINER

CROSS-REFERENCE TO RELATED APPLICATION

This application is a continuation of application Ser. No. 11/019,510, filed Dec. 21, 2004 now U.S. Pat. No. 7,455,397.

BACKGROUND OF THE INVENTION

The present invention relates to an ink cartridge attachment/detachment device that slides an ink cartridge horizontally to load it into the main body of a recording apparatus, and a recording apparatus comprising this attachment/detachment device. The present invention also relates to a liquid ejection apparatus, such as an ink jet recording apparatus, that discharges (ejects) a liquid, such as ink, from a recording head and records on (attaches the liquid to) recording material (an ejected liquid target material), and a liquid cartridge attachment/detachment device provided for the liquid ejection apparatus. The present invention further relates to a liquid container (liquid cartridge) including an ink cartridge.

In this case, such a liquid ejection apparatus includes not only a recording apparatus, such as a printer, a copier or a facsimile machine, that employs an ink jet recording head and that, by ejecting ink, records images on a recording material, but also an apparatus wherein, instead of ink, a liquid consonant with an intended purpose is ejected by a liquid ejection head, which corresponds to the recording head, onto an ejected liquid target material, which corresponds to recording material, and the liquid is attached to the ejected liquid target material, which corresponds to recording material, and the liquid is attached to the ejected liquid target material.

In addition to the recording head, the liquid ejection head can be a color material ejection head used for manufacturing a color filter for a liquid crystal display, an electrode material (conductive paste) ejection head used for forming an electrode for an organic EL display or a plane light-emitting display (FED), a bio-organic ejection head used for bio-chip manufacturing, or a sample ejection head used as a precision pipette.

An explanation will now be given for an ink jet printer as an example ink jet recording apparatus or an example liquid ejection apparatus. A comparatively large pressing force is required to load an ink cartridge into an ink jet printer. When separate ink cartridges are provided for individual colors, a pressing force of about 4.9 to 6.9 N is sufficient. However, for an ink cartridge unit of a single package type wherein ink cartridges for a plurality of colors are integrally formed, since a plurality of needles are provided, a very large pressing, which is plural times as large as 4.9 to 6.9 N, is required. Such a large pressing force can be exerted so long as the ink cartridge is loaded vertically; however, when the ink cartridge is to be slid in a direction other than the vertical direction during the loading process, an unnatural force is also imposed on the ink jet printer. Thus, the application of such a large pressing force is practically impossible.

Disclosed in patent document 1 is an ink cartridge attachment/detachment device that employs the principle of the lever to obtain a large pressing force. According to this device, the rotation of a cartridge attachment/detachment lever is transmitted to a link plate to enable the unlocking of a link lever and the loading of an ink cartridge into a holder.

However, this device is one developed for the loading of ink cartridges for individual colors, and does not provide the large pressing force required to cope with an ink cartridge unit of a single package type wherein ink cartridges for a plurality of colors are integrally formed. Further, if a cartridge attachment/detachment lever and a link plate provided for each of the color ink cartridges, the number of parts would be increased, and accordingly, the costs for parts would be higher.

Further, a cartridge that is being loaded, or has been loaded, is always subjected to another force for returning the ink cartridge from a flow path member that is connected to the ink cartridge. Therefore, to maintain the loaded state, the pressing force for loading the ink cartridge must be greater than this other force. Otherwise, a gap would appear between the ink cartridge and the flow path member, and contact points provided for the ink cartridge and the flow path member would be shifted, making it impossible to detect the amount of ink remaining. Furthermore, a positional shifting of the contact points may also occur due to variances in the size tolerances for the parts. However, a configuration that will provide such a large pressing force and maintain a closed contact state is not disclosed in patent document 1.

Patent Document 1: JP-A-11-157094

To resolve these problems, it is one objective of the present invention to provide an ink cartridge attachment/detachment device wherein, even when an ink cartridge unit of a single package type, for which a plurality of color ink cartridges are integrally formed, is employed (i.e. even when an ink cartridge containing different types of ink therein is employed), very little power is required to produce and apply a large pressing force to securely load the ink cartridge, so that, while the ink cartridge can be easily removed, position shifting of the loaded ink cartridge does not occur, and to provide a recording apparatus comprising this attachment/detachment device.

It is another objective of the present invention to provide a liquid container that can be easily fixed to a attachment/detachment device even when large pressing force is required for loading.

It is yet another objective of the present invention to provide a liquid container that can be easily removed from a attachment/detachment device even when large pressing force is required for loading.

SUMMARY OF THE INVENTION

To achieve this objective, according to a first aspect of the invention, an ink cartridge attachment/detachment device, which loads an ink cartridge into the main body of a recording apparatus by sliding the ink cartridge, comprises: cartridge holding means for holding the ink cartridge upon insertion of the ink cartridge by a predetermined stroke; and a rotating and sliding mechanism, using the rotation of a lever arm and the leverage principle, for producing the pressing force required for loading the ink cartridge, and for converting the rotation of the lever arm into movement of another predetermined stroke required for the loading the ink cartridge.

According to the first aspect, since the lever arm, for which a comparatively long distance can be obtained between the operating point and the fulcrum, is employed, a comparatively large lever ratio can be obtained. Therefore, since by applying the leverage principle very little power is required to produce a large pressing force, even a single package type ink cartridge unit can be easily loaded or removed.

According to a second aspect of the invention, for the ink cartridge attachment/detachment device of the first aspect, the cartridge holding means includes: an unlocking mechanism that can remove the ink cartridge from the main body of the recording apparatus by merely rotating the lever arm.

According to the second aspect, since the ink cartridge can be removed from the main body of the recording apparatus simply by performing a single-touch operation, i.e., the rotation of the lever arm, the operation performed to remove the ink cartridge can be smoothly executed and simplified.

According to a third-aspect of the invention, for the ink cartridge attachment/detachment device of the second aspect, the unlocking mechanism includes: an unlocking pin that is moved together with the ink cartridge as the lever arm is rotated; and an elastic unlocking piece for releasing the locked state of the ink cartridge by differentiating travel loci of the unlocking pin in the direction in which the ink cartridge is inserted and in the direction in which the ink cartridge is removed. According to the third aspect of the invention, the travel locus for the unlocking pin is set so that the ink cartridge is locked in the direction in which the ink cartridge is inserted and is unlocked in the direction in which the ink cartridge is removed. Thus, only a single-touch operation is required to remove the ink cartridge.

According to a fourth aspect of the present invention, for the ink cartridge attachment/detachment device of one of the first to third aspects, the cartridge holding means includes: a lock slider, which is brought into contact with a driving rib projecting from one of two opposite sides of the ink cartridge and which is slid against an urging force exerted by an extraction spring; a slider holder, which is moved together with a movable frame while holding the lock slider so that the lock slider is slidable; an engagement pawl, which is pivotally connected to the lock slider and which engages an engagement rib formed on the slider holder to combine the lock slider and the slider holder together; a lock spring for urging the engagement pawl toward the engagement rib; and a slide lock piece, which slides, relative to the slider holder, in a direction perpendicular to a loading direction in which the ink cartridge is loaded and which has a guide protrusion that engages a guide groove formed in the slider holder. According to the fourth aspect, by employing a predetermined stroke to insert the ink cartridge, the ink cartridge is held securely, while the ink cartridge, the movable frame, the slider holder and the lock slider are combined to form a single unit. Therefore, only an extremely simple operation is required to securely hold the ink cartridge.

According to a fifth aspect of the invention, for the ink cartridge attachment/detachment device of one of the first to the fourth aspects, the lever arm includes: a base end, which is rotatably connected to an upright rotation pin provided on a fixed frame; an arm main body, which extends from the base end toward the rear face of the main body of the recording apparatus; and a knob, which is attached to the distal end of the arm main body, wherein a bi-stable spring is suspended between the base end and the fixed frame and urges the lever arm to be positioned at either one of right and left rotation ends.

According to the fifth aspect, when the lever arm is pivoted to either the left or the right by the force exerted by the bi-stable spring, the lever arm is automatically moved to and halted at either the right or the left rotation end. Therefore, the ink cartridge is not incompletely positioned when halted, but is halted either at a position whereat the ink cartridge is completely loaded into the main body of the recording apparatus, or at a standby position whereat the inserted ink cartridge is accepted. Further, in order to obtain such effects, a bi-stable spring having a comparatively large line diameter and a large urging force is employed. Therefore, the bi-stable spring also has a function for positioning the ink cartridge so it projects slightly toward the rear face of the main body of the recording apparatus and facilitates the easy removal of the ink cartridge from the main body.

According to a sixth aspect of the invention, for the ink cartridge attachment/detachment device of the fifth aspect, a transmission member that is rotated together with the lever arm is connected through a pressure increase spring to the base end of the lever arm; and wherein, when the lever arm is rotated in a predetermined direction to load the ink cartridge, an urging force exerted by the pressure increase spring presses and holds the ink cartridge so that the ink cartridge closely contacts a flow path member. According to the sixth aspect, even when a gap is opened between the ink cartridge and the flow path member by the returning force exerted by the flow path member and the variances in part tolerances, the urging force exerted by the pressure increase spring is applied to the ink cartridge and the flow path member, so that these two members are held to always closely contact each other.

According to a seventh aspect of the invention, for the ink cartridge attachment/detachment device of one of the first to the sixth aspects, the rotating and sliding mechanism is constituted by a rack and pinion mechanism. According to the seventh aspect, a comparatively simple structure can be used to convert the rotation of the lever arm into the movement of the movable frame or of the ink cartridge that is held by the movable frame, the movement being the movement of the predetermined stroke required for lading the ink cartridge. Further, since a transmission path or the length of an action can be comparatively increased by employing the rack, the number of parts can be reduced, compared with when multiple gear trains are employed to provide the transmission path.

According to an eighth aspect of the invention, for the ink cartridge attachment/detachment device of the seventh aspect, the rotating and sliding mechanism includes: a first pinion, which is attached to the base end of the lever arm to rotate together with the lever arm; a slide bar, which has a first rack meshing with the first pinion and a second rack for transmitting the movement of the first rack downstream along a transmission path; a combination pinion, which has a second pinion meshing with the second rack and a third pinion for transmitting the rotation of the second pinion downstream along the transmission path; and a third rack, which is provided on the movable frame slidably attached to the fixed frame and meshes with the third pinion.

According to a ninth aspect of the invention, for the ink cartridge attachment/detachment device of the sixth aspect, the transmission path provided by the second rack, the second pinion, the third pinion and the third rack is arranged in each of right and left sides of the lever arm.

According to the eighth and the ninth aspects of the invention, regardless of the position of the rotational fulcrum of the lever arm, an optimal point for smoothly sliding the movable frame can be designated as the last application point for the transmission of force to the movable frame. When the transmission paths are arranged on both sides, the movable frame can be prevented from being inclined when the ink cartridge is attached and detached, and further, the ink cartridge can be smoothly and steadily loaded and removed.

According to a tenth aspect of the invention, the ink cartridge attachment/detachment device of one of the first to the ninth aspects further comprises: ink cartridge erroneous insertion prevention means for preventing the insertion of the ink cartridge when the lever arm is located at a set position at which the lever arm is supposed to be when loading of the ink cartridge is completed, or when the lever arm is located at a position other than a reset position at which loading of the ink cartridge is enabled, or when the ink cartridge is to be inserted while only the cartridge holding means on one side is operated.

The main conventional erroneous insertion prevention means for an off-carriage ink cartridge are: one for electrically detecting electrical conduction, and another one for physically preventing the insertion of an ink cartridge that does not engage a protrusion that is formed on the cartridge holder side. However, these means can be applied for ink cartridges provided for individual colors, and are not always satisfactory for an ink cartridge unit, of a single package type, for which a plurality of color ink cartridges are integrally formed.

Whereas, according to the tenth aspect of the invention, when the lever arm is located at a position, other than the reset position, whereat the ink cartridge should not be inserted, and when the ink cartridge is to be inserted at this time, operation of the cartridge holding means is not performed, and an erroneous insertion of the ink cartridge is prevented. Further, when the ink cartridge is to be inserted while the ink cartridge holding means only on one side is being operated, the ink cartridge is tilted, so that the insertion of the ink cartridge is incomplete. Therefore, the means provided in the tenth aspect is effective as the prevention means for the erroneous insertion of an ink cartridge of a single package type.

According to an eleventh aspect of the invention, for the ink cartridge attachment/detachment device of the tenth aspect, the ink cartridge erroneous insertion prevention means includes: an erroneous insertion prevention protrusion protruded from the fixed frame of the recording apparatus toward a lock slider; a slide lock piece sliding, relative to the lock slider, in a direction perpendicular to the direction in which the ink cartridge is inserted; and a guide groove formed in a slider holder moved together with the movable frame of the recording apparatus, and engaged with a guide protrusion provided on the slide lock piece, wherein the guide groove is shaped so that, when the ink cartridge is to be inserted while the lever arm is located at the set position, the slide lock piece takes a traveling locus to be brought in contact with the erroneous insertion prevention protrusion and to prevent the insertion of the ink cartridge. According to the eleventh aspect of the invention, when the lever arm is located at the set position, the erroneous insertion of the ink cartridge is inhibited with a comparatively simple structure wherein the erroneous insertion prevention protrusion is formed on the fixed frame and the shape of the guide groove is contrived.

According to a twelfth aspect of the invention, for the ink cartridge attachment/detachment device of the tenth or the eleventh aspect, the ink cartridge erroneous insertion prevention means includes: an erroneous insertion prevention protrusions protruded from the fixed frame of the recording apparatus toward a lock slider; a slide lock piece sliding, relative to the lock slider, in a direction perpendicular to the direction in which the ink cartridge is inserted; and a guide groove formed in a slider holder moved together with the movable frame of the recording apparatus, and engaged with a guide protrusion provided on the slide lock piece, wherein the guide groove is shaped so that, when the lever arm is pivoted from the reset position to the set position while only the cartridge holding means on one side is operated, the slide lock piece located close to the cartridge holding means on the other side that is not operated takes a traveling locus to be brought into contact with the erroneous insertion prevention protrusion and to prevent the insertion of the ink cartridge. According to the twelfth aspect of the invention, with a comparatively simple structure where the erroneous insertion prevention protrusion is formed on the fixed frame and the shape of the guide groove is contrived, the erroneous insertion of the ink cartridge can be prevented when the lever arm is pivoted from the reset position to the set position while only the cartridge holding means on one side is operated.

According to a thirteenth aspect, for the ink cartridge attachment/detachment device of one of the tenth to the twelfth aspects, the ink cartridge erroneous insertion prevention means includes: a collision avoiding unit for, when the ink cartridge is inserted while the lever arm is located at a position other than the reset position, preventing deformation of an elastic unlocking piece which is caused by a collision to an unlocking pin provided on an engagement pawl. According to the thirteenth aspect, since the collision avoiding unit is provided, even when the ink cartridge is inserted while the lever arm is located at a position other than the reset position, the collision of the unlocking pins to the flexible unlocking pieces can be avoided, and the deformation of the flexible unlocking pieces due to the collision is prevented beforehand.

According to a fourteenth aspect of the invention, for the ink cartridge attachment/detachment device of the thirteenth aspect, the collision avoiding means includes: a collision avoiding convex portion rotating together with the engagement pawl; and a sliding face contacting the collision avoiding convex portion and being integrally formed in an engagement rib to be engaged with the engagement pawl, wherein a rotating locus for the engagement pawl is set so that, when the lever arm is located at a position other than the reset position and when the ink cartridge is inserted, a normal rotating locus of the engagement pawl by which the unlocking pin collides with the elastic unlocking piece is corrected and an avoiding rotating locus by which the unlocking pin do not collide with the elastic unlocking piece is selected. According to the fourteenth aspect of the invention, with a comparatively simple structure that the collision avoiding convex portion and the sliding face are provided, the normal rotating locus of the engagement pawl can be corrected and changed to the avoiding rotating locus, and the collision of the unlocking pin to the elastic unlocking piece can be prevented.

According to a fifteenth aspect of the invention, for the ink cartridge attachment/detachment device of one of the tenth to the fourteenth aspects, the ink cartridge erroneous insertion prevention means includes: an erroneous insertion prevention flap which adopts a retraction attitude when the lever arm is located at the reset position, and adopts a projection attribute when the lever arm is located at a position other than the reset position; and a rotational direction changing mechanism for converting the movement of the lever arm into the movement of the erroneous insertion prevention flap. According to the fifteenth aspect, since the erroneous insertion prevention flap is projected when the lever arm is located at a position other than the reset position, the insertion of the ink cartridge is physically impossible. Further, when the erroneous insertion prevention flap in the projection attitude comes into sight of a user who tries to insert the ink cartridge, the user can visually identify the insertion of the ink cartridge is inhibited.

According to a sixteenth aspect of the invention, for the ink cartridge attachment/detachment device for the fifteenth aspect, the erroneous insertion prevention flap includes: a flap main body directly contacting an insertion end face of the ink cartridge to prevent the erroneous insertion of the ink cartridge; a rotary shaft rotatably connected to the fixed frame so that an axial direction of the rotary shaft is set in the widthwise direction of the fixed frame; and a conversion cam follower provided to an end face opposite to the flap main body with the rotary shaft in between, wherein the erroneous insertion prevention flap always adopts the projection attitude by receiving an urging force from urging means that is arranged between the fixed frame and the flap. According to the sixteenth aspect, the erroneous insertion prevention flap has a comparatively simple and functional structure, and is so located as to physically, visually and effectively prevent the erroneous insertion of the ink cartridge.

According to a seventeenth aspect of the invention, for the ink cartridge attachment/detachment device of the fifteenth or the sixteenth aspect, the rotational direction changing mechanism includes: a trigger which pivots in a direction of the movement of the lever arm by a predetermined angle about a rotation pin provided upright on the upper face of the fixed frame; a conversion cam follower provided to the erroneous insertion prevention flap; and urging means for urging the trigger so as to always rotate toward the lever arm.

According to an eighteenth aspect of the invention, for the ink cartridge attachment/detachment device of the seventeenth aspect, the trigger includes: an arm rotatably connected to the rotation pin, and extending in the radial direction; and a conversion operating portion extending in the circumferential direction from the distal end of the arm toward the lever arm and the erroneous insertion prevention flap, wherein the conversion operating portion has, at its input side, an input contact portion that directly contacts the lever arm, and, at its output side, a conversion cam face, which slides and contacts the conversion cam follower of the erroneous insertion prevention flap.

According to the seventeenth and the eighteenth aspects of the invention, with a comparatively simple structure where only a trigger in a predetermined shape is arranged, the rotational movement of the lever arm can be converted into the rotational movement of the erroneous insertion prevention flap. Therefore, the ink cartridge can be inserted only when the lever arm is located at the reset position.

According to a nineteenth aspect of the invention, the ink cartridge attachment/detachment device of one of the first to the eighteenth aspects further comprises: creep load reduction means for reducing a creep load, which is imposed on the individual sections in the main body of the recording apparatus, that is caused when the lever arm continuously stays at the set position at which the lever arm is supposed to be when loading of the ink cartridge is completed.

When the lever arm is located at the set position, a considerably large load is imposed on the individual sections in the main body of the recording apparatus. When this state is continued, a creep is caused in the sections in the main body of the recording apparatus, and pressing force required to keep the ink cartridge in contact with the flow path member can not be obtained. According to the nineteenth aspect of the invention, since the creep load reduction means is provided, the individual sections in the main body of the recording apparatus are maintained in the state where the creep does not occur. Further, although the ink cartridge is slightly retracted, the pressing force required for loading of the ink cartridge is obtained. Therefore, since a large load to cause a creep is not imposed on the individual sections in the main body of the recording apparatus, the pressing force required for loading of the ink cartridge is constantly obtained, regardless of how often the ink cartridge is attached and detached.

According to a twentieth aspect of the invention, for the ink cartridge attachment/detachment device of the nineteenth aspect, the creep load reduction means includes: urging means for urging the lever arm located at the set position to rotate toward the reset position; and a lever arm stop mechanism for halting the lever arm at a set standby position that is located backward from the set position toward the reset position by a predetermined pitch.

According to the twentieth aspect of the invention, the lever arm at the set position is automatically moved to the reset position by the force of the urging means, and is halted at a predetermined set standby position by the action of the lever arm stop mechanism. Therefore, without a user's special attention, the lever arm can automatically reach the set standby position, so that the usability can be improved. Furthermore, since the load imposed on the individual sections in the main body of the recording apparatus is reduced, the service life of the main body of the recording apparatus can be extended.

According to a twenty-first aspect, for the ink cartridge attachment/detachment device of one of first to twentieth aspect, an ink cartridge insertion state judging means is provided, which, when a user attempts to insert the ink cartridge beyond a predetermined distance, stops the ink cartridge at a predetermined position before the loading of the ink cartridge, and makes it possible for the user to judge whether insertion state of the ink cartridge is normal or not.

Since insertion of the ink cartridge depends on user's activity, there is a possibility of erroneous insertion (abnormal insertion state) such as tilted insertion in which the ink cartridge is inserted in a state that the cartridge holding means in only one side is operated, and thus there is a possibility that the ink cartridge erroneously inserted maybe loaded without correction (hereafter referred to as erroneous load).

According to the twenty-first aspect of the present invention, because the ink cartridge insertion state judging means stops the ink cartridge at a predetermined position before the loading of the ink cartridge when a user attempts to insert the ink cartridge beyond a predetermined distance, the user can visually confirm a rear end portion of the ink cartridge to easily judge whether insertion state of the ink cartridge is normal or not. As a result, if the insertion state is not normal, then the user can insert again the ink cartridge correctly. Therefore, it is possible to remarkably reduce a possibility that the ink cartridge in the abnormal insertion state and without correction is erroneously loaded by rotation of the lever arm.

According to a twenty-second aspect of the present invention, for the ink cartridge attachment/detachment device of the twenty-first aspect, the ink cartridge insertion state judging means includes: a lever arm rotation restricting mechanism which restricts rotation of the lever arm from a reset position toward a set position so as to stop the inserted ink cartridge at the predetermined position.

According to the twenty-second aspect of the present invention, even if a user attempts to insert the ink cartridge beyond the predetermined distance, the rotation of the lever arm from the reset position toward the set position is restricted. Accordingly, the movement of the rotating and sliding mechanism is also restricted. Therefore, the ink cartridge can be stopped at the predetermined position. As a result, by restricting the rotation of the lever arm only, the user can easily judge whether the insertion state of the ink cartridge is normal or not.

According to a twenty-third aspect of the present invention, for the ink cartridge attachment/detachment device of the twenty-second aspect, the lever arm rotation restricting mechanism includes: a restricting portion which is disposed at the reset position on a guide for guiding the rotation of the lever arm and which restricts the rotation of the lever arm toward the set position.

According to the twenty-third aspect of the present invention, since the restricting portion is formed at the reset position on the guide for guiding the rotation of the lever arm, the lever arm rotation restricting mechanism can be readily constructed without increase of component parts and with low cost.

According to a twenty-fourth aspect of the present invention, for the ink cartridge attachment/detachment device of one of first to twenty-third aspects, there is provided an ink cartridge erroneous load warning means, which, when the ink cartridge in abnormal insertion state is erroneously loaded, notifies a user of the erroneous loading of the ink cartridge.

Even if a structure that makes it difficult to perform erroneous insertion of the ink cartridge is adopted, it is difficult to completely eliminate the erroneous insertion of the ink cartridge (abnormal insertion state) because the insertion operation depends on user's activity.

For this reason, according to the twenty-fourth aspect of the present invention, the ink cartridge erroneous load warning means is provided, which, when the ink cartridge in abnormal insertion state (erroneous insertion state) is erroneously loaded, can notify the user of the erroneous loading of the ink cartridge. Therefore, upon the notification, the user can correctly insert the ink cartridge again, and then load the ink cartridge. Accordingly, it is possible to remarkably reduce a possibility that the ink cartridge in abnormal insertion state (erroneous insertion state) and without correction is erroneously loaded by the rotation of the lever arm. Further, it is possible to remarkably reduce a possibility that the ink cartridge erroneously loaded is left as it is, and therefore it is possible to remarkably reduce a possibility that ink is leaked by capillary action due to incomplete sealing state between the ink supply needle and the sealing rubber.

According to a twenty-fifth aspect of the present invention, for the ink cartridge attachment/detachment device of the twenty-fourth aspect, the ink cartridge erroneous load warning means includes: a rotatable lid member capable of closing an insertion opening portion for the ink cartridge; and a rib formed on an inner side of the lid member, wherein when the ink cartridge is erroneously loaded, the rib abuts against the ink cartridge and restricts rotation of the lid member, to thereby prevent the lid member from being closed.

According to the twenty-fifth aspect of the present invention, when the ink cartridge is erroneously loaded, the rib on the inner side of the lid member abuts against the ink cartridge and restricts the rotation of the lid member, to thereby prevent the lid member from being closed. In this manner, the erroneous loading can be notified to the user. That is, upon the notification, the user can insert the ink cartridge again, and then load the ink cartridge again.

According to a twenty-sixth aspect of the present invention, for the ink cartridge attachment/detachment device of the twenty-fifth aspect, the ink cartridge erroneous load warning means further includes: a lid member open/close detector which detects open/close of the lid member.

According to the twenty-sixth aspect, since the lid member open/close detector can detect open/close of the lid member, the fact that the lid member is not closed can be converted into an electric signal by which that fact can be notified to the user by way of warning display or the like.

According to a twenty-seventh aspect of the present invention, for the ink cartridge attachment/detachment device of the twenty-sixth aspect, the ink cartridge erroneous load warning means further includes: an ink cartridge erroneous loading state controller which prevents the recording apparatus main body from being activated until the lid member open/close detector detects close of the lid member.

According to the twenty-seventh aspect, by provision of the ink cartridge erroneous loading state controller, there is no possibility that the recording apparatus main body is activated, until the close of the lid member is detected by the lid member open/close detector. Therefore, there is no possibility that the recording apparatus main body conducts an initial filling step or the like for filling ink into ink flow passages provided within the recording head when the ink cartridge is erroneously loaded. Accordingly, there is no possibility that waste ink is leaked outside the apparatus due to the initial filling step or the like, even if the ink cartridge is erroneously loaded.

According to a twenty-eighth aspect of the invention, a recording apparatus comprises: an ink cartridge attachment/detachment device according to one of the first to the twenty-seventh aspects, which slides an ink cartridge to load into a main body of the recording apparatus. According to the twenty-eighth aspect of the invention, the recording apparatus can be provided wherein the ink cartridge can be attached and detached steadily with an extremely small force.

According to a twenty-ninth aspect of the invention, a liquid ejection apparatus comprises: a liquid cartridge attachment/detachment device, for sliding a liquid cartridge, and for loading the liquid cartridge into a main body of the liquid ejection apparatus; cartridge holding means for holding the liquid cartridge upon insertion of the liquid cartridge by a predetermined stroke; and a rotation and sliding mechanism, using rotation of a lever arm and the leverage principle, for producing pressing force required for loading the liquid cartridge, and for converting the rotation of the lever arm into movement of another predetermined stroke required for loading the liquid cartridge.

According to a thirtieth aspect of the present invention, a liquid container, which is employed for a liquid ejection apparatus that includes a liquid container accommodation portion, in which the liquid container is accommodated, and a slider, which slides in a direction in which the liquid container is inserted while holding the liquid container in the liquid container accommodation portion, comprises: a case internally having a liquid containing portion; and a supply portion for externally introducing a liquid in the liquid containing portion that is formed on one side wall of the case, wherein a contact portion, which contacts one part of the slider to enable the slider to move in the direction in which the liquid container is inserted, and an engagement portion, which is engaged with a lock portion provided on the slider, are formed on a side wall that intersects the side wall where the supply portion is formed.

According to the thirtieth aspect, the contact portion that contacts one part of the slider is formed on the side wall of the case of the liquid container. In this case, the engagement portion that engages the lock portion of the slider is provided on the case. When the liquid container is inserted into the attachment/detachment device, the contact potion is brought in contact with one part of the slider, and pushes and moves the slider. Further, when the liquid container is inserted, the engagement portion of the case is engaged with the lock portion of the slider, so that the case is fixed to the slider. Therefore, since the liquid container can be moved to the connector side while being held by the slider, the liquid container can be connected to the connector through the stable operation.

According to the thirty-first aspect of the present invention, for the liquid container of the thirtieth aspect, the contact portion is projected outside the case.

With this arrangement, since the contact portion is projected outside the case, when the liquid container is inserted into the attachment/detachment device, the contact portion can be easily brought in contact with the lock portion provided on the slider.

According to the thirty-second aspect, for the liquid container of the thirtieth aspect or the thirty-first aspect, the engagement portion is recessed in one face of the case, and as the lock portion is entered to the engagement portion, the engagement portion and the lock portion are engaged together.

According to the arrangement, since the engagement portion is recessed in one face of the case, the locking portion need only be entered to the engagement portion to engage these portions. As a result, the case can be more securely fixed to the slider.

According to a thirty-third aspect, for the liquid container of any one of thirtieth to thirty-second aspects, a contact face, which is formed on the contact portion and contacts one part of the slider, is connected to one face of the engagement portion.

According to this arrangement, since the contact face of the contact portion is integrally formed with one face of the engagement portion, the lock portion can be positioned by using the contact face and can be engaged with the engagement portion.

According to a thirty-fourth aspect, for the liquid container of any one of thirtieth to thirty-third aspects, a reinforcing portion, for reinforcing the contact portion, is provided on one face of the case.

According to this arrangement, since the reinforcing portion for reinforcing the contact portion is provided on the case, the damage on the contact portion or a portion where the contact portion is formed can be prevented when one part of the slider abuts against the contact portion.

According to a thirty-fifth aspect, for the liquid container of any one of thirtieth to thirty-fourth aspects, at least one of an introducing portion for introducing a liquid into the case, a circuit board having a storage devices a positioning portion and an abutting portion that abuts against the liquid container accommodation portion is formed in the case.

According to this arrangement, since at least one of an introducing portion for introducing a liquid into the case, a circuit board having a storage device, a positioning portion, and an abutting portion that abuts against the liquid container accommodation portion is formed in the case, the function of the liquid container can be improved.

According to a thirty-sixth aspect, for the liquid container of any one of thirtieth to thirty-fifth aspects, a circuit board having a storage device and an abutting portion abutting against the liquid container accommodation portion are formed in the case, and the engagement portion, the circuit board and the abutting portion are arranged at a relative distances in the named order from the bottom of the case toward the height of the case.

According to this arrangement, not only the engagement portion, but also the circuit board and the abutting portion are formed in the case, and the engagement portion, the circuit board and the abutting portion are arranged at relative distances in the named order from the bottom of the case toward the height of the case. That is, the case is supported by engagement of the engagement portion with the lock portion and by abutment of the abutting portion against the liquid ejection apparatus. Therefore, the moment of force is generated in the direction in which the circuit board is pressed against the terminal arrangement portion of the liquid ejection apparatus, and the connection between the circuit board and the terminal arrangement portion can be stabilized.

According to thirty-seventh aspect, for the liquid container of any one of thirtieth to thirty-sixth aspects, the contact portion and the engagement portion are located on the face of the case, which face is substantially in parallel to the direction in which the liquid container is inserted, and is opposed to the slider.

According to this arrangement, since the contact portion and the engagement portion are located on the face of the case, which face is substantially in parallel to the direction in which the liquid container is inserted, and is opposed to the slider, the slider can be easily brought in contact with the contact portion when the liquid container is inserted.

The present disclosure relates to the subject matter contained in Japanese patent application Nos. 2003-424832 (filed on Dec. 22, 2003), 2004-031295 (filed on Feb. 6, 2004), 2004-032152 (filed on Feb. 9, 2004) and 2004-244780 (filed on Aug. 25, 2004), each of which is expressly incorporated herein by reference in its entirety.

BRIEF DESCRIPTION OF THE DRAWINGS

FIGS. 27A, 27B and 27C are side cross-sectional views of the operating state of the ink cartridge erroneous insertion prevention unit when the normal insertion is performed.

DESCRIPTION OF THE PREFERRED EMBODIMENT

Figure 1:
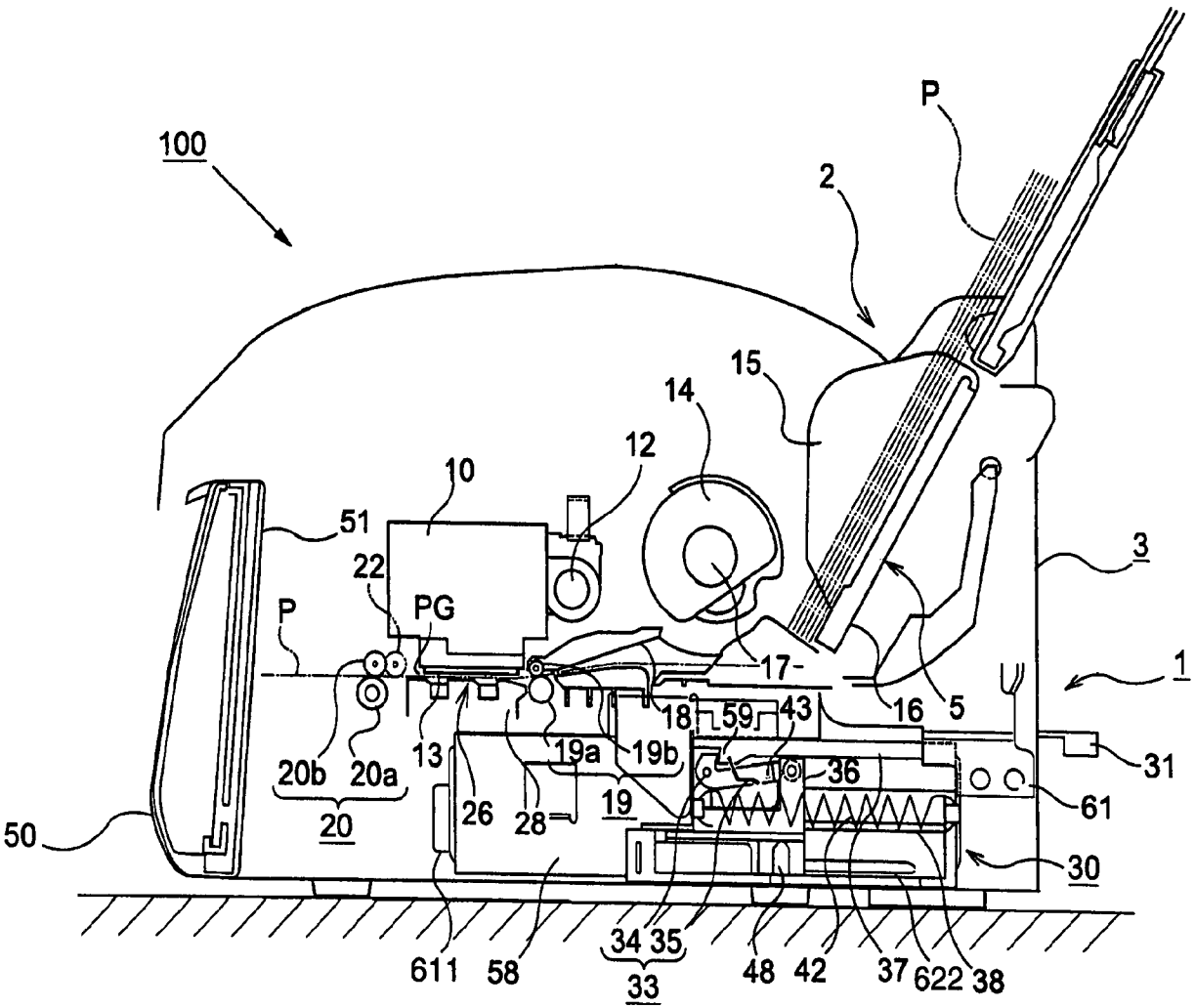
FIG. 1 is a side cross-sectional view of the overview of an ink jet printer.

An explanation will now be given for an ink cartridge attachment/detachment device and an ink cartridge according to the present invention, and a recording apparatus that is an example liquid ejection apparatus comprising the ink cartridge attachment/detachment device. First, an ink jet printer is employed as the best mode for carrying out the recording apparatus, and the overview of the general configuration will be described while referring to the drawings. FIG. 1 is a schematic side cross-sectional view of the ink jet printer when an ink cartridge is loaded.

(Ink Jet Printer)

In an ink jet printer 100, a carriage 10 is supported by a carriage guide shaft 12 to reciprocate in the main scanning direction (direction perpendicular to the plane of paper in FIG. 1). The carriage 10 is the main component of recording means that is example liquid ejection means for recording a recording material P (hereinafter simply referred to also as a sheet P) that is an example target material for liquid ejection. A recording head 13 is mounted on the carriage 10, and is an example liquid ejection head for discharging (ejecting) ink, which is an example liquid, to the sheet P. In the space of a main body 3 of the recording apparatus below the carriage 10, an ink cartridge 611 of a single package, which is an example liquid cartridge (liquid container), is loaded through an ink cartridge attachment/detachment device 1 according to the present invention that will be described later.

An ink supply mechanism (not shown) is connected to the attachment/detachment device 1. This ink supply mechanism includes, for example, a valve mechanism and a tube by which the attachment/detachment device 1 communicates with the recording head 13. The ink supply mechanism supplies ink from the ink cartridge 611 through the tube to the recording head 13.

A platen 28 is located under and opposite to the recording head 13 to define a gap PG between the head face of the recording head 13 and the sheet P. The sheet P is recorded by alternately and repetitively performing a sheet conveying operation and an ink ejection operation, that is: an operation for conveying the sheet P between the carriage 10 and the platen 28 by a predetermined distance in a sub-scanning direction (transverse direction on the plane of paper in FIG. 1) that is perpendicular to the main scanning direction; and an operation for ejecting ink to the sheet P from the recording head 13 during a period in which the recording head 13 is reciprocated one time in the main scanning direction.

The configuration of the ink jet printer 100 will be further described based on a path for conveying the sheet P. First, a feed tray 5, which is an example target material stacking portion for stacking the sheets P, is located uppermost stream in the conveying direction. An edge guide 15 is provided for the feed tray 5 to contact the side edges of the sheets P and to smoothly guide the sheet P in the sub-scanning direction. As a rotary shaft 17 of a feed roller 14 is rotated, a hopper 16 is raised at a predetermined timing, and pushes up the sheets P on the feed tray S toward the feed roller 14.

The section including the feed tray 5, the feed roller 14 and the hopper 16 is an automatic sheet feeder 2. As the feed roller 14 is rotated, a predetermined unit number of sheets P are sequentially picked up beginning from the topmost sheet P by a force exerted by a separation pad, which is an example of a separation portion provided near the feed roller 14. The thus picked up sheet P is conveyed downstream in the conveying direction.

A recording material detector (not shown) (hereinafter referred to simply as a detection lever), which is example target material detection means for detecting that the sheet P is passed by, is provided downstream the feed roller 14. Further, a convey roller pair 19, which includes a drive roller 19*a* and a coupled roller 19*b* used for conveying, is provided downstream the detection lever. The coupled roller 19*b* is supported downstream a roller holder 18, which is rotatably attached at a rotary shaft (not shown) and is to be pivoted by a helical torsion spring (not shown), so that the coupled roller 19*b* is always in contact with the drive roller 19*a* under pressure to form a nip.

The sheet P, sandwiched and conveyed by the convey roller pair 19, is guided to a recording position 26 under the recording head 13, and a desired recording process is performed for substantially the entire recording face of the sheet P as the carriage 10 and the sheet P are moved in the aforementioned manner. The gap GP, which is defined between the recording head 13 and the platen 28 that is located under and opposite to the recording head 13, is an extremely important element for accurate recording, and is adjusted as needed in accordance with the thickness of the sheet P.

A discharge roller pair 20, which is example target material discharge means and includes a drive roller 20*a* and a toothed discharge roller 20*b*, is located downstream the recording head 13. The sheet P is discharged by the discharge roller pair 20, and is placed on a mounting face 51 of a discharge stacker 50, which is example target material accepting portion located downstream.

The toothed roller 20*b* has a plurality of teeth along the outer edge, and is rotatably supported by a roller holder (not shown) provided for a toothed roller. An auxiliary toothed roller 22 is located upstream the toothed roller 20*b*, and the sheet P is pushed slightly downward by the auxiliary toothed roller 22. The axis of the coupled roller 19*b* is slightly downstream than that of the driver roller 19*a*, while the axis of the toothed roller 20*b* is slightly upstream than that of the driver roller 20*a*.

With this configuration, between the convey roller pair 19 and the discharge roller pair 20, the sheet P is slightly bent and convex downwardly, i.e., is set in a so-called a "reverse warped" state. Further, the sheet P located opposite to the recording head 13 is pressed against the platen 28 to prevent the raising of the sheet P, and the proper recording is performed. It should be noted that the auxiliary toothed roller 22 has a plurality of teeth similarly to the toothed roller 20*b*, and is supported by a roller holder (not shown) provided for an auxiliary toothed roller.

Figure 16:
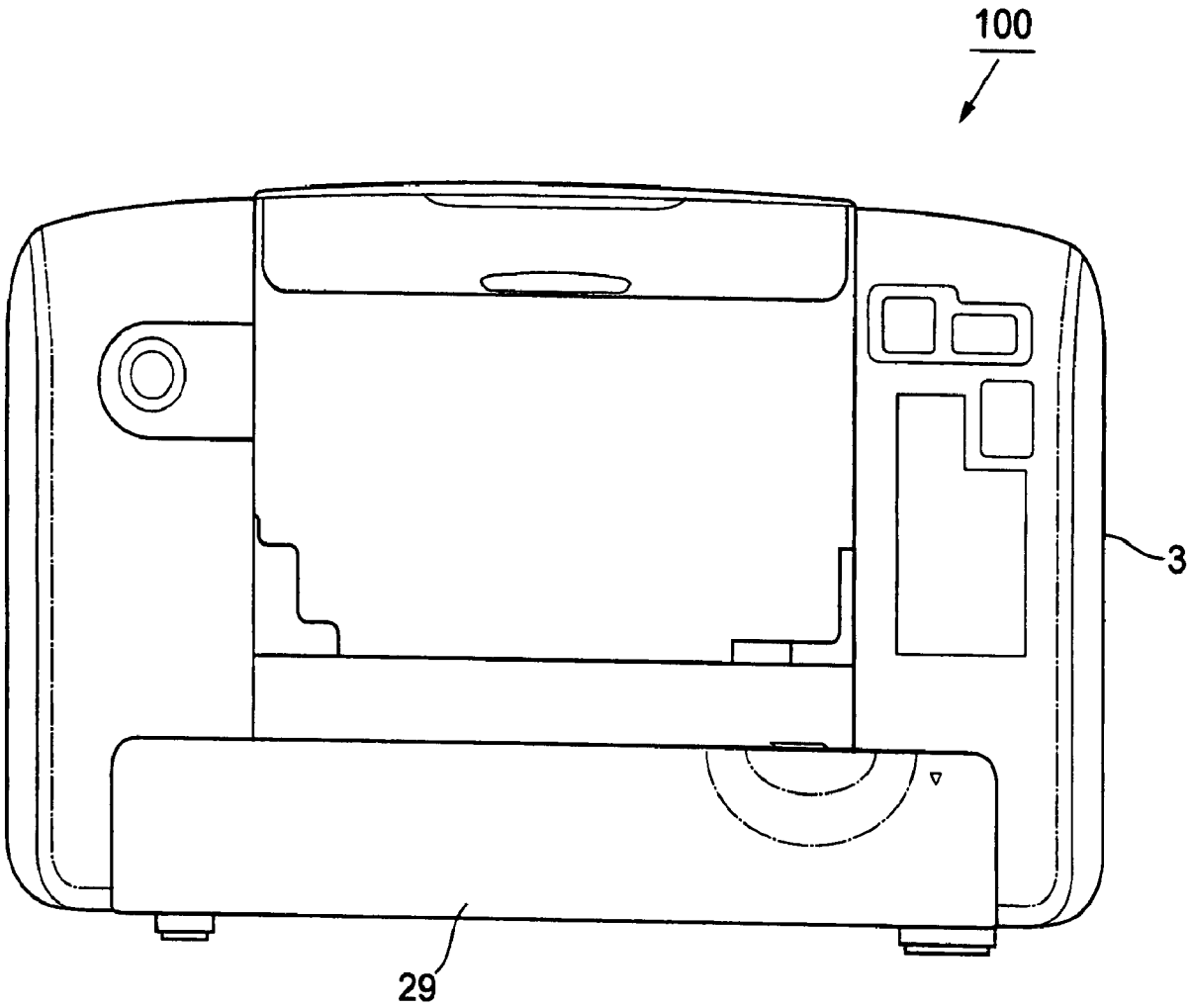
FIG. 16 is a rear view of an ink jet printer where a lid member is closed.

The ink jet printer 100 in this mode is a printer that employs the ink cartridge unit of single package type where a plurality of color ink cartridges are integrally formed, and that horizontally slides the ink cartridge 611 from a rear portion of the main body 3 below the feed tray 5 to load the ink cartridge therein. As is shown in FIG. 16, a lid member 29 is provided on the rear end face of the main body 3 to block an opening for insertion of the ink cartridge 611.

(Ink Cartridge)

Figure 38:
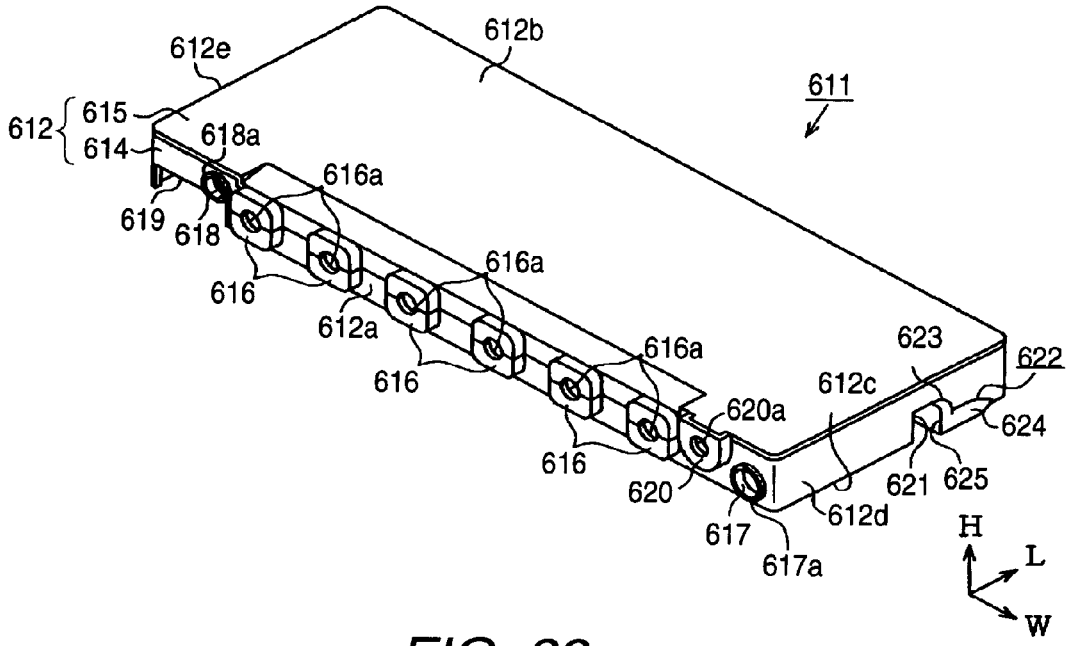
FIG. 38 is a perspective view of an ink cartridge to be loaded into the printer.
Figure 39:
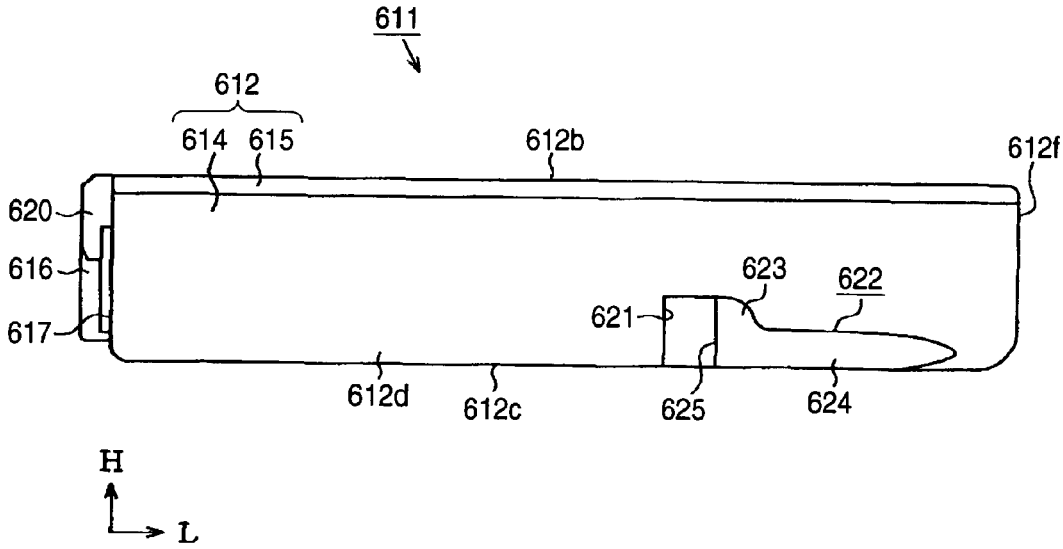
FIG. 39 is a side view of the ink cartridge.
Figure 40:
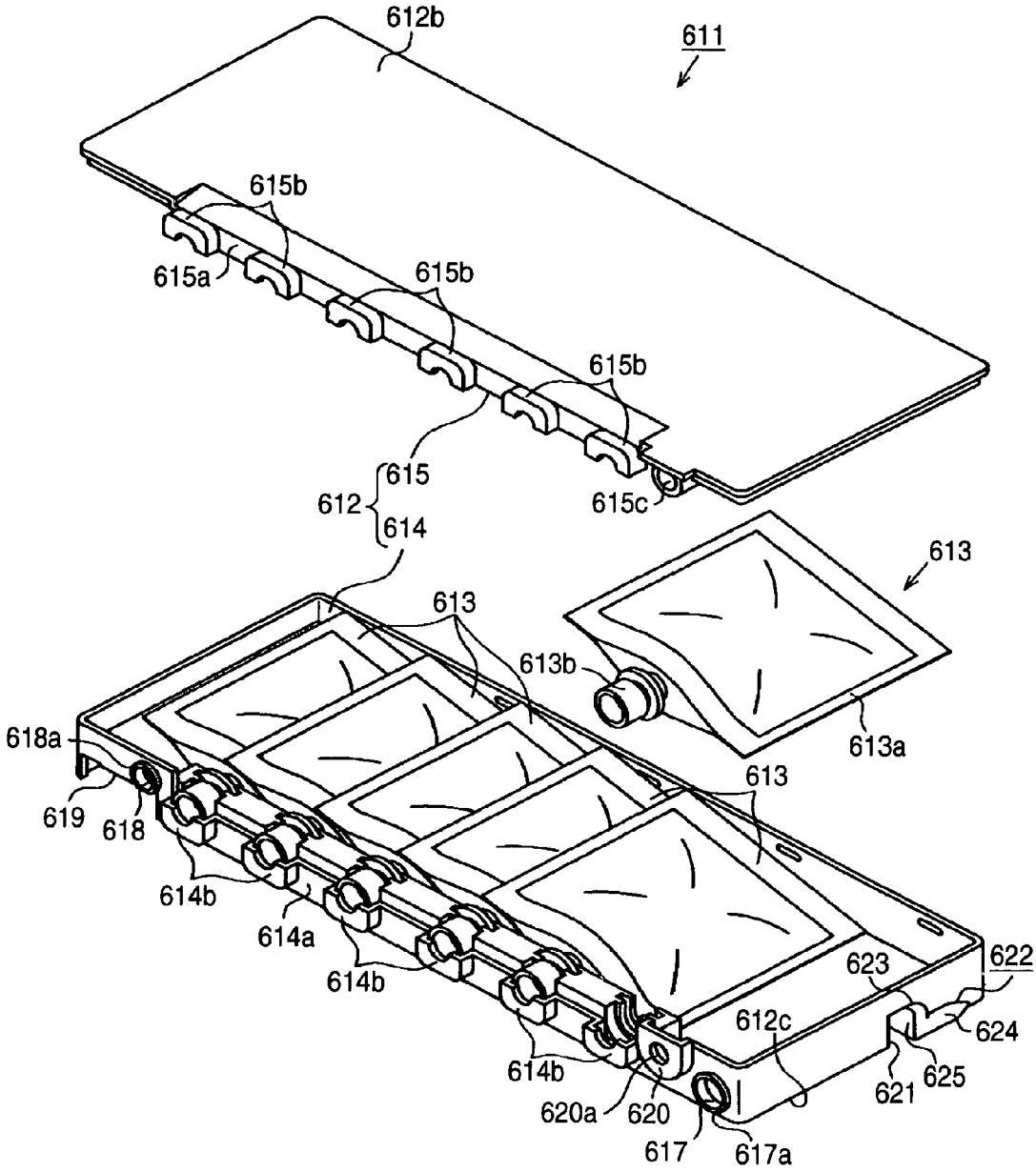
FIG. 40 is an exploded perspective view of the ink cartridge.

The ink cartridge 611 preferably used for the inkjet printer 100 will now be explained. FIG. 38 is a perspective view of the ink cartridge 611, FIG. 39 is a side view of the ink cartridge 611, and FIG. 40 is an exploded perspective view of the ink cartridge 611. As is shown in FIGS. 38 to 40, the ink cartridge 611 includes a case 612. As shown in FIG. 40, a plurality of ink packs 613 are stored in a case 612. In this embodiment, six ink packs 613 in which different types of ink are contained are stored. Each of the ink packs 613 has a bag 613*a* serving as a liquid containing portion, and an introducing portion 613*b* serving as a supply portion. The bag 613*a* is obtained by heat-sealing a film member or film members into a bag shape. The introducing portion 613*b* is sandwiched between the film member(s) while the base end thereof is inserted into the bag 613*a*. The introducing portion 613*b* has a flow path (not shown) in its interior so that ink contained in the bags 613*a* can be introduced to the outside.

As is shown in FIG. 40, the case 612 is formed of a container portion 614 and a lid 615. The container portion 614 has a box shape, and six lower supports 614*b* are formed on a front face 614*a*. To mount the ink packs 613 in the container portion 614, the introducing portions 613*b* of the ink packs 613 are fixed to the lower supports 614*b*. Upper supports 615*b* are formed on a front face 615*a* of the lid 615. To attach the lid 615 to the container portion 614, the upper supports 615*b* are fitted to the lower supports 614*b* to which the introducing portions 613*b* are fixed. As a result, as is shown in FIG. 38, supports 616 that constitute the supply portions are formed on a front face 612*a* of the case 612. An insertion hole 616*a* is provided in each of the supports 616. In case that the ink cartridge 611 is to be inserted, the front face 612*a* is directed to the attachment/detachment device 1, and an upper face 612*b* and a bottom face 612*c* are placed horizontally.

As is shown in FIG. 38, a first fitting hole 617 and a second fitting hole 618, which are positioning portions, are formed in the right and left ends of the front face 612*a* of the case 612 (container portion 614), respectively. Further, abutting portions 617*a* and 618*a*, each in a ring shape, are projected by one step from the front face 612*a*, and enclose the first and second fitting holes 617 and 618. The abutting portions 617*a* and 618*a* function as portions that abuts against a flow path member 4 (see FIG. 3), which will be described later, when the ink cartridge 611 is connected to the flow path member 4. A substrate recessed portion 619, which is a substrate attachment portion, is formed in the bottom face 612*c* of the case 612 (container portion 614) and below the second fitting hole 618. A circuit board having a storage device (not shown) is arranged in the substrate recessed portion 619. Further, an introduction support 620, which is used as an introduction portion, is formed on the front face 612*a* of the case 612 and between the first fitting hole 617 and the support 616 on the right end in FIG. 38. A flow path 620*a* is formed in the introduction support 620, and when the lid 615 is fixed to the container portion 614, the flow path 620*a* communicates with an introduction path 615*c* (see FIG. 40) that is formed in a front face 615*a* of the lid 615. The introduction path 615*a* communicates with a waste ink containing portion (not shown) that is provided on the back face of the lid 615.

The waste ink containing portion is defined, preferably, by fusing (heat-sealing) the edge of one film member (not shown) to the back face of the lid 615. The waste ink containing portion includes an absorbing member between the film member and the back face of the lid 615, and is to be connected to a cleaning mechanism (not shown) that is provided in the ink jet printer 100. The cleaning mechanism has a cap, a vacuum pump and so on to forcibly aspire ink in the recording head 13 and to prevent clogging of the nozzles of the recording head 13. Therefore, waste ink discharged from the cleaning mechanism is transmitted from the introduction support 620 to the waste ink containing portion through the flow path 620*a*.

As is shown in FIG. 38, engagement recessed portions 621, which are engagement portions, are formed in the faces parallel to the direction in which the ink cartridge 611 is inserted, i.e., in side faces (side walls) 612*d* and 612*e* of the case 612 (container portion 614). As is shown in FIGS. 38 and 39, the engagement recessed portions 621 are shaped in squares in the side faces 612*d* and 612*e*. The engagement recessed portions 621 are open in the bottom face 612*c* of the case 612, and as is shown in FIG. 39, are located slightly closer to a rear face 612*f* of the case 612 than the middle position between the front face 612*a* and the rear face 612*f*. Furthermore, the engagement recessed portions 621, the upper face (substrate attachment face) of the substrate recessed portion 619 and the abutting portion 618*a*, all of which are formed in the case 612, are located at relative distances in order from the bottom face 612*c* of the case 612 in the direction of a height H. That is, in the direction of the height H, the engagement recessed portions 621 is located lower than the substrate attachment face of the recessed portion 619, which face is located lower than the abutting portion 618*a*.

As is shown in FIG. 39, pressing ribs (driving ribs) 622, each having substantially an L shape, are formed on the side faces 612*d* and 612*e* of the container portion 614. Each of the pressing ribs 622 includes a first rib 623, which is a contact portion, and a second rib 624, which is reinforcing means.

first rib 623 is projected like a strip, so that the longitudinal direction is substantially parallel to the direction of the height H of the ink cartridge 611 (container portion 614). The front face of the first rib 623 is used as a contact face 625 that contact a lock slider 36 that will be described later. That is, as is shown in FIG. 38, the contact face 625 is projected outward from the side face 612*d*, 612*e* of the case 612. The first rib 623 is adjacent to the engagement recessed portion 621; more specifically, the face of the engagement recessed portion 621 close to the rear face 612*f* of the case 612 is continuous to (preferably flush with) the contact face (front face) 625 of the first ribs 623.

The second rib 624 is continuous to the first rib 623. The second rib 624 is projected like a strip, so that the longitudinal direction thereof is substantially parallel to the direction of a depth L of the ink cartridge 611 (container portion 614). The second rib 624 reinforces the first rib 623, i.e., the damage on the contact face 625 or the first rib 623 is prevented when other members abut against the contact face 625 of the first rib 623.

(Ink Cartridge Attachment/Detachment Device)

Figure 2:
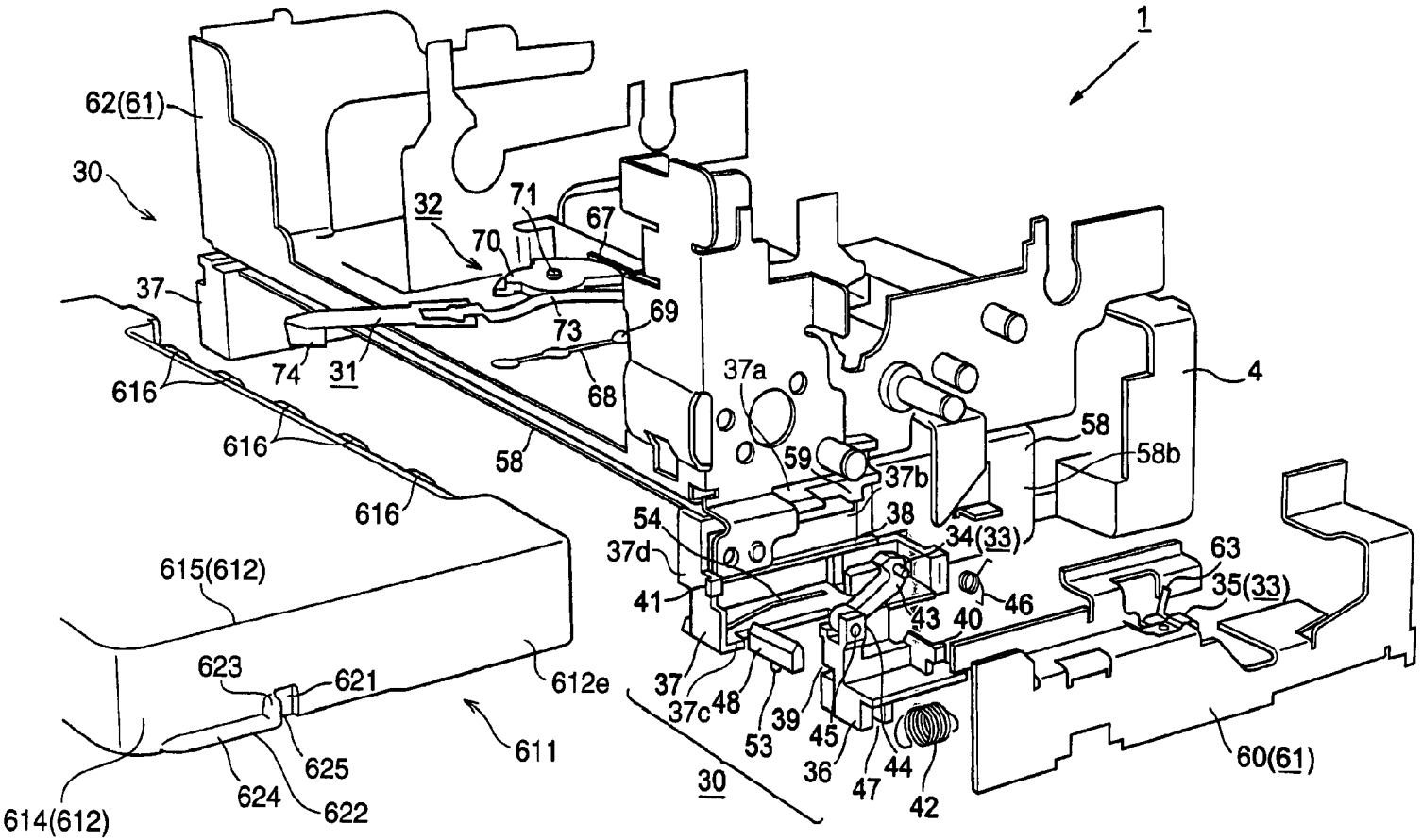
FIG. 2 is an exploded perspective view of a attachment/detachment device before an ink cartridge is inserted.
Figure 3:
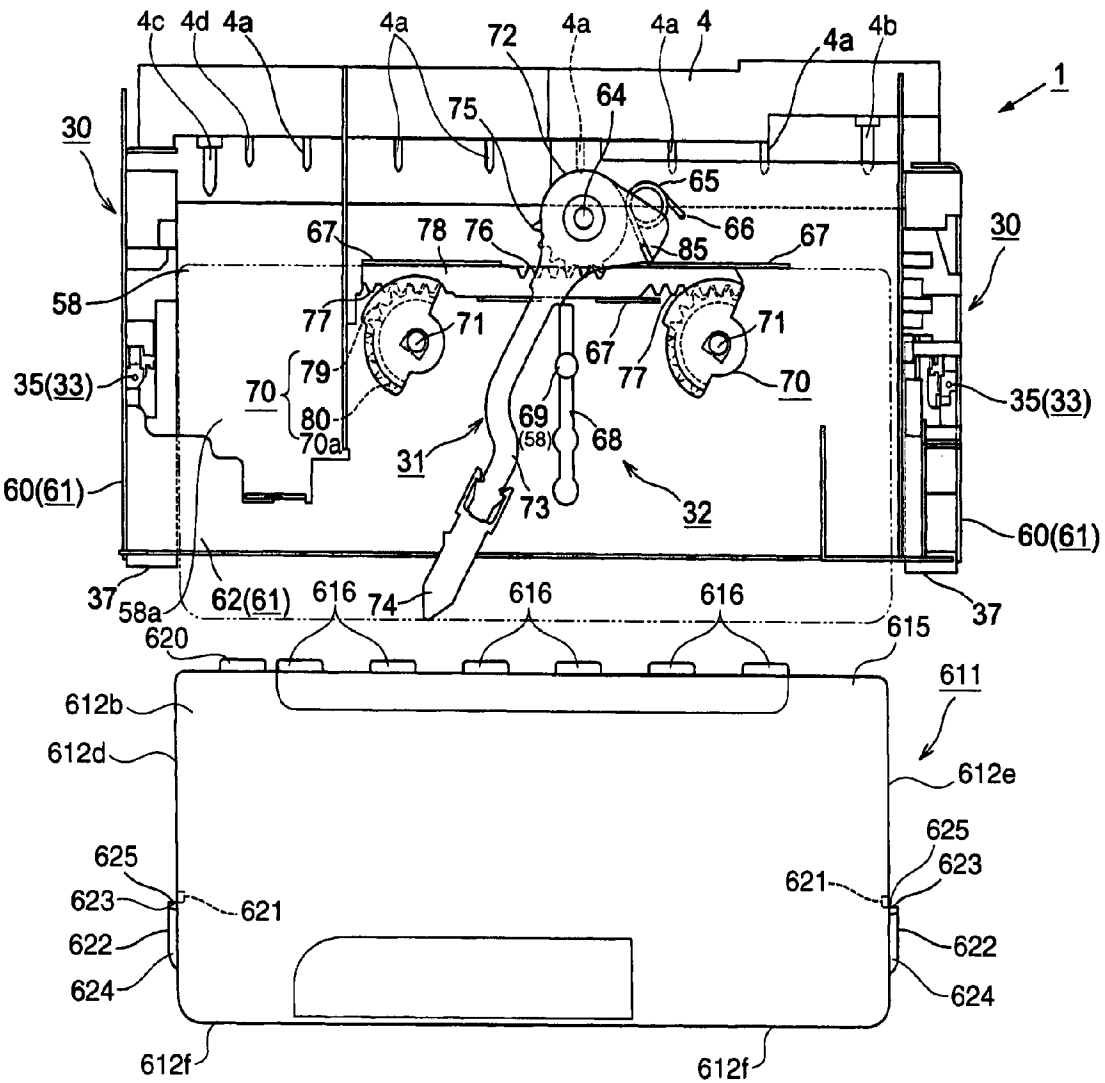
FIG. 3 is a plan view of the attachment/detachment device before the ink cartridge is inserted.
Figure 4:
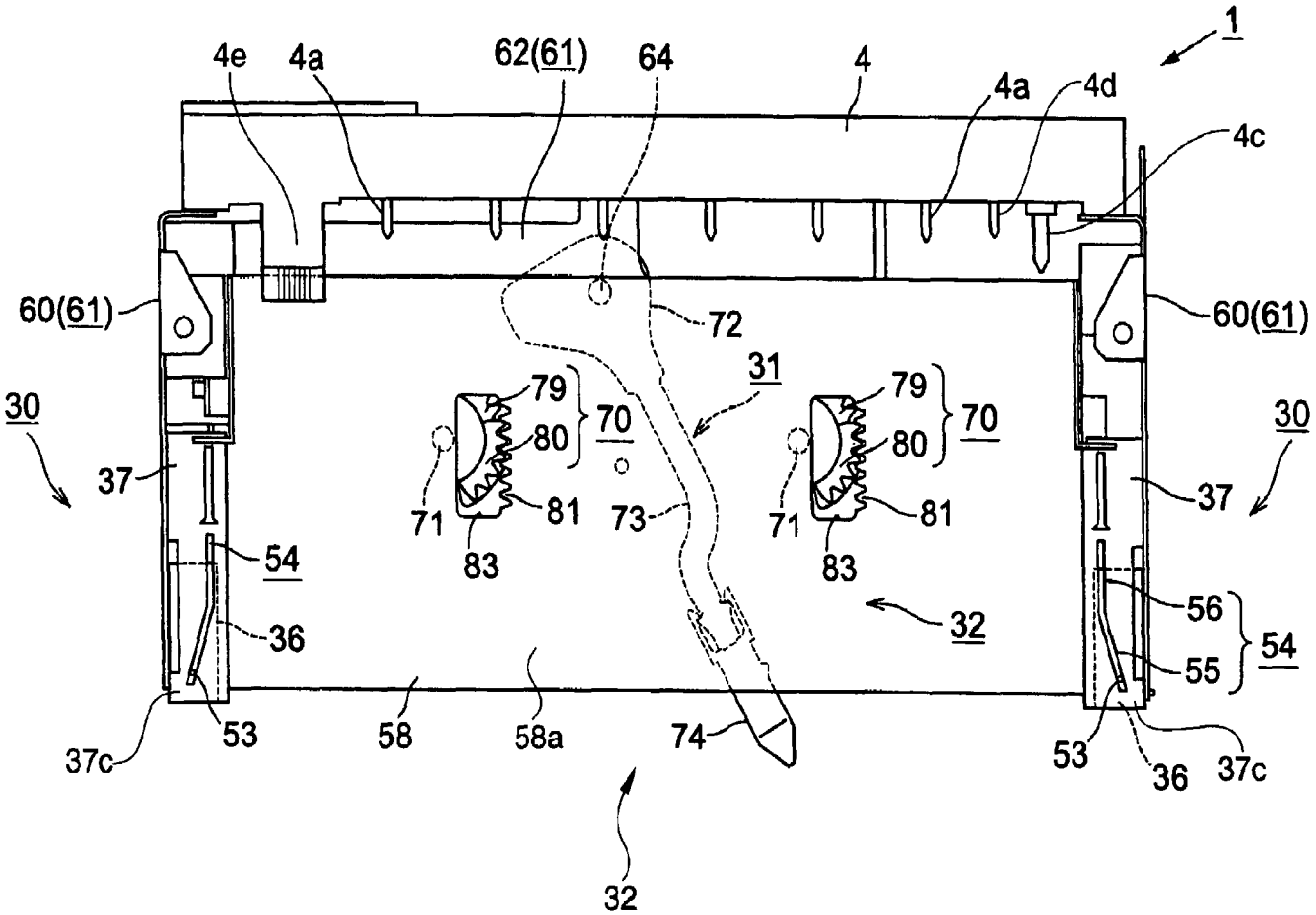
FIG. 4 is a bottom view of a attachment/detachment device before an ink cartridge is inserted.
Figure 5:
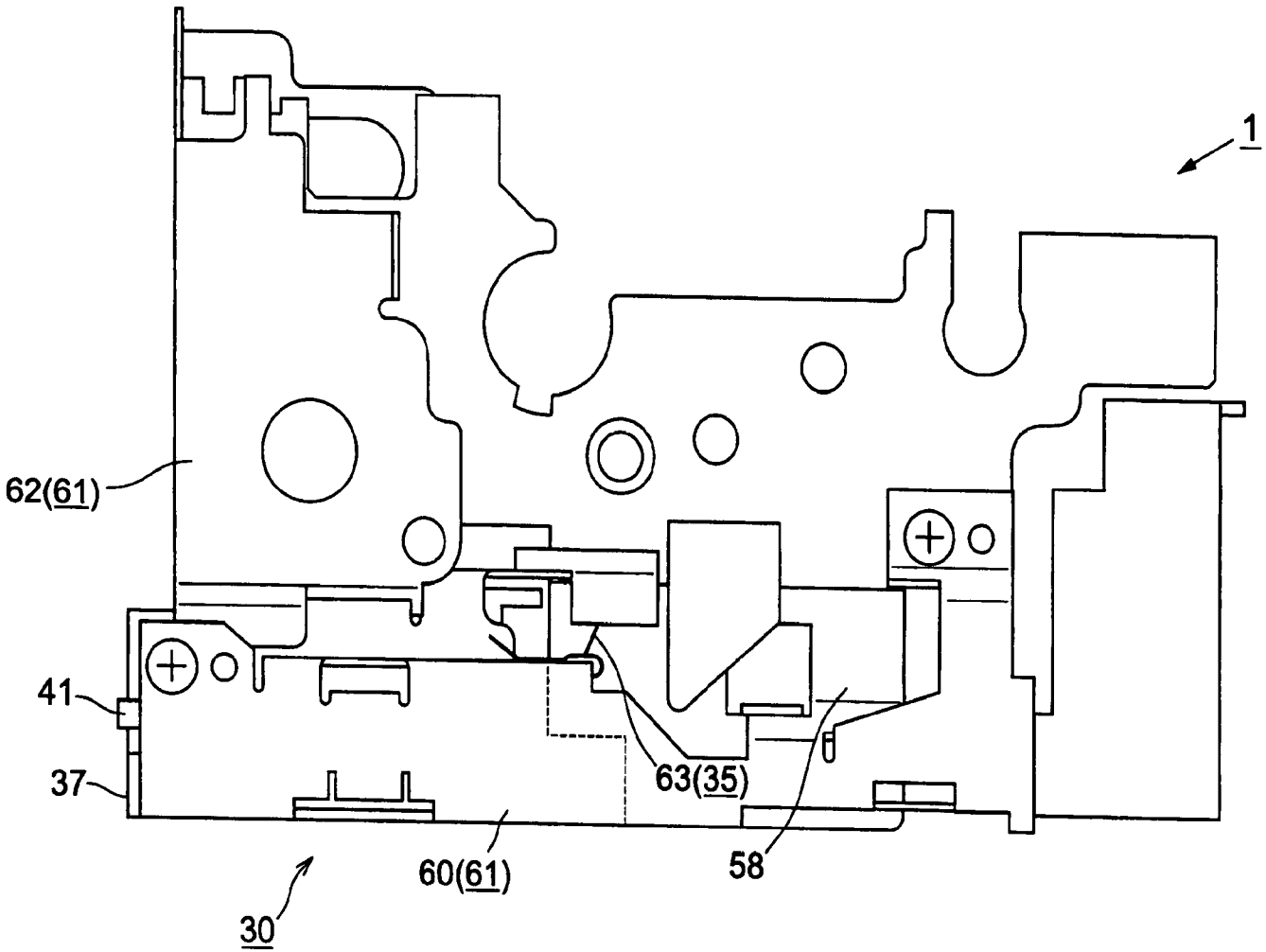
FIG. 5 is a side view of a cartridge holding unit before an ink cartridge is inserted.
Figure 6:
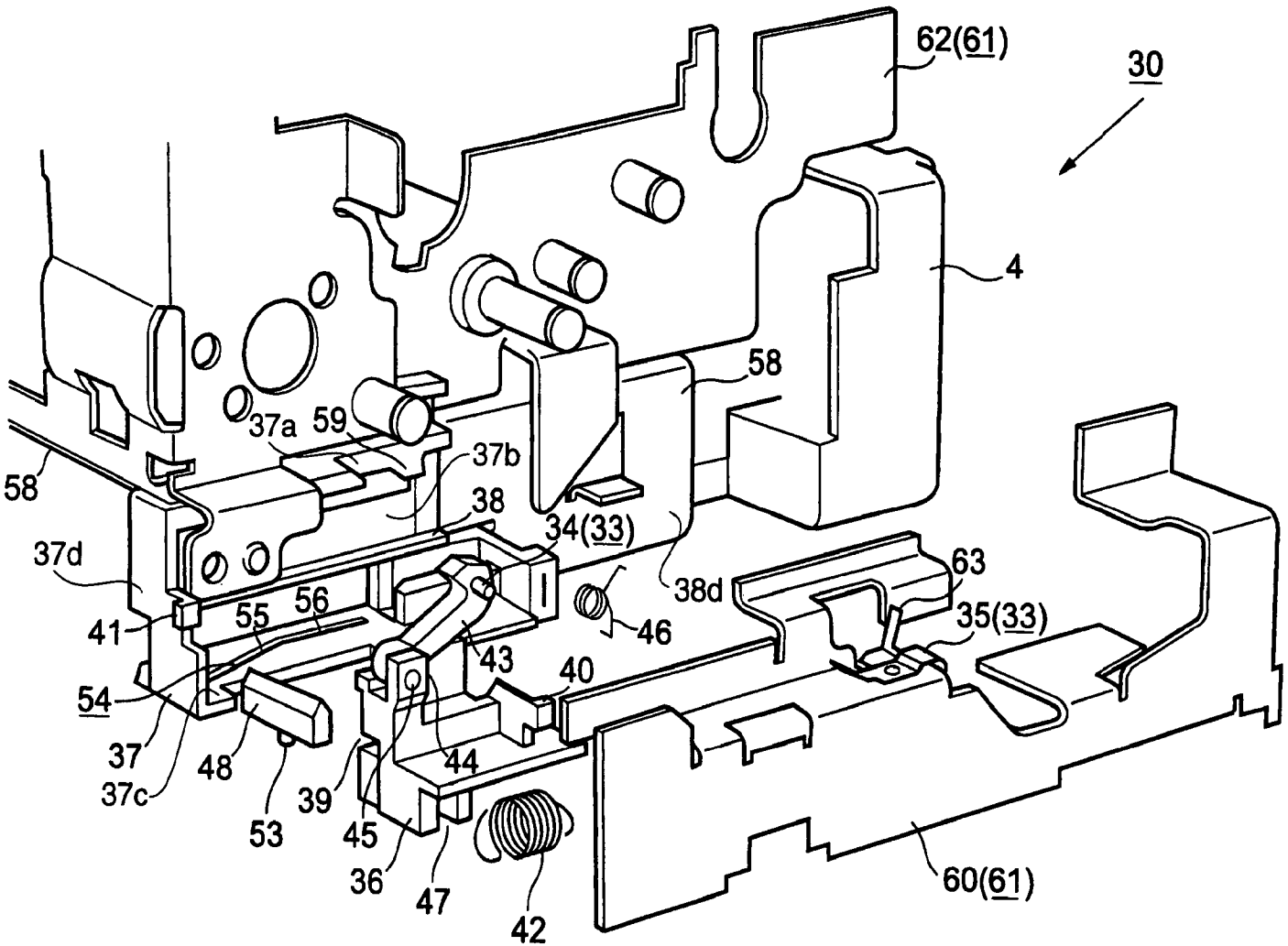
FIG. 6 is an enlarged exploded perspective view of the cartridge holding unit.

An explanation will now be given for an ink cartridge attachment/detachment device n that is applied to the inkjet printer 100 and that attaches and detaches the ink cartridge 611. FIG. 2 is an exploded perspective view of the ink cartridge attachment/detachment device in the state before the ink cartridge is inserted into the printer. FIG. 3 is a plan view of this state, FIG. 4 is a bottom view of this state, and FIG. 5 is a side view of a cartridge holding mechanism in this state. FIG. 6 is an enlarged, exploded perspective view of the cartridge holding mechanism. FIGS. 7A and 7B are a side view and a bottom view of the operating state of the cartridge holding mechanism at an ink cartridge insertion start position. FIGS. 8A and 8B are a side view and a bottom view of the operating state of the cartridge holding mechanism at an ink cartridge insertion end position.

Figure 9:
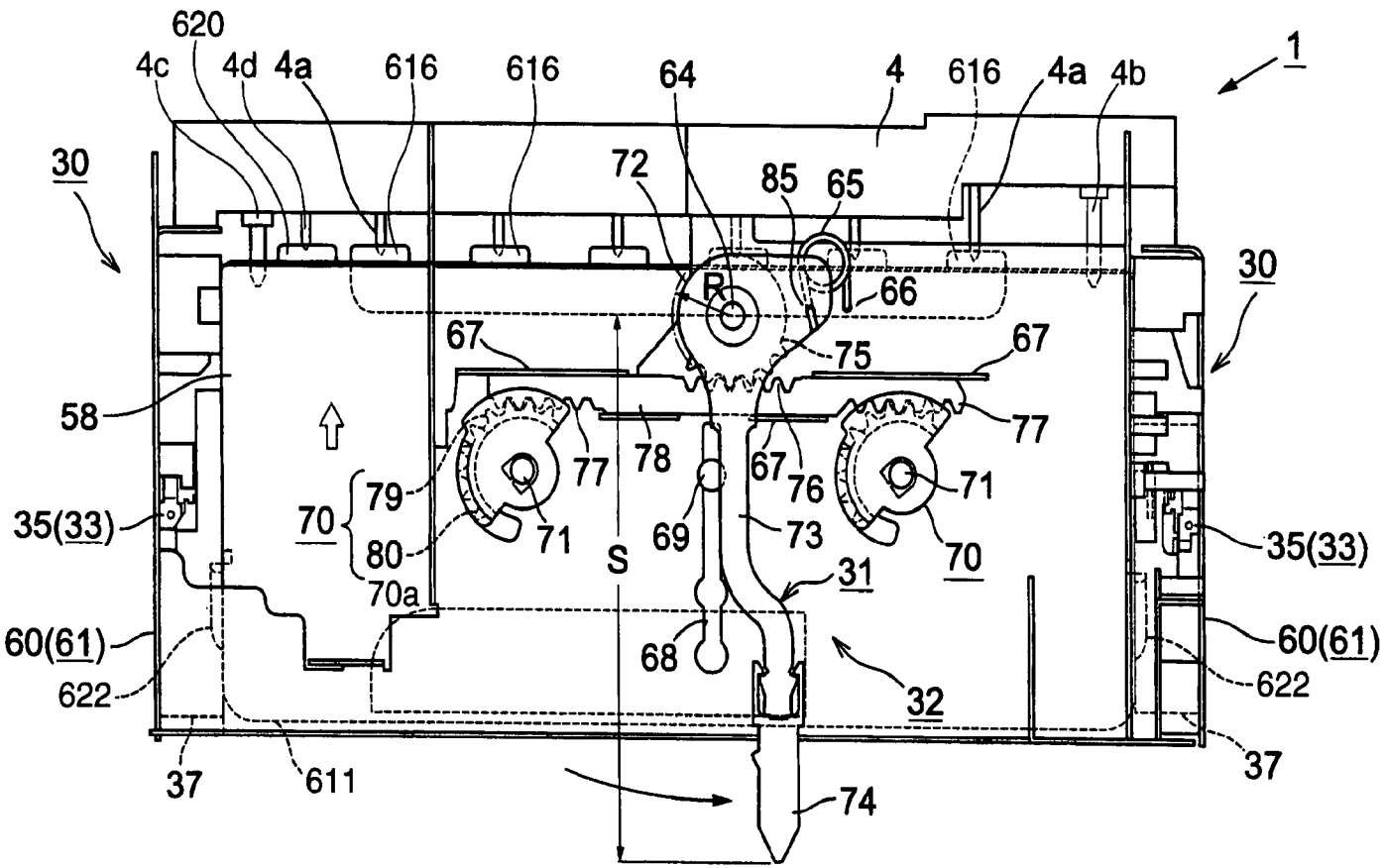
FIG. 9 is a plan view of the attachment/detachment device when an ink cartridge is loaded.

FIG. 9 is a plan view of the attachment/detachment device in the state wherein the ink cartridge is currently being loading. FIGS. 10A and 10B are a side view and a bottom view of the operating state of the cartridge holding mechanism in this state. FIG. 11 is a plan view of the attachment/detachment device in the state wherein the ink cartridge is completely loaded. FIGS. 12A and 12B are a side cross-sectional view and a bottom view of the ink cartridge holding mechanism in this state. FIG. 13 is a plan view of the attachment/detachment device in the state of an unlocking moment to remove the ink cartridge. FIGS. 14A and 14B are a side view and a bottom view of the cartridge holding mechanism in this state. FIG. 15 is an enlarged perspective view of the base end of a lever arm.

As is shown in FIG. 2, the attachment/detachment device 1 including an ink cartridge accommodation portion (a liquid container accommodation portion) comprises: a flow path member 4, which is a connector; cartridge holding mechanisms 30, which are holding mechanisms; and a rotating and sliding mechanism 32, which is a sliding mechanism. The flow path member 4 is attached to the end of a main frame 62. The cartridge holding mechanisms 30 and the rotating and sliding mechanism 32 are attached respectively to the lower portion and to the upper face of the main frame 62, as is shown in FIG. 2. The cartridge holding mechanisms 30 are located on respective lower sides of the main frame 62. In a space defined by the main frame 62 and the cartridge holding mechanisms 30, an opening is formed on the side (left side in FIG. 2) opposite to the side where the flow path member 4 is attached. The attachment/detachment device 1 is disposed within the outer case of the printer 100 so that this opening faces the insertion port formed in the outer case, and therefore, the ink cartridge 611 that is inserted through the insertion port can be accommodated in the space. It should be noted that, in FIG. 2, only one part is shown for the cartridge holding mechanism 30 located on the left end of the main frame 62, and the other configuration is not shown.

In the ink cartridge attachment/detachment device 1 according to this embodiment, the cartridge holding mechanisms 30 holds the ink cartridge 611 upon insertion of the ink cartridge 611 by a predetermined stroke. Further, in this embodiment, the rotating and sliding mechanism 32 uses a rotation of a lever arm 31 and the principle of the lever to provide pressing power sufficient to load the ink cartridge 611. The rotating and sliding mechanism 32 converts the rotation of the lever arm 31 into the horizontal movement of another predetermined stroke required for loading the ink cartridge 611.

Of these elements, each of the cartridge holding mechanisms 30 has an unlocking mechanism 33 which is provided as one of feature components of the present invention, and which permits extraction of the ink cartridge 611 from the main body 3 only by rotating the lever arm 31. The unlocking mechanism 33 includes: an unlocking pin 34, which is moved together with the ink cartridge 611 as the lever arm 31 is rotated; and a flexible (elastic) unlocking piece 35, which unlocks the ink cartridge 611 by differentiating traveling loci of the unlocking pin 34 for the insertion direction of the ink cartridge 611 and the removal direction thereof. The more detailed structure of the unlocking mechanism 33 will be described later together with the other components of the cartridge holding mechanism 30.

As is shown in FIG. 6, the cartridge holding mechanism 30 includes: a lock slider 36, which directly supports the ink cartridge 611; a slider holder 37, which slidably supports the lock slider 36; and the unlocking mechanism 33. The lock slider 36 is a block member that slides by contacting the contact face 625 of the driving rib (pressing rib) 622 in FIGS. 2 and 38 that is projected from the side face 612*d*, 612*e* the ink cartridge 611.

The lock slider 36 is moved inside the slider holder 37 such that the lock slider 36 slides on an along the inner walls of the upper and lower plates 37*a* and 37*c* of the slider holder 37, while being guided by a guide rib 38 formed on the inner wall 37*b* of the slider holder 37. The lock slider 36 is formed with an engagement groove 39 that fits the guide rib 38 therein. An extraction spring 42, such as a tension coil spring, is suspended between engagement hooks 40 and 41 that are respectively formed on the lock slider 36 and the slider holder 37.

The engagement groove 39 is formed in the side face of the lock slider 36, and the guide rib 38 of the slider holder 37 is fitted to the engagement groove 39. Further, a guide recessed portion 47 is formed in the lower face of the lock slider 37, and a slide lock piece 48, which is a lock portion, is fitted to the guide recessed portion 47. This slide lock piece 48 is the form of a plate having a tapered distal end. Further, a guide protrusion 53 is formed on the lower face of the slide lock piece 48 so as to be fitted to the guide groove 54 of the slider holder 37.

Accordingly, the lock slider 36 is slidably moved, while being supported within the slider holder 37, in a state in which the guide protrusion 53 of the slide lock piece 48 fitted to the guide recessed portion 47 is fitted to the guide groove 54 and the guide rib 38 is fitted to the engagement groove 39. At this time, the lock slider 36 supported by the slider holder 37 faces the respective side face 612*d*, 612*e* of the ink cartridge 611 inserted into the attachment/detachment device 1. Furthermore, when the guide protrusion 53 is moved along the slope portion 55 toward the horizontal portion 56, the slide lock piece 48 is gradually projected from the guide recessed portion 47 to the inside (toward the traveling locus of the ink cartridge 611). When the guide protrusion 53 is located in the horizontal portion 56, a state in which a part of the slide lock piece 48 is projected from the guide recessed portions 47 is maintained.

The engagement hook 40 is formed on the lock slider 36. The engagement hook 40 is located at such a position that, when the lock slider 36 is disposed on the slider holder 37, the engagement hook 40 is substantially at the same height as the engagement hook 41. The engagement hook 40 is shaped like a hook, and the distal end thereof is projected toward the flow path member 4. The terminal ends of an extraction spring 42 are retained on the engagement hooks 40 and 41, respectively. In this embodiment, the extraction spring 42 is constructed by a tension coil spring. When the extraction spring 42 is suspended between the engagement hooks 40 and 41 in a state in which the lock slider 36 is attached to the slider holder 37, the lock slider 36 is urged toward the opening (toward the side plate 37*d*) of the attachment/detachment device 1. Therefore, when an external force is not exerted to the lock slider 36, the lock slider 36 is moved toward the opening by the urging force of the extraction sprig 42, and the guide protrusion 53 of the slide lock piece 48 is located at the start end of the slope portion 55.

A bearing portion 44 is also provided on the lock slider 36 to rotatably support an engagement pawl 43. The bearing portion 44 has a hole that receives a rotary shaft 45 disposed at the base end of the engagement pawl 43. Further, attached to the rotary shaft 45 is a lock spring 46, such as a helical torsion spring, for urging the engagement pawl 43 toward the upper plate inner wall 37*a* of the slider holder 37.

The engagement pawl 43 is a member having a hook-shaped pawl formed at the distal end thereof. The unlocking pin 34, which is a part of the unlocking mechanism 33, is disposed on the outer side face of the pawl to extend in parallel to a rotational axis about which the engagement pawl 43 is rotatable. The lock slider 36 is formed with the guide recessed portion 47 extending in a direction perpendicular to the loading direction in which the ink cartridge 611 is loaded. The slide lock piece 48 is fitted to the guide recessed portion 47 as described above.

The slide lock piece 48 is a flat plate member, the distal end of which is cut in a crest shape in order to match the shape of the guide recessed portion 47 to be fitted. The slide lock piece 48 has the guide protrusion 53 on the end face thereof opposing the lower plate 37*c* of the slider holder 37. The guide protrusion is fitted to the guide groove 54 formed in the lower plate 37*c* of the slider holder 37. As the guide protrusion 53 is moved in the loading direction of the ink cartridge 611 along the shape of the guide groove 54, the slide lock piece 48 is slid in the loading direction of the ink cartridge 611 and also in the direction perpendicular to the loading direction of the ink cartridge 611.

That is, as is shown in FIGS. 4, 7, 8, 10, 12 and 14, the guide groove 54 has the slope portion 55 at a start end side where the ink cartridge is inserted, and the horizontal portion 56 at a terminal end side. Further, the slope portion 55 is gradually inclined from outward to inward, and the horizontal portion 56 is continuous from the innermost end of the slope portion 55 to extend toward the terminal end in parallel to the loading direction, while maintaining this inner most position.

The guide protrusion 53 fitted to the thus shaped guide grooves 54 takes the outermost position when the guide protrusion 53 is located at the start end. Accordingly, the ink cartridge 611 is insertable. The guide protrusion 53 takes the innermost position when the guide protrusion 53 is located at the terminal end of the slope portion 55, whereby the slide locking piece 48 is slid to enter into the respective engagement recessed portion 621 in FIGS. 2 and 38 that is formed in the side face 612*d*, 612*e* of the ink cartridge 611. Accordingly, the ink cartridge 611 is held from both sides.

The slider holder 37 is a box-shaped member that internally has a space for accommodating the lock slider 36. The slider holders 37 are held on a movable frame 58 having a portal cross section as an example, and can slide together with the movable frame 58. A hook-shaped engagement rib 59 is formed on the inner wall of the upper plate 37*a* of the slider holder 37, and is engaged with the engagement pawl 43 that is rotatably attached to the lock slider 36. With this structure, the lock slider 36 and the slider holder 37 are combined integrally.

The slider holder 36 includes the upper plate 37*a*, the middle plate 37*b*, the lower plate 37*c* and the side plate 37*d* connecting these plates. The engagement rib 59 is formed on the inner face of the distal end of the upper plate 37*a*. The distal end of the engagement rib 59 is formed in a hook shape. The middle plate 37*b* has the guide rib 38 that is projected outward (on the engagement rib 59 side), and that is substantially in parallel to the direction in which the ink cartridge 611 is inserted. Further, the side plate 37*d* has the engagement hook 41 that is located at a position slightly higher than the guide rib 38. The engagement hook 41 is formed into a hook shape, so that the distal end thereof is projected outward.

As described above, the guide groove 54 is formed in the horizontal face of the lower plate 37*c*. As is shown in FIG. 6, this guide groove 54 includes the slope portion 55 and the horizontal portion 56. The slope portion 55 is located closer to the opening side of the attachment/detachment device 1 than the horizontal portion 56. The slope portion 55 is inclined gradually inward (toward the side opposite to the side where the engagement rib 59 is formed) as it goes from the opening side toward the flow path member 4 side The horizontal portion 56 is continuous from the slope portion 55 to extend from the slope portion 55 toward the flow path member 4.

The slider holder 37 is retained onto the movable frame 58 (see FIGS. 4 and 6) that includes a flat plate 58*a* (see FIG. 4). Specifically, the movable frame 58 includes the flat plate 58*a*, which is located at the lower face of the main frame 62, and bent portions 58*b* (see FIG. 6), which are formed on respective ends of the flat plate 58*a*. Further, as is shown in FIGS. 7A and 7B, since the bent portions 58*b* are connected respectively to the slider holders 37 that are provided on both sides of the flat plate 58*a*, the movable frame 58 and the slider holders 37 are securely held together. Further, the movable frame 58 is relatively movably attached to the main frame 62. With this arrangement, the slider holders 37 can be slidably moved together with the movable frame 58 relative to the main frame 62.

The outer side face of the slider holder 37 is open. After the lock slider 36 and the extraction spring 42 are accommodated, a sub-frame 60 is used to externally block the open area. Each of the sub-frames 60 is a part of a fixed frame 61, and is attached to the main frame 62 of the fixed frame 61 by screws.

The sub-frame 60 is disposed over the slider holder 37 holding the lock slider 36. The sub-frame 60 is fixed with respect to the main frame 62. An unlocking pin 35 is securely attached to a substantially central portion of the sub-frame 60. The unlocking piece 35 includes an elastic piece 63, which is a leaf spring inclined toward the flow path member 4.

The flow path member 4 is attached to the rear end faces of the sub-frames 60 to be connected to the ink cartridge 611. The flow path member 4 includes needles 4*a* to be inserted into the needle openings of the ink cartridge 611, an ink supply path and a contact point for detecting the amount of remaining ink.

Specifically, as is shown in FIG. 3, six needles 4*a* are formed in the flow path member 4 to be inserted into the insertion holes 616*a* of the ink cartridge 611. Further, first and second insertion needles 4*b* and 4*c* are formed in the flow path member 4 to be fitted to the first and second fitting holes 617 and 618 of the ink cartridge 611. An introduction needle 4*d* is also formed in the flow path member 4 to be inserted into the introduction support 620 of the ink cartridge 611. Furthermore, as is shown in FIG. 4, a terminal arrangement portion 4*e* is formed at the lower portion of the flow path member 4. Terminals (not shown) are provided in the terminal arrangement portion 4*e*, and are connected to a circuit board, which is attached to the substrate recessed portion 619 of the ink cartridge 611, when the ink cartridge 611 is fixed to the flow path member 4.

The flexible unlocking piece 35 is a part of the unlocking mechanism 33, and is attached to the sub-frame 60. The flexible unlocking piece 35 is a member like a leaf spring member, and has the elastic tongue piece 63 that extends obliquely upward The elastic deformation of the elastic tongue piece 63 is used to differentiate traveling loci of the unlocking pin 34 for the direction in which the ink cartridge 611 is loaded and for the direction in which it is removed.

That is, as the elastic tongue piece 63 is bent downward, the unlocking pin 34 can be moved in the direction in which the ink cartridge 611 is loaded, while the height of the pin 34 is maintained. In contrast, when the unlocking pin 34 is moved in the direction in which the ink cartridge 611 is removed, the elastic tongue piece 63 is not bent upward because of the direction in which the elastic tongue piece 63 is inclined. Thus, in this case, the unlocking pin 34 is moved downward and the traveling locus of the unlocking pin 34 is changed. Thus, the engagement pawl 43 integrally formed with the unlocking pin 34 is pivoted downward, and is disengaged from the engagement rib 59.

The main frame 62 is a member that forms a frame of the main body 3 of the recording apparatus. As shown in FIG. 2, the structure of the main frame 62 is reinforced by using the flat plate with which the moveable frame 58 is slidably contacted and by bending the part of the outer edges of the flat plate upward. As shown in FIG. 3, in the main frame 62, a rotation pin 64 is disposed in the center of the rear portion, and functions as the rotation fulcrum of the lever arm 31 that will be described later. Further, an engagement hole 66 is formed beside the rotation pin 64 in order to hold one end of a bi-stable spring 65. Furthermore, in the vicinity of the front of the rotation pin 64, guide ribs 67 are extended in the widthwise direction of the main body 3. The guide ribs 67 are obtained by standing parts of the main frame 62 upright.

Also in the front of the rotation pin 64, an elongated guide slit 68 is formed perpendicular to the guide ribs 67, and is extended in the direction in which the ink cartridge 611 is attached and detached. An engagement pin 69, which is provided upright on the movable frame 58 located below, is fitted into the guide slit 68. With this structure, without being tilted, the movable frame 58 can be guided by and moved in parallel along the inner walls of the sub-frames 60 and the guide slit 68 that is formed in the main frame 62. On the right and left sides of the guide slit 68, rotation pins 71 are provided upright and function as rotation fulcrums for combination pinions 70 that will be described later.

The lever arm 31 includes: a base end 72, which is rotatably connected to the rotation pin 64 provided on the main frame 62; an arm main body 73, which is extended from the base end 72 toward the rear face of the main body 3; and a knob 74, which is attached to the distal end of the arm main body 73. An engagement hole 85 is formed in the outer edge that is protruded from the side of the base end 72. The engagement hole 85 is used to hold one end of the bi-stable spring 65, which is a helical torsion spring having a comparatively large line diameter and which urges the lever arm 31 to be positioned at either one of right and left rotation ends.

A first pinion 75 having a fan shape, which is an example of a transmission member in the rotating and sliding mechanism 32, is attached to the lower face of the base end 72. The first pinion 75 is rotated together with the lever arm 31 through a pressure increase spring 87 (see FIG. 15) that is a helical torsion spring. A ratio of a distance S between the fulcrum and the application point of the lever arm 31 to a pitch circle radius R of the first pinion 75 is employed substantially as a lever ratio. In this embodiment, as the distance S between the fulcrum and the application point can be comparatively increased by employing the lever arm 31, a large lever ratio of S:R=1:0.12 is obtained.

Therefore, when the driving power required for loading of the ink cartridge 611 is 34.0 N, only about 4.1 N is necessary as the lever operating force exerted to the lever arm 31, without counting on the friction loss and the load imposed on the bi-stable spring 65. In this embodiment, the rotational angle of the lever arm 31 is set to about 55°, and the moving stroke of the ink cartridge 611 obtained according to the rotational angle is set to about 12 mm.

As is shown in FIG. 15, two engagement holes 89 and an elongated stop hole 90 are formed in the base end 72 of the lever arm 31. Two engagement ribs 88 in an arch shape viewed in plan are formed upright on the upper face of the first pinion 75, and are fitted in the engagement holes 89. The elongated stop hole 90 is used to hold one end of the pressure increase spring 87. Similarly to the engagement ribs 88, the engagement holes 89 are formed in an arch shape viewed in plan, but the circumferential length of each engagement hole 89 is slightly longer than the circumferential length of each engagement rib 88 to provide a clearance portion 91 therebetween. The pressure increase spring 87 is sandwiched and compressed between the base end 72 of the lever arm 31 and the first pinion 75, and the other end of the pressure increase spring 87 is held at a notch 92 that is formed in the outer edge of the first pinion 75.

A rack and pinion mechanism can be employed as an example of the rotating and sliding mechanism 32. In this embodiment, the rotating and sliding mechanism 32 includes: the first pinion 75, which is rotated together with the lever arm 31; a slide bar 78, which has a first rack 76 meshing with the first pinion 75 and second racks 77 to transmit the movement of the first rack 76 downstream along respective transmission paths; and third racks 81 meshing with the combination pinions 70. Each of the combination pinions 70 is obtained by integrally forming a second pinion 79, which meshes with the second rack 77, and a third pinion 80, which transmits the rotation of the second pinion 79 downstream along the respective transmission path.

In this embodiment, each transmission path is formed by the second rack 77, the second pinion 79, the third pinion 80 and the third rack 81, and is provided on either side of the lever arm 31. In consonance with this arrangement, the slider bar 78 has the first rack 76 located in the center on a side close to the rotation pin 64, and the second racks 77 located in the right and left end portions on the opposite side. It should be noted that the slide bar 78 is guided by the guide ribs 67 of the main frame 62 to reciprocate in the widthwise direction of the main body 3.

Similarly to the first pinion 75, the second pinion 79 and the third pinion 80 are formed of fan-shaped gears, and are coupled together with the phase being shifted at about 90° to form the combination pinion 70. The third pinion 80 is passed through a semi-annular opening formed in the main frame 62, reaches a window 83 that is opened in the moveable frame 58 located below, and meshes with the third rack 81 that is formed in the side edge of the window 83. Further, the right and left combination pinions 70 are rotated in the same direction, and therefore, the second pinions 79, the third pinions 80 and the third rack 81 are arranged in the same orientation.

As described above, the rotating and sliding mechanism 32 includes the lever arm 31, which has the base end 72, the arm main body 73 and the knob 74 as shown in FIG. 3 The base end 72 is formed like a flat plate, and the rotation pin 64 is retained substantially in the center of the base end 72. The lever arm 31 is supported by the main frame 62 to be rotated about the rotation pin 64. The retaining hole 85 is formed in the end face of the base end 72, and one end of the bi-stable spring 65 is fixed to the retaining hole 85 to inhibit the removal of the spring 65. Further, in the main frame 62, the retaining through hole 66 is formed in the vicinity of the base end 72 of the lever arm 31 to fix the other end of the bi-stable spring 65. The bi-stable spring 56 that is supported by the retaining holes 66 and 85 is a helical torsion spring or the like, and urges the lever arm 31 to either one of the right and left rotation ends.

The arm main body 73 is extended from the base end 72 toward the opening, and the knob 74 is located at the distal end of the arm main body 73. The first pinion 75 is located under the lower face of the base end 72, and is connected to the lever arm 31 and rotated as the lever arm 31 is rotated.

In addition, in the main frame 62, the slider bar 78 is located at a position at which it can mesh with the first pinion 75. The slide bar 78 is supported by the side faces of the ribs 67 that are projected from the main frame 62. The slide bar 78 has the first rack 76 that is provided close to the base end 72 of the lever arm 31. The first rack 76 is located at a position at which it can mesh with the first pinion 75 Accordingly, as the lever arm 31 is rotated to the right in FIG. 3, the first pinion 75 is rotated counterclockwise in FIG. 3, and the slide bar 78 is moved to the right in FIG. 3 by meshing of the first pinion 75 with the first rack 76.

The slide bar 78 also includes the second racks 77, which are located at two positions on the face opposite from the face where the first rack 76 is formed. In the main frame 62, the combination pinions 70 are provided to mesh with the second racks 77, respectively. Each of the combination pinions 70 includes a cover 70*a*, the second pinion 79 and the third pinion 80, all of which are supported by the rotation pin 71.

The second and third pinions 79 and 80 are made of fan-shaped-gears, and are supported by the rotation pin 71, while the phases of the pinions 79 and 80 are different at about 90°. The second pinions 79 is located at a position to mesh with the corresponding second rack 77. The rotation of the second pinion 79 is transmitted to the third pinion 80 to rotate the third pinion 80 in the same direction. As is shown in FIG. 4, the third pinion 80 can mesh with a corresponding third rack 81 of the movable frame 58 that is provided below the main frame 62. When the third pinions 80 are rotated counterclockwise in FIG. 4 (clockwise in FIG. 3), the movable frame 58 is slid toward the flow path member 4 because the third pinions 80 meshes with the third racks 81.

As is shown in FIG. 3 and as discussed above, the guide slit 68 is formed substantially in the center of the main frame 62, and is extended in parallel to the direction in which the ink cartridge 611 is inserted. The engagement pin 69 projected from the movable frame 58 is slidably fitted to the guide slit 68. Therefore, the movable frame 58 is held on the inner faces of the sub-frames 60 that are provided on both sides of the main frame 62, and is moved in parallel, without being tilted, as the engagement pin 69 is fitted to the guide slit 68.

The operation of the thus arranged ink cartridge attachment/detachment device 1 will now be described.

(1) Before Insertion (see FIGS. 2 to 5)

Before the ink cartridge 611 is inserted into the main body 3 of the recording apparatus, as is shown in FIG. 3, the lever arm 31 is located at a leftmost position. In this state, the lock sliders 36 are located closest to the start end, and the engagement pawls 43 are in contact with the inner walls of the upper plates 37*a* of the slider holders 37. As is shown in FIG. 4, the guide protrusions 53 are located at the start end positions, which are the outermost positions in the slope portions 55 of the guide grooves 54. Therefore, the slide lock pieces 48 are accommodated in the guide recessed portions 47, so that the insertion of the ink cartridge 611 is permitted.

That is, before insertion of the ink cartridge 611, that is, when the ink cartridge 611 is not yet mounted to the attachment/detachment device 1, the lock sliders 36 of the cartridge holding mechanisms 30 are urged toward the opening of the attachment/detachment device 1 by the urging force of the extraction springs 42. Thus, the guide protrusions 53 of the slide lock pieces 48 are located at the start ends of the guide grooves 54 (slope portions 55). The engagement pawls 43 are urged toward the upper plates 37*a* by the lock springs 46, and the distal ends of the engagement pawls 43 are in contact with the lower faces of the upper plates 37*a*. The lever arm 31 of the rotating and sliding mechanism 32 is located at the leftmost position, as is shown in FIG. 3.

Figure 7:
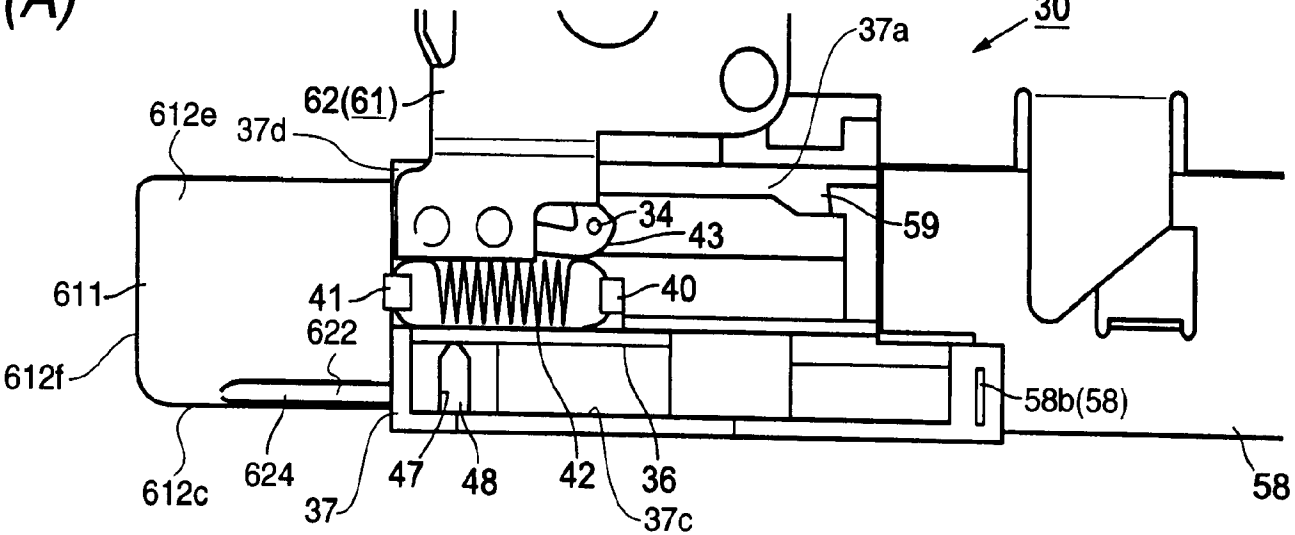
FIGS. 7A and 7B are a side view and a bottom view of the cartridge holding unit when insertion of an ink cartridge is started.
Figure 7:
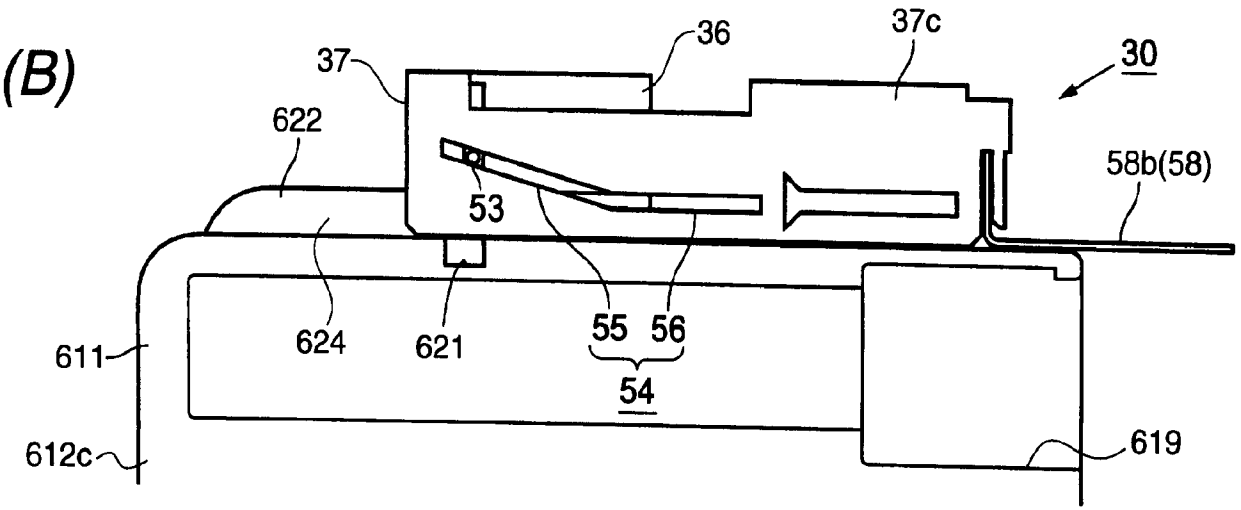

(2) Start Insertion (see FIG. 7)

When the ink-cartridge 611 is manually inserted from the opening in the rear face of the main body 3 of the recording apparatus, the contact faces 625 at the distal ends of the driving ribs 622, which are formed on the two side faces 612*d* and 612*e* of the ink cartridge 611, are brought in contact with the end faces of the lock sliders 36 where the guide recessed portions 47 are formed, and gradually push the lock sliders 36 forward against the urging force of the extraction springs 42. Accordingly, the guide protrusions 53 are moved forward in the main body 3 along the slop portions 55 and the horizontal portions 56 of the guide grooves 54. As the guide protrusions 53 are moved forward, the slide lock pieces 48 are gradually moved inwardly and are projected.

That is, when the ink cartridge 611 is manually inserted through the insertion port of the ink jet printer 100 and is slid at a predetermined distance, the lock sliders 36 partially contact the contact faces 625 of the case 612. Specifically, the contact faces 625 of the case 612 close to the lock sliders 36 are brought in contact with the portions of the lock sliders 36 (the portions where the guide recessed portions 47 are formed). At this time, since the contact faces 625 are projected from the case 612, the ink cartridge 611 need only be pushed inside the attachment/detachment device 1 to bring the contact faces 625 in contact with the lock sliders 36. Further, at this time, as is shown in FIG. 7A, the lock sliders 36 are urged toward the opening of the attachment/detachment device 1 by the urging force of the extraction springs 42, and as is shown in FIG. 7B, the guide protrusions 53 of the slide lock pieces 48 are located at the start ends of the slope portions 55.

When the ink cartridge 611 is further pushed against the urging force of the extraction springs 42, the lock sliders 36 are moved, and the guide protrusions 53 of the slide lock pieces 48 slide along the slope portions 55 to the right in FIG. 7B. At this time, as is shown in FIG. 7A, the distal ends of the engagement pawls 43 slide along the lower faces of the upper plates 37*a* of the slide holders 37.

(3). Complete of Insertion (see FIGS. 8A and 8B)

When the ink cartridge 611 is fully pushed in, upon generation of a clicking sound, the engagement pawls 43 are moved over the outer ridges of the engagement ribs 59 and are engaged with the engagement ribs 59. In this state, the lock sliders 36 are combined integrally with the slider holders 37, and the guide protrusions 53 have reached the terminal ends of the horizontal portions 56 of the guide grooves 54. The slide lock pieces 48 are completely projected inwardly, and are entered into the engagement recessed portions 621 that are formed in both side faces 612*d* and 612*e* of the ink cartridge 611. In this manner, the ink cartridge 611 is locked and held by the lock sliders 36.

That is, when the ink cartridge 611 is pushed further from a state shown in FIG. 7, the guide protrusions 53 are slid along the horizontal portions 56 and reach the terminal ends of the horizontal portions 56 as shown in FIG. 8B. As a result, the slide lock pieces 48 are projected toward the ink cartridge 611. At this time, since the contact faces 625 and the lock sliders 36 are in contact with each other, the engagement recessed portions 621 and the slide lock pieces 48 are relatively positioned with respect to each other, and located substantially at the same positions. Therefore, as is shown in FIG. 8B, the projected slide lock pieces 48 partially enter the engagement recessed portions 621 (engaged state). When the guide protrusions 53 reach the terminal ends of the horizontal portions 56, as is shown in FIG. 8A, the engagement pawls 43 are passed over the rear faces of the engagement ribs 59 that are formed on the upper plates 37*a* of the slide holders 37, and are engaged with the engagement ribs 59. Because the slide lock pieces 48 are engaged with the engagement recessed portions 621, and the engagement pawls 43 are engaged with the engagement ribs 59, the ink cartridge 611 is fixed relative to the lock sliders 36, and the lock sliders 36 are fixed to the slider holders 37. That is, the ink cartridge 611, the lock sliders 36 and the slider holders 37 are fixed to each other. At this time, the state of the rotating and sliding mechanism 32 is unchanged compared with before the ink cartridge 611 is inserted.

Figure 10:
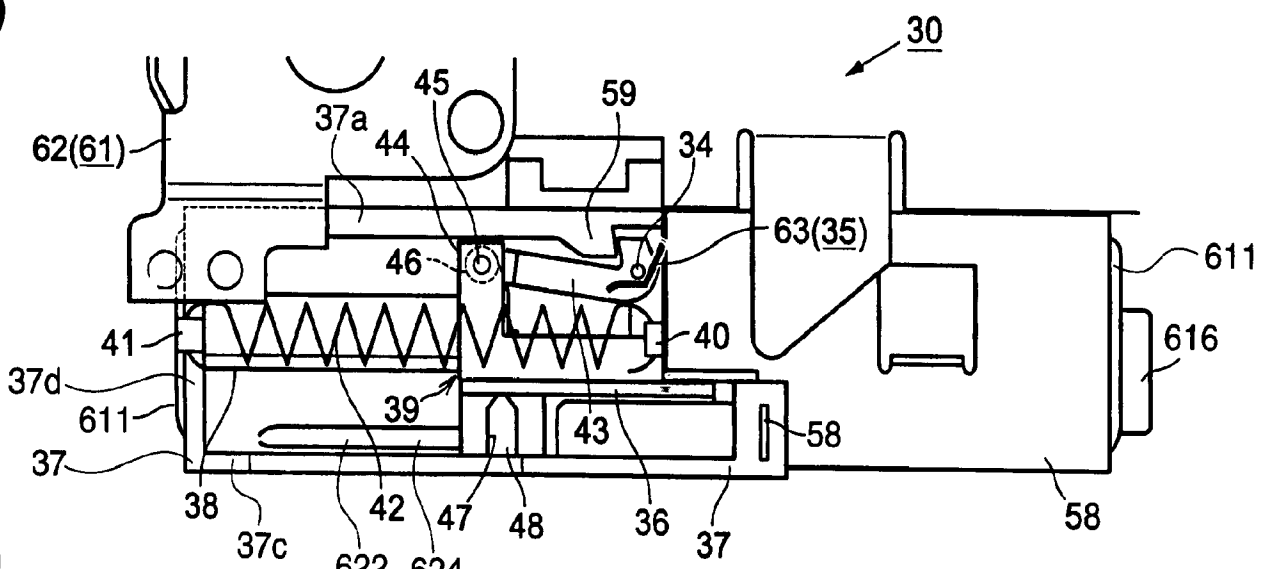
FIGS. 10A and 10B are a side view and a bottom view of the cartridge holding unit when an ink cartridge is loaded.
Figure 10:
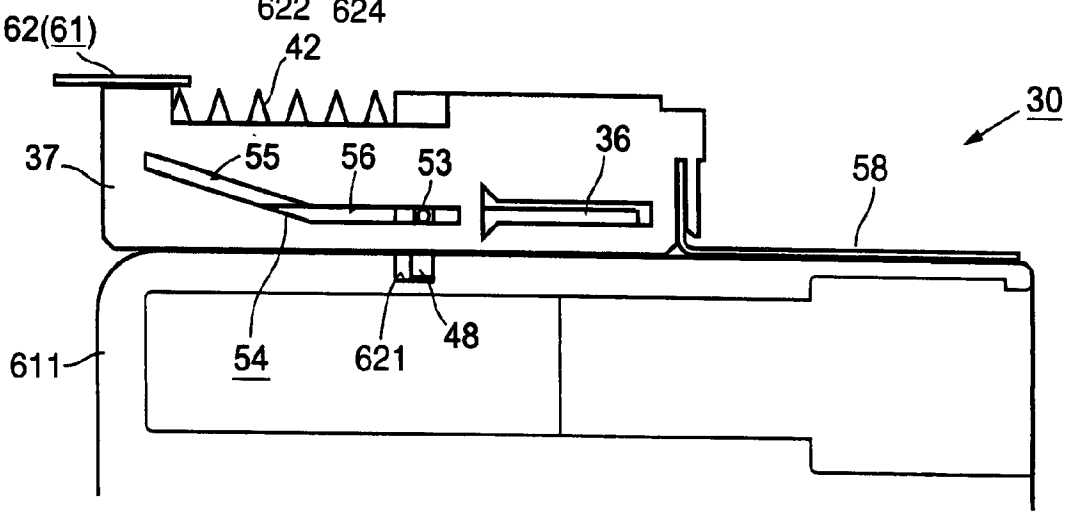
Figure 11:
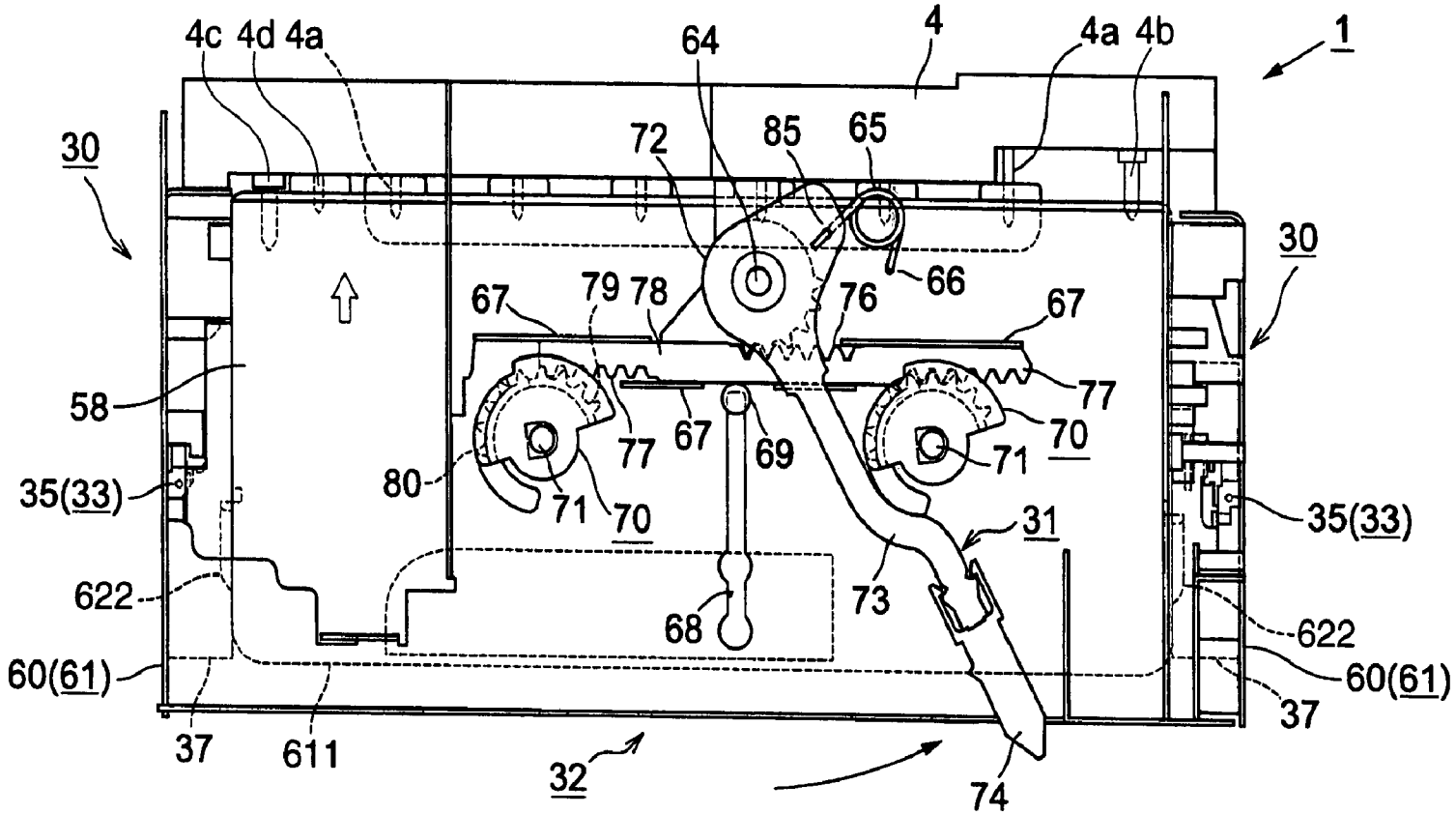
FIG. 11 is a plan view of the attachment/detachment device when loading of an ink cartridge is completed.

(4) Loading (see FIGS. 9 and 10)

When as is shown in FIG. 9 the lever arm 31 is gradually pivoted to the right by using the knob 74 of the lever arm 31, the first pinion 75 is rotated, and the rotation force is transmitted to the first rack 76 to move the slider bar 78 to the right. Then, the force is transmitted from the second racks 77 to the second pinions 79 and the third pinions 80, so that these pinions 79 and 80 are rotated clockwise in FIG. 9. Accordingly, the third racks 81, which meshes with the third pinions 80, and the movable frame 58 that includes the third racks 81, are moved toward the rear. In this state, as is shown in FIG. 10, the unlocking pins 34 are located in front of the flexible tongue pieces 63 of the flexible unlocking pieces 35, and are move forward along the upper traveling locus. The slide lock pieces 48 are currently projected, and are located in the engagement recessed portions 621. Thus, the ink cartridge 611 is locked and held by the lock sliders 36.

That is, to load the ink cartridge 611, the lever arm 31 in the state in FIG. 3 is turned to the right (counterclockwise) against the urging force of the bi-stable spring 65 by holding the knob 74 of the lever arm 31 as shown in FIG. 9. The first pinion 75 is rotated counterclockwise in FIG. 9, and the slide bar 78 having the first rack 76 meshing with the first pinion 75 is moved to the right in FIG. 9.

As the slide bar 78 is moved, the rotation force is transmitted to the second pinions 79 and the third pinions 80, so that the second pinions 79 and the third pinions 80 are rotated clockwise in FIG. 9. As a result, the moveable frame 58 having third racks 81 meshing with the third pinions 80 is moved toward the flow path member 4. Since the slider holders 37 retained on the movable frame 58 are also moved toward the flow path member 4, the ink cartridge 611, which is locked by the slider holders 37 and the lock sliders 36, is also moved toward the flow path member 4.

As is shown in FIG. 10A, as the lock sliders 36 are moved by the rotation of the lever arm 31, the unlocking pins 34, which are formed on the engagement pawls 43 of the cartridge holding mechanisms 30, are slid across the elastic pieces 63 of the unlocking-pieces 35, and are gradually moved toward the upward portions of the elastic pieces 63, while elastically deforming the elastic pieces 63.

Figure 12:
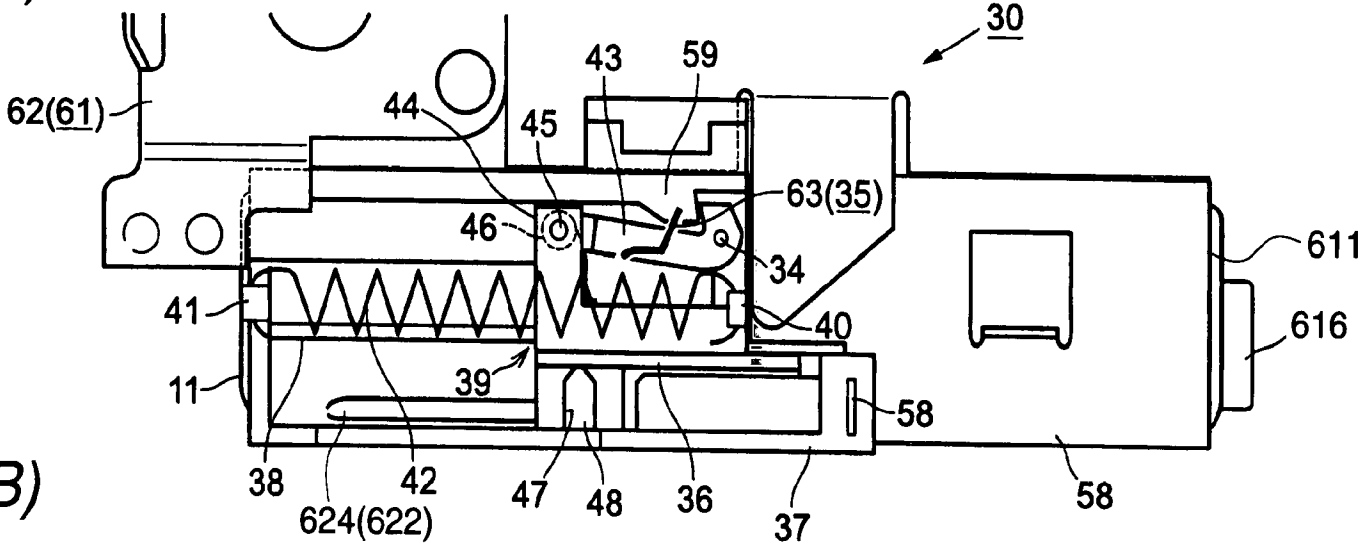
FIGS. 12A and 12B are a side view and a bottom view of the cartridge holding unit when loading of an ink cartridge is completed.
Figure 12:
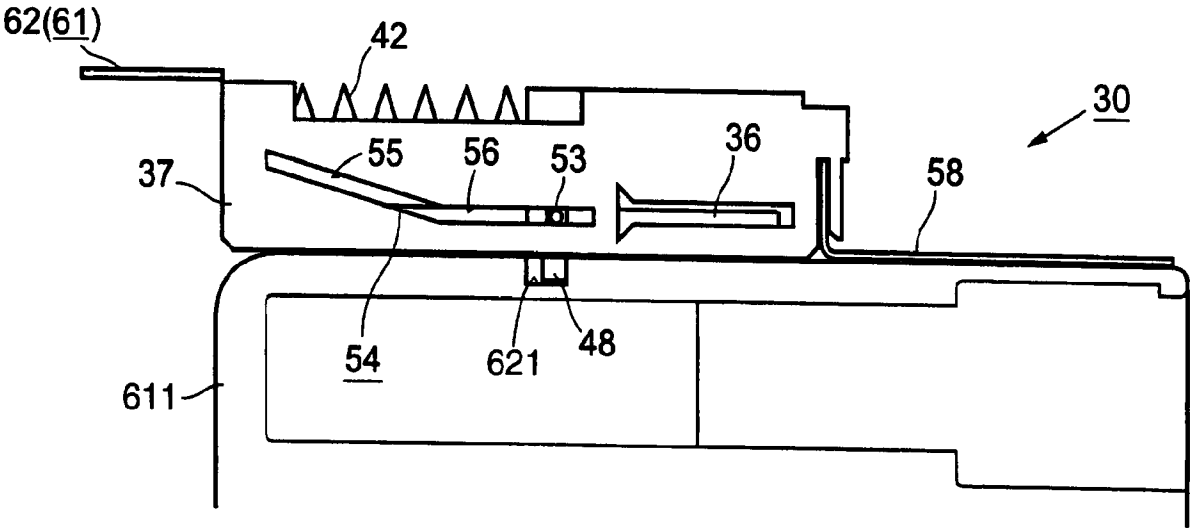
Figure 13:
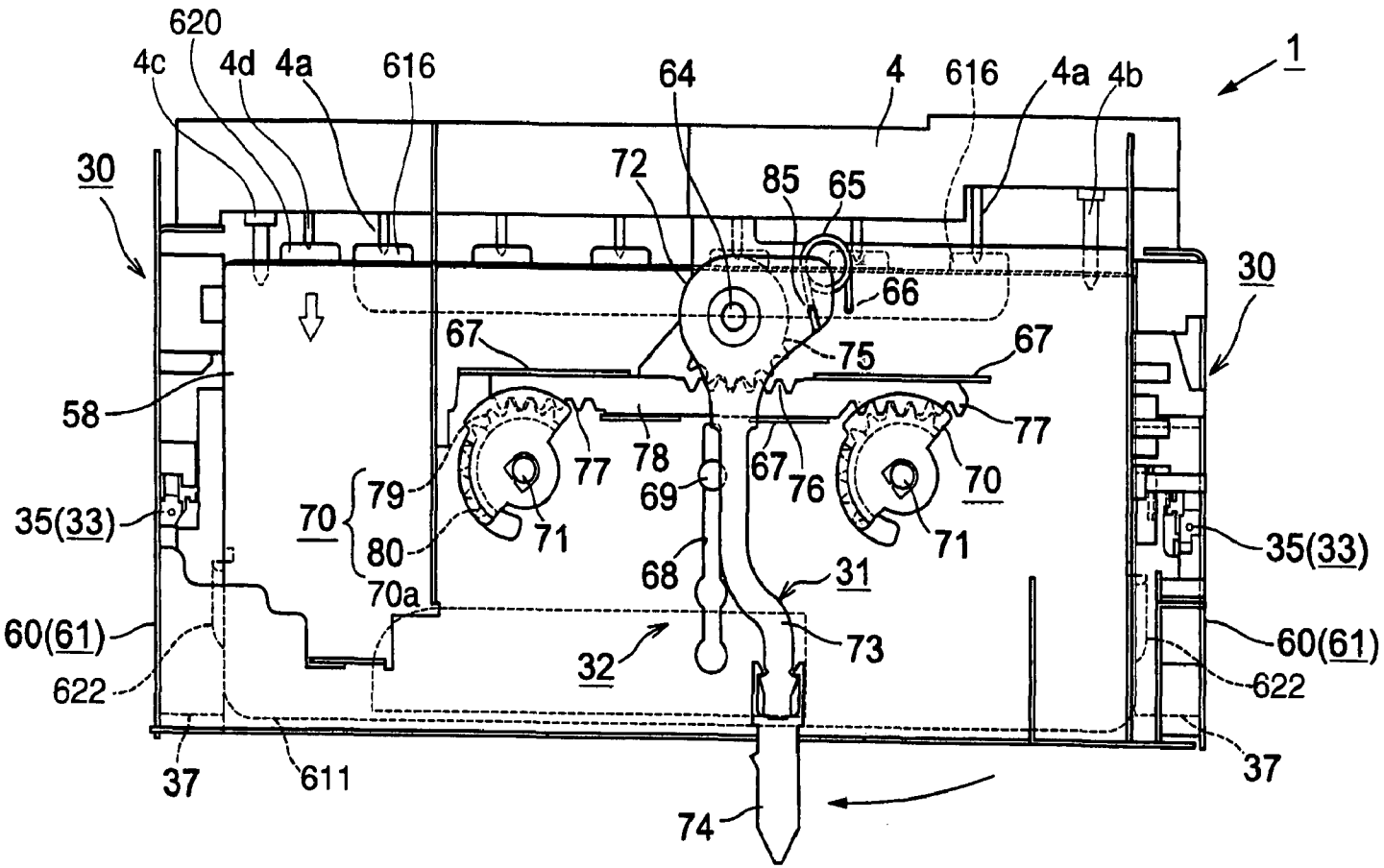
FIG. 13 is a plan view of the attachment/detachment device when an ink cartridge is extracted.

(5) Complete of Loading (see FIGS. 11, 12 and 15)

When the lever arm 31 is pivoted to the rightmost position as is shown in FIG. 11, the ink cartridge 611 is moved more to the rear, and the needles 4*a* formed on the flow path member 4 are inserted into the needle openings 616*a* of the ink cartridge 611. Specifically, when the lever arm 31 is pivoted to the right in FIG. 11, the ink cartridge is brought in contact with the flow path member 4 at a position slightly before the right end, and the first pinion 75 is halted. In this state, when the lever arm 31 is further pivoted to the right, the pressure increase spring 87 is compressed, and by the reactive force of this spring 87, gaps 91 are removed that are present at the engagement holes 89 downstream in the rotational direction. At the same time, unsteadiness due to the tolerance of the sizes of parts is eliminated. Furthermore, by the urging force of the pressure increase spring 87, the ink cartridge 611 is strongly pushed to closely contact the flow path member 4, and since the lever arm 31 is fixed by the urging force of the bi-stable spring 65, the close contact of the ink cartridge 611 with the flow path member 4 is maintained. As a result, the loading of the ink cartridge 611 is completed. In this state, as is shown in FIG. 12A, the unlocking pins 34 have been passed over the flexible tongue pieces 63 and located behind these pieces 63. Further, the slide lock pieces 48 are projected, and the ink cartridge 611 is held by the lock sliders 36.

That is, as is shown in FIG. 11, when the lever arm 31 is rotated to the rightmost position, the ink cartridge 611 is moved to enter into the flow path member (4) side, together with the movable frame 58. The needles 4*a* of the flow path member 4 are inserted into the insertion holes 616*a* that are formed in the supports 616 of the ink cartridge 611. At this time, as is described above, since the engagement recessed portions 621 are engaged with the slide lock pieces 48, the ink cartridge 611 is held by the lock sliders 36 and the slider holders 37. The ink cartridge 611 is also supported by the flow path member 4 since the abutting portions 611*a* and 618*a* are in contact with the flow path member 4. That is, the ink cartridge 611 is held by the engagement recessed portions 621, which are engaged with the slide lock pieces 48, and the abutting portions 617*a* and 618*a*, which are in contact with the flow path member 4. Furthermore, since the engagement recessed portion 621, the abutting portion 618*a* and the substrate recessed portion 619 are located in order at relative distances in the direction of the height H of the ink cartridge 611, the moment of force is generated in the direction in which the substrate recessed portion 619 is pressed against the terminal arrangement portion 4*e*. As a result, the connection of the circuit board, which is attached to the substrate recessed portion 619, to the terminal arrangement portion 4*e* can be stabilized. In addition, at this time, as is shown in FIG. 13A, the unlocking pins 34 are passed over the elastic pieces 63 and reach the back side of the elastic pieces 63.

Figure 14:
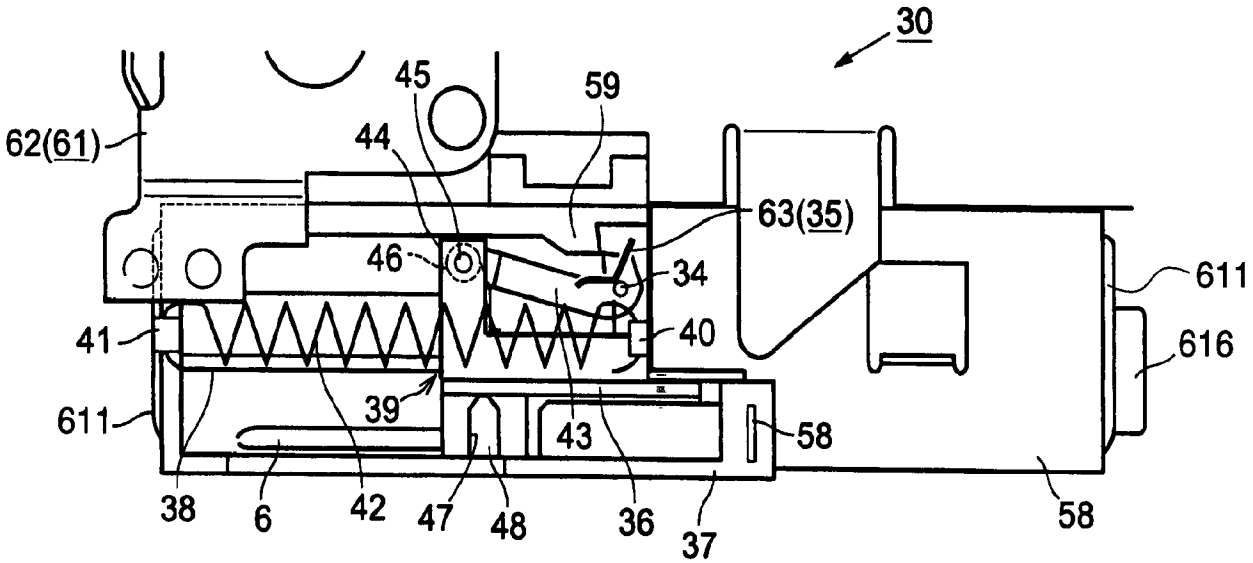
FIGS. 14A and 14B are a side view and a bottom view of the cartridge holding unit when an ink cartridge is extracted.
Figure 14:
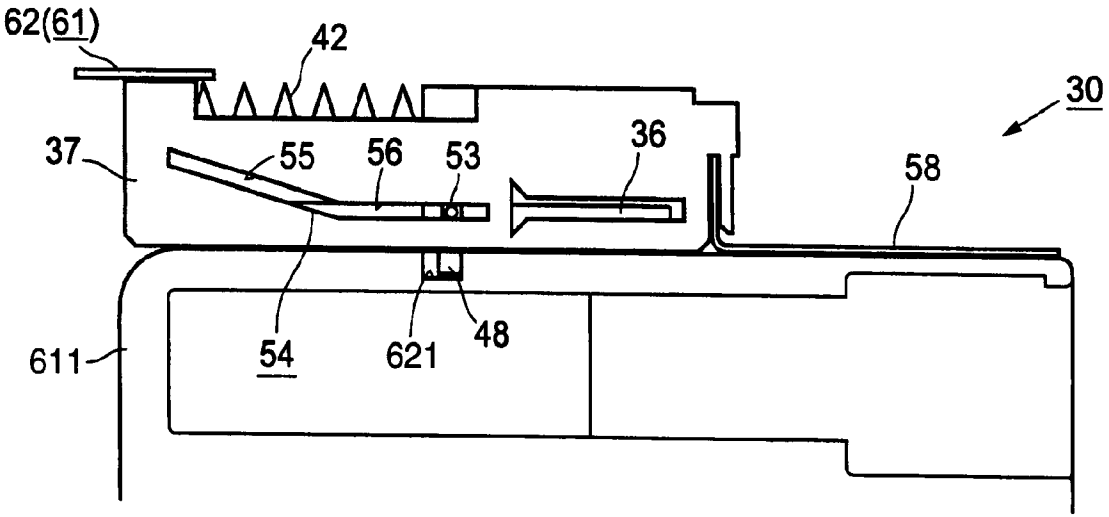
Figure 15:
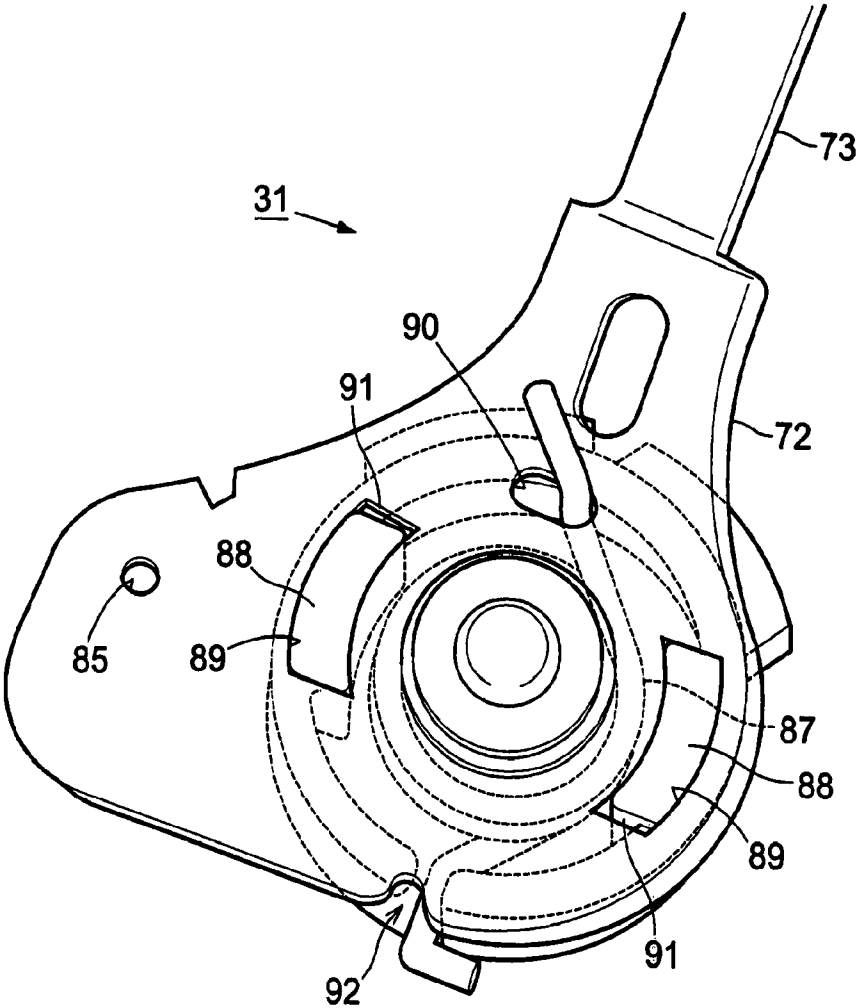
FIG. 15 is an enlarged perspective view of the base end of a lever arm.

(6) Removing (see FIGS. 13 and 14)

When as is shown in FIG. 13 the lever arm 31 is moved from the rightmost position to the left, as is shown in FIG. 14A, the unlocking pins 34 are moved downward along the slopes of the flexible tongue pieces 63, are passed under the pieces 63 along the lower traveling locus, and reach in front of the pieces 63. At this time, the engagement pawls 43, which are integrally formed with the unlocking pins 34, are rotated downward against the urging force of the lock springs 46, and are disengaged from the engagement ribs 59. Then, when the lever arm 31 is moved to the leftmost position shown in FIG. 3, the ink cartridge 611 is ejected by a distance of 22 mm or more from the rear end of the main body 3 by the urging forces of the exaction spring 42 and the bi-stable spring 65. Thus, the ink cartridge 611 is removed.

That is, for extraction of the ink cartridge 611, the lever arm 31 located at the rightmost position as is shown in FIG. 11 is moved to the left (clockwise in FIG. 11). As is shown in FIG. 13, when the lever arm 31 is moved to the left, the first pinion 75 is rotated clockwise in FIG. 13, and the a slide bar 78 is moved to the left in FIG. 13. As the slide bar 78 is moved to the left, the second and third pinions 79 and 80 are rotated counterclockwise in FIG. 13. As a result, the movable frame 58 having the third racks 81 meshing with the third pinions 80 is moved to the side opposite to the flow path member 4. Therefore, the ink cartridge 611, which is fixed to the movable frame 58 through the lock sliders 36, is separated from the flow path member 4, and the needles 4*a* are removed from the insertion holes 616*a*.

As is shown in FIG. 14A, when the lock sliders 36 are separated from the flow path member 4 at a predetermined distance, the unlocking pins 34 are brought in contact with the back faces of the elastic pieces 63. As the lock sliders 36 are gradually separated from the flow path member 4, the unlocking pins 34 are slid along the back faces of the elastic pieces 63, and reach the lower ends of the elastic pieces 63. As a result, the engagement pawls 43 are turned downward against the urging force of the lock springs 46.

When the lever arm 31 is rotated to the leftmost position, the engagement pawls 43 are disengaged from the engagement ribs 59, and by the extraction springs 42, the lock sliders 36 are urged toward the opening of the attachment/detachment device (toward the side plate 37*d* side of the slider holders 37). Thus, the lock sliders 36 are brought in contact with the contact faces 625 of the ink cartridge 611, and push the ink cartridge 611 toward the opening. Further, when the guide protrusions 53 of the slide lock pieces 48 are moved from the horizontal portions 56 to the slope portions 55, the slide lock pieces 48 are released from the engaged recessed portions 621 of the ink cartridge 611. As a result, the ink cartridge 611 is put into a state in which it is disengaged from the lock sliders 36. When the slide lock pieces 48 are completely separated from the engagement recessed portions 621 of the ink cartridge 611, the ink cartridge 611 is ejected to the side opposite to the flow path member 4 by also using the urging force of the bi-stable spring 65.

According to this embodiment, the following effects can be obtained.

(1) In this embodiment, the engagement recessed portion 621 and the pressing rib 622 are formed in the side face 612*d*, 612*e* of the case 612 (container portion 614) of the ink cartridge 611. Further, the front face of the first rib 623, which constitute the pressing rib 622, is defined as the contact face 625 that contacts the lock slider 36.

When the ink cartridge 611 is inserted into the attachment/detachment device 1, the contact face 625 is brought in contact with the lock slider 36 so that the lock slider 36 is moved within the slider holder 37. Further, as the lock slider 36 is moved, the slide lock piece 48, which is projected toward the traveling locus of the ink cartridge 611, is engaged with the engagement recessed portion 621. In this manner, the case 612 is fixed to the lock slider 36. Therefore, by only inserting the ink cartridge 611 into the attachment/detachment device 1, the ink cartridge 611 can be easily fixed to the lock slider 36. Furthermore, since the lock slider 36 is fixed to the slider holder 37 by the engagement between the engagement pawl 43 and the engagement rib 59, the ink cartridge 611 can be fixed to the lock slider 36 and the slider holder 37. In addition, since the ink cartridge 611, which is fixed to the lock slider 36 and the slider holder 37, is moved and fixed to the flow path member 4 by driving the rotating and sliding mechanism 32, the ink cartridge 611 can be easily connected (fixed) to the flow path member 4 with the stable operation (2) In this embodiment, since the contact face 625 of the case 612 is projected outwardly of the case 612, the contact face 625 can be easily and reliably brought in contact with the lock slider 36 when the ink cartridge 611 is inserted into the attachment/detachment device 1.

(3) In this embodiment, the engagement recessed portion 621 is provided in the side face 612*d*, 612*e* of the case 612 in the form of a recess. Therefore, the engagement recessed portion 621 is engaged with the slide lock piece 48 by entering the slide lock piece 48 into the engagement recessed portion 621. Therefore, the case 612 can be comparatively securely fixed to the lock slider 36.

(4) In this embodiment, the side face of the engagement recessed portions 621 close to the rear face 612*f* is formed to be continuous to the contact face (front face) 625 of the first rib 623. With this arrangement, when the ink cartridge 611 is inserted, the contact face 625 can be brought in contact with the lock slider 36 to relatively position the slide lock piece 48 and the engagement recessed portion 621 accurately. Therefore, since the slide lock piece 48 and the engagement recessed portion 621 can be aligned substantially at the same position in the direction in which the ink cartridge 611 is inserted, the slide lock piece 48 can be easily entered into the engagement recessed portion 621.

(5) In this embodiment, the second rib 624 is provided to the first rib 623 having the contact face 625. Therefore, when the lock slider 36 contacts the contact face 625, the second rib 624 can reinforce the first rib 623 to prevent the damage on the contact face 625 or on the first rib 623.

(6) In this embodiment, the introduction support 620 used to introduce waste ink, the substrate recessed portion 619 to attach the circuit board, the first and second fitting holes 617 and 618 and the supports 616 are provided on the case 612 of the ink cartridge 611. With this arrangement, since the introduction support 620 is formed to be connected to a waste liquid absorption portion, the ink cartridge 611 can be used as a waste liquid reservoir in which waste ink is retained. Further, when the circuit board is attached to the ink cartridge 611, the ink attribute information can be stored. Furthermore, the first and second fitting holes 617 and 618 can be employed to position the ink cartridge 611. Moreover, when the abutting portions 617*a* and 618*a* are brought in contact with the flow path member 4, the position of the ink cartridge 611 in the insertion direction can be determined. That is, when the introduction support 620, the substrate recessed portion 619, the first and second fitting holes 617 and 618 and the abutting portions 617*a* and 618*a* are formed, the function of the ink cartridge 611 can be improved.

(7) In this embodiment, the engagement recessed portion 621, the attachment face of the substrate recessed portion 619 and the abutting portion 618*a* are located in the case 612 in this order at relative distances from the bottom face 612*c* of the case 612 in the direction of the height. Therefore, when the ink cartridge 611 is connected to the flow path member 4, the moment of force is exerted in the direction in which the substrate recessed portion 619 is pressed against the terminal arrangement portion 4*e*, so that the connection of the circuit board, attached to the substrate recessed portion 619, to the terminal arrangement portion 4 can be stabilized.

(8) In this embodiment, in the case 612, the engagement recessed portion 621 and the contact face 625 are provided on the face that is close to the lock slider 36 and that is parallel to the direction in which the ink cartridge 611 is inserted. Therefore, when the ink cartridge 611 is inserted, the lock slider 36 can be easily brought in contact with the contact face 625.

(9) In this embodiment, when the lever arm 31 is turned so that the rotating and sliding mechanism 32 moves the movable frame 58 toward the side opposite to the flow path member 4 (i.e., in the direction in which the ink cartridge 611 is removed), the flexible piece 63 is used to disengage the engagement pawl 43 from the engagement rib 59, to thereby release the fixed state of the lock slider 36 and the slider holder 37. Further, when the lock slider 36 is urged toward the opening of the attachment/detachment device 1 by the extraction spring 42, the slide lock piece 48 of the lock slider 36 is escaped from the engagement recessed portion 621 of the ink cartridge 611. With this arrangement, the ink cartridge 611 in the fixed state during mounting can be easily extracted from the attachment/detachment device 1.

This embodiment may be altered as follows.

(1) In this embodiment, the engagement recessed portion 621 is formed in a square shape in the case 612. However, a groove extended in the direction of the height may be formed in the side face 612*d*, 612*e* of the case 612. In short, an arbitrary shape can be employed so long as at least the part of the slide lock piece 48 can be engaged.

(2) In this embodiment, the pressing rib 622 is formed substantially in an L shape in the case 612. However, other shapes can be employed, and, for example, a simple square protrusion may be employed. Further, the second rib 624 may be omitted so long as a necessary strength can be obtained by only the first rib 623.

(3) In this embodiment, as the ink cartridge 611, six ink packs 613 are provided in the case 612. However, the arrangement is not limited to this, and an arbitrary structure can be employed so long as one type or two or more types of ink can be contained in the case. For example, the ink cartridge 611 may include, instead of the ink packs 613, ink containing portions that are formed by adhering a film or films to the case 612.

(4) In this embodiment, an ink ejection printer has been employed as a liquid ejection apparatus. However, another type of liquid ejection apparatus maybe employed, e.g., a printing apparatus such as a facsimile machine or a copier; a liquid ejection apparatus for ejecting a liquid, such as an electrode material or a color material, that is employed for manufacturing a liquid crystal display, an EL display or a plane light emission display; a liquid ejection apparatus for ejecting a bio-organic material that is used for bio-chip manufacturing; or a sample ejection apparatus such as a precision pipette. The fluid (liquid) employed is not limited to ink, and another fluid may be employed.

(Modifications)

The ink cartridge attachment/detachment device according to the present invention and the recording apparatus that comprises this attachment/detachment device basically employ the above described configuration. However, the configuration can be changed or partially omitted without departing from the subject of the invention. An explanation will now be given, first, for three modifications (first to third modifications) where an ink cartridge erroneous insertion prevention means is provided, second, for another modification (fourth modification) where a creep load reduction means is provided, and third, a modification where parts are slightly changed.

Moreover, an explanation will be given for a modification (fifth modification) where an ink cartridge insertion state judging means is provided, and then for a modification (a sixth modification) where an ink cartridge erroneous load warning means is provided, and thereafter a modification where parts are slightly changed.

(First Modification)

Figure 17:
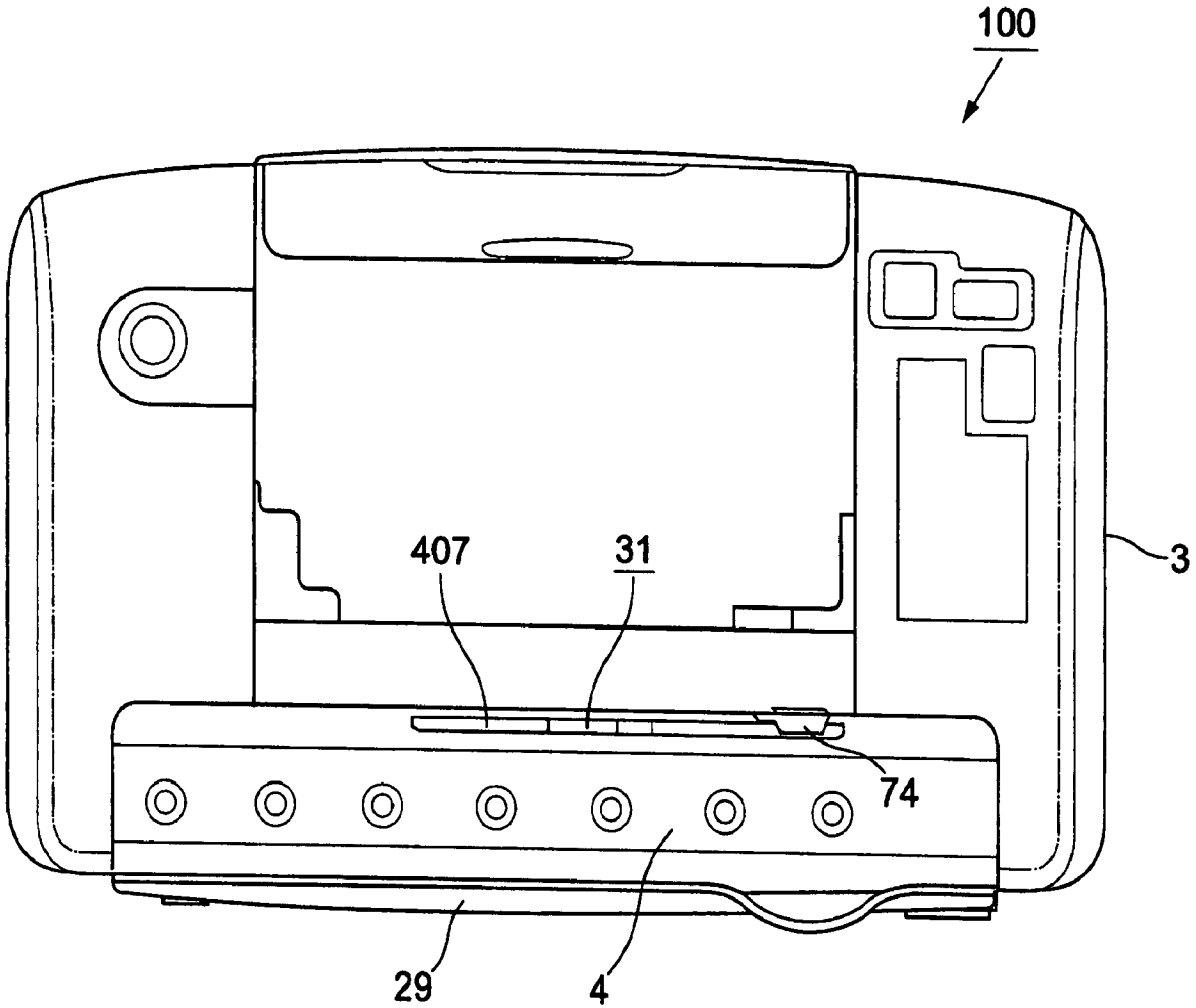
FIG. 17 is a rear view of the ink jet printer wherein the lid member is open and the lever arm is located at a set position.
Figure 18:
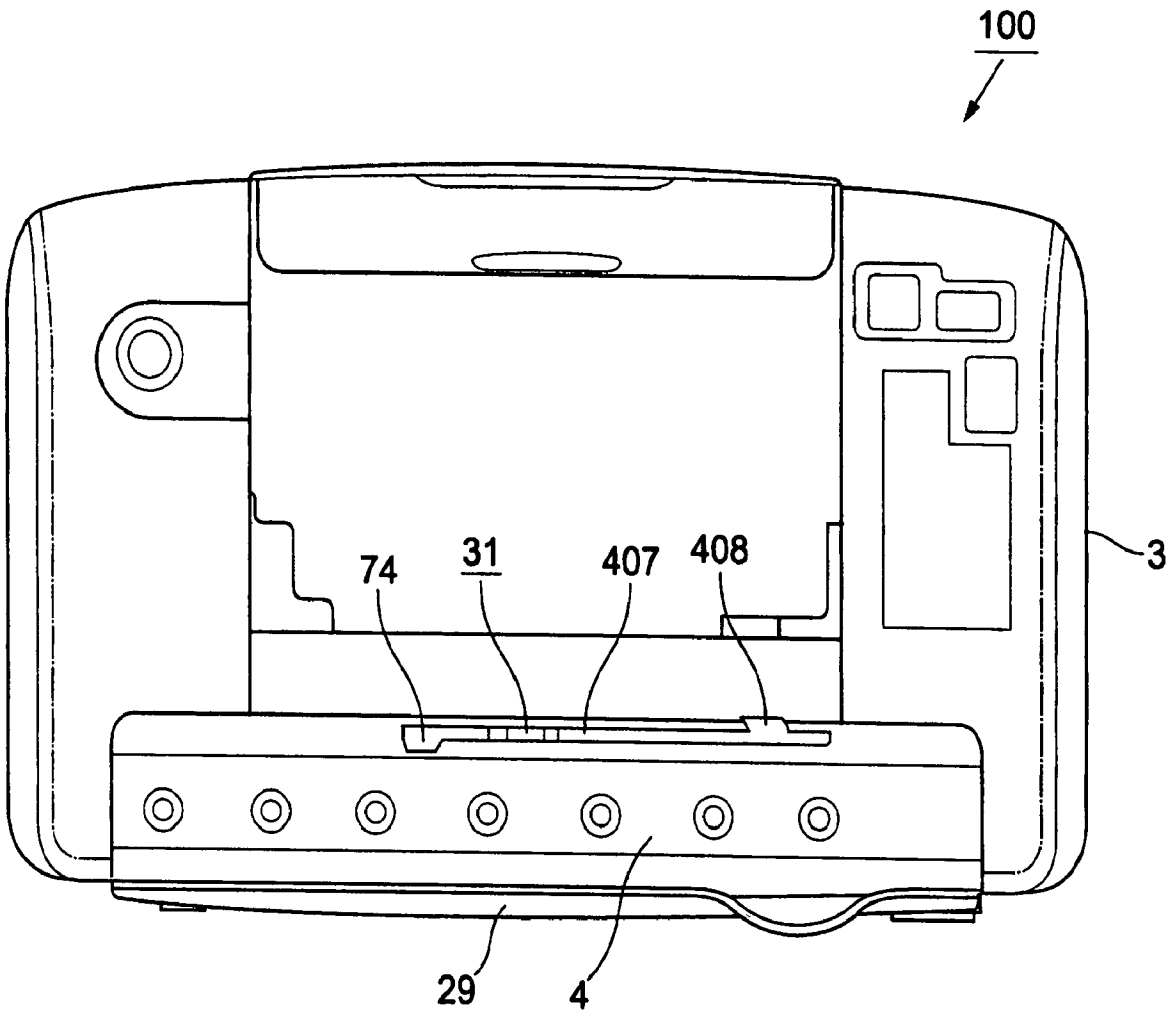
FIG. 18 is a rear view of the ink jet printer wherein the lid member is open and the lever arm is located at a reset position.
Figure 19:
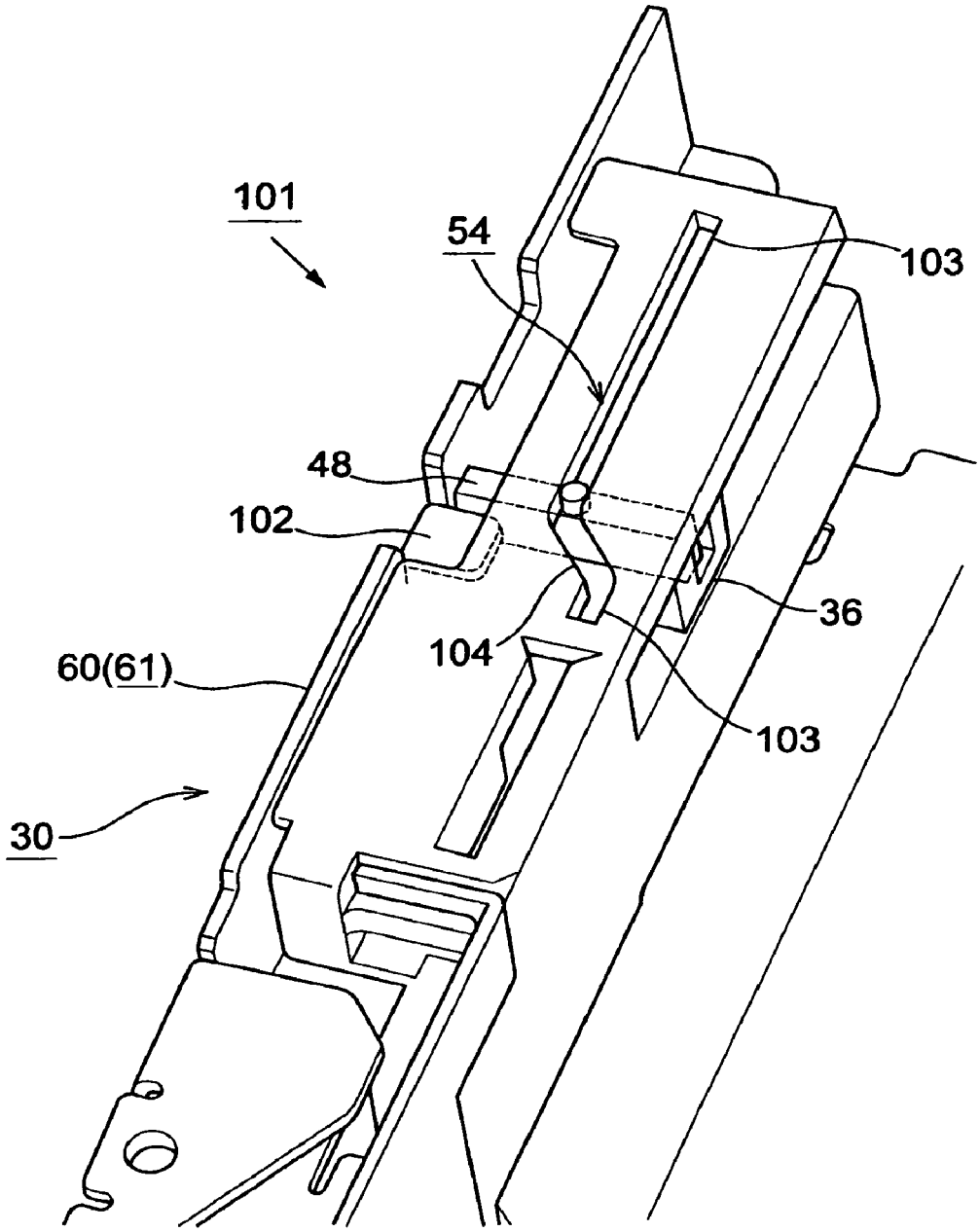
FIG. 19 is a oblique bottom perspective view of an ink cartridge insertion prevention unit.
Figure 21:
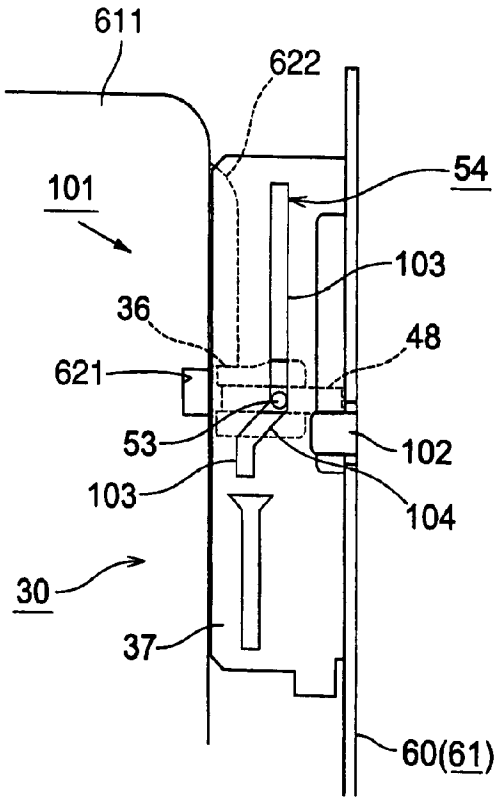
FIGS. 21A and 21B are bottom views of the operating state of the ink cartridge erroneous insertion prevention unit at the erroneous insertion time.
Figure 21:
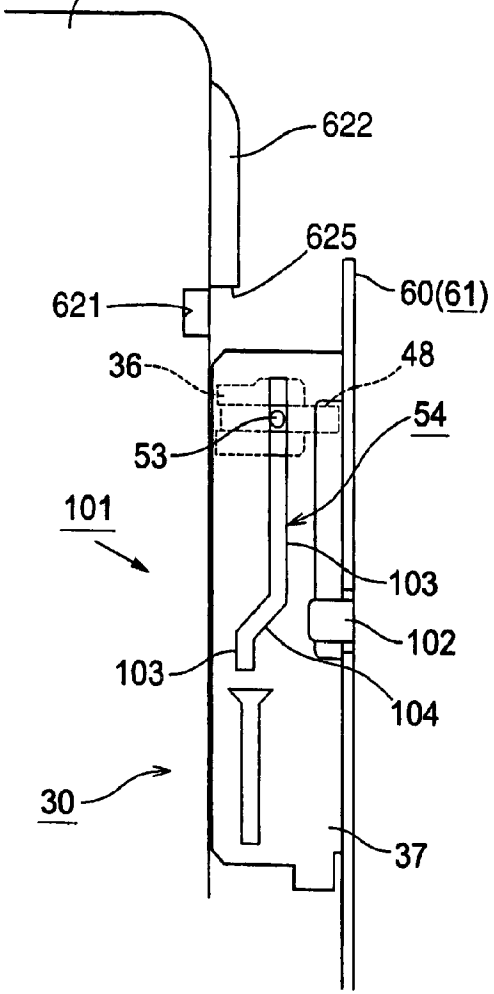
Figure 22:
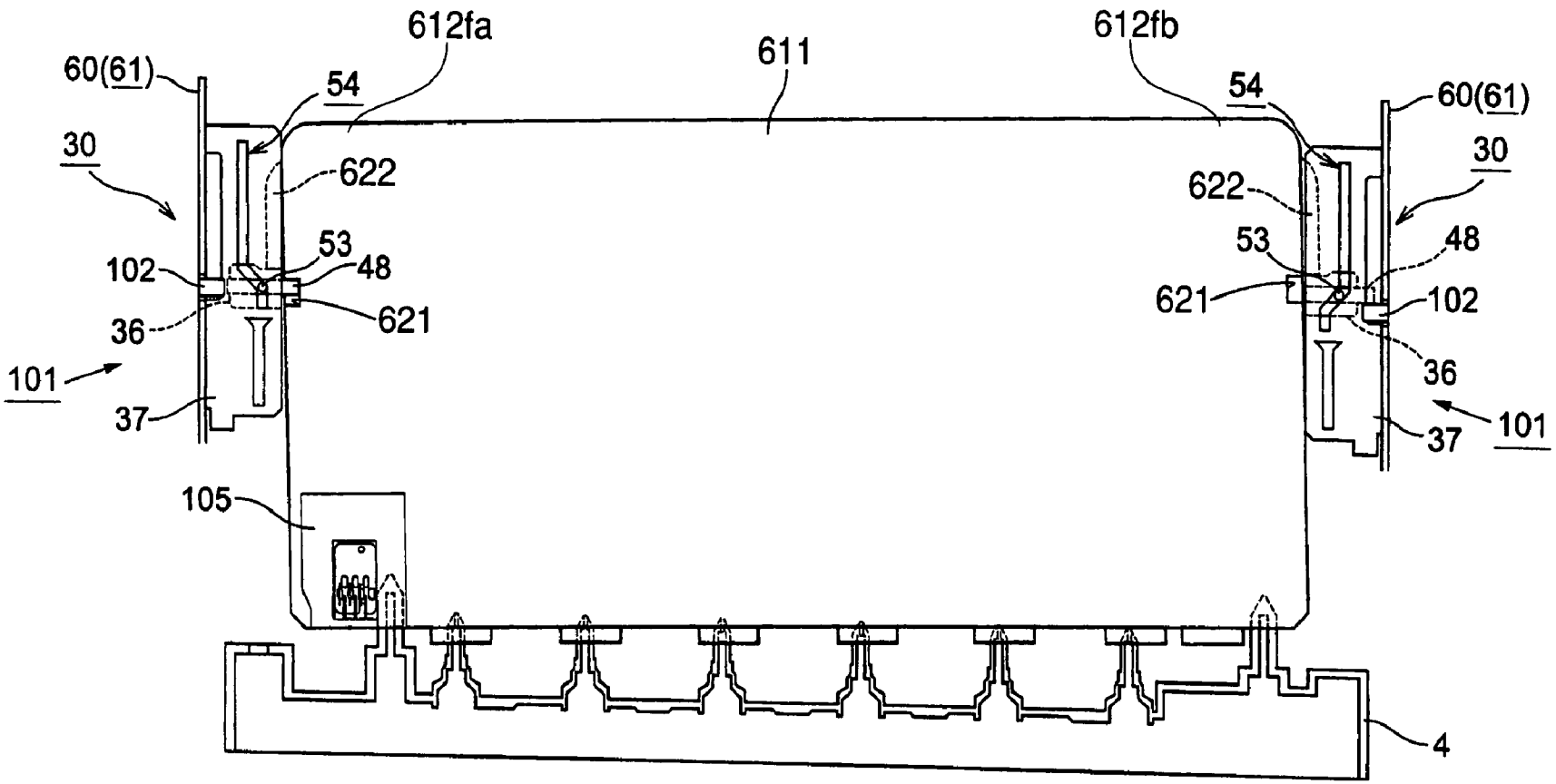
FIG. 22 is a bottom view of the operating state of the ink cartridge erroneous insertion prevention unit when only the cartridge holding unit on one side is operated.

FIG. 16 is a rear view of an ink jet printer where a lid member is closed. FIG. 17 is a rear view of the ink jet printer where the lid member is open and a lever arm is located at a set position. FIG. 18 is a rear view of an ink jet printer where the lid member is open and the lever arm is located at a reset position. FIG. 19 is an enlarged, oblique perspective bottom view of the periphery of ink cartridge erroneous insertion prevention means. FIGS. 20A, 20B and 20C are bottom views of the operating state of the ink cartridge erroneous insertion prevention means when the ink cartridge is normally inserted. FIGS. 21A and 21B are bottom views of the operating state of the ink cartridge erroneous insertion prevention means when the ink cartridge is erroneously inserted. FIG. 22 is a bottom view of the operating state of the ink cartridge erroneous insertion prevention means when the ink cartridge is inserted while only a cartridge holding means on one side is operated.

In this modification, ink cartridge erroneous insertion prevention units 101 are provided for an ink cartridge attachment/detachment device 1. The ink cartridge erroneous insertion prevention units 101 prevent the erroneous insertion of an ink cartridge 611 when a lever arm 31 is located at a set position shown in FIG. 17 whereat the lever arm 31 is supposed to be located when loading of the ink cartridge 611 is completed, or when the lever arm 31 is located at a position other than a reset position shown in FIG. 18 whereat loading of the ink cartridge 611 is permitted. Furthermore, the ink cartridge erroneous insertion prevention units 101 prevent the insertion of the ink cartridge 611 when only a cartridge holding unit 30 on one side is operated as is shown in FIG. 22.

Figure 20:
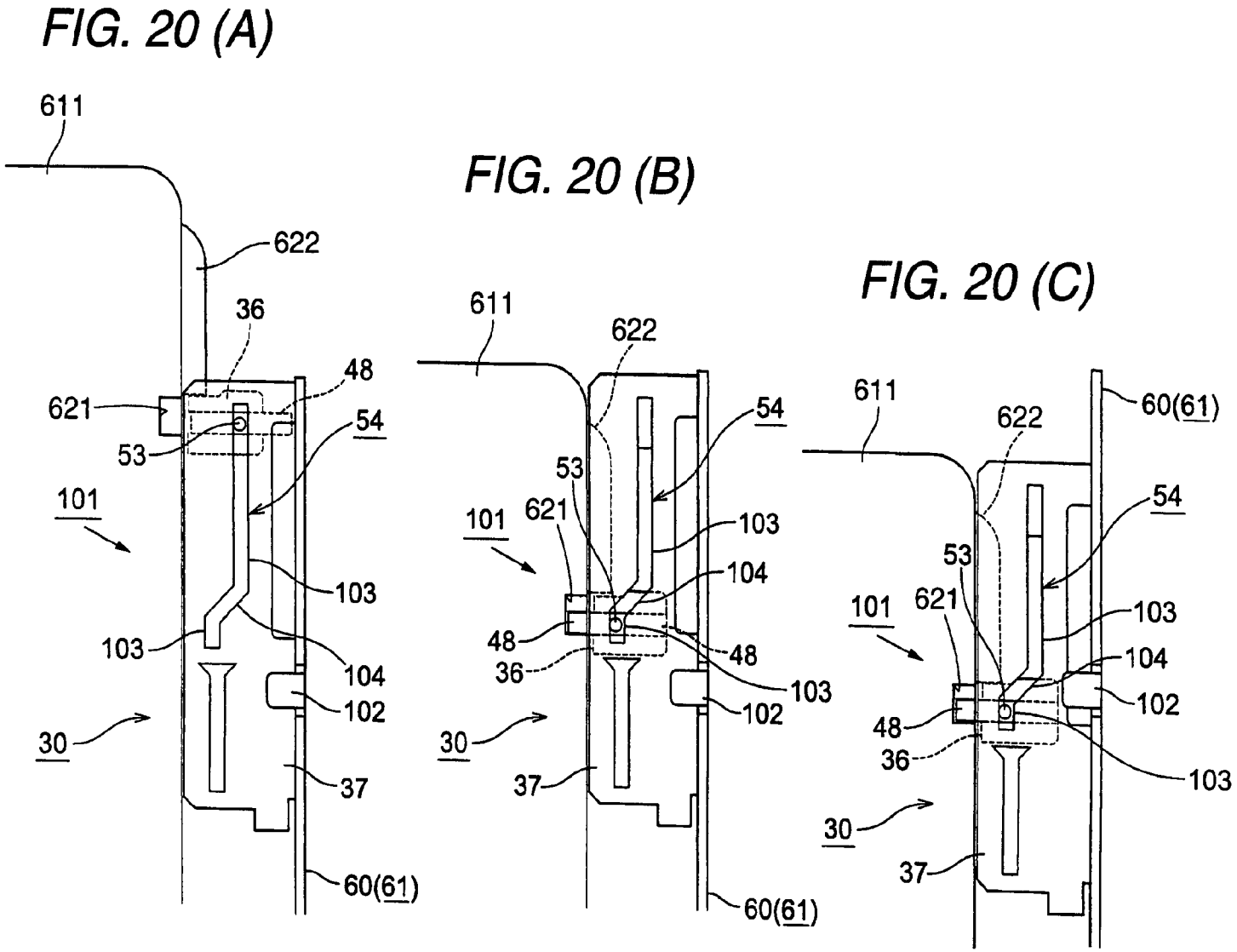
FIGS. 20A, 20B and 20C are bottom views of the operating state of the ink cartridge insertion prevention unit at the normal insertion time.

Specifically, each of the ink cartridge erroneous insertion prevention units 101 includes; an erroneous insertion prevention protrusion 102, and the slide lock piece 48 and the guide groove 54 described above. The erroneous insertion prevention protrusions 102 are formed by using one part of subframes 60 of a fixed frame 61, and are projected toward lock sliders 36. Unlike the previous embodiment, as is shown in FIGS. 20 and 21, horizontal portions 103 are provided at the front ends and the rear ends of the guide grooves 54, so that the horizontal portions 103 close to the front ends of the guide grooves 54 are long, while the horizontal portions 103 close to the rear ends are short. Furthermore, slope portions 104 are formed to connect the front and rear horizontal portions 103, and the length of the slope portions 104 are considerably shorter than that for the previous embodiment.

In addition to the shapes of the guide grooves 54, the positions of the slope portions 104 of the guide grooves 54 and the positions of the erroneous insertion prevention protrusions 102 are very important That is, when the lever arm 31 is located at the set position, and when the ink cartridge 611 is to be inserted, as is shown in FIG. 21B, the slide lock pieces 48 take a traveling locus, so that they contact the erroneous insertion prevention protrusions 102 to prevent the erroneous insertion of the ink cartridge 611.

When only the cartridge holding unit 30 on one side is operated (in FIG. 22, only the left cartridge holding unit 30 is operated), and when the lever arm 31 is pivoted from the reset position to the set position, the slide locking piece 48 of the other cartridge holding unit 30 that is not operated (in FIG. 22, the right cartridge holding unit 30) takes a traveling locus, so that it contacts the erroneous insertion prevention protrusion 102 to prevent the insertion of the ink cartridge 611.

Therefore, since the ink cartridge 611 is inserted in the incomplete state where it is tilted as is shown in FIG. 22, a cartridge sensor 105 detects a failure and notifies a user of that an error has occurred for the insertion of the ink cartridge 611 and loading is incomplete. When the ink cartridge 611 is inserted in the correct state where the lever 31 is located at the reset position, as is shown in FIG. 20, the slide lock pieces 48 can reach the engagement recessed portions 621 without contacting the erroneous insertion prevention protrusions 102. As a result, the ink cartridge 611 can be held by the cartridge holding unit 30.

With this configuration, the erroneous loading of the ink cartridge 611, which is caused by a difference in the position of the lever arm 31, seldom occurs in the ink cartridge attachment/detachment device of this modification. Further, the sizes of the slider holders 37 need not be strictly and precisely designed to prevent the tilting of the ink cartridge 611, and the structure for maintaining a complicated attitude is not necessary. Only with a comparatively simple cam groove structure, the erroneous insertion of the ink cartridge 611 can be prevented, and the usability can be improved.

(Second Modification)

Figure 23:
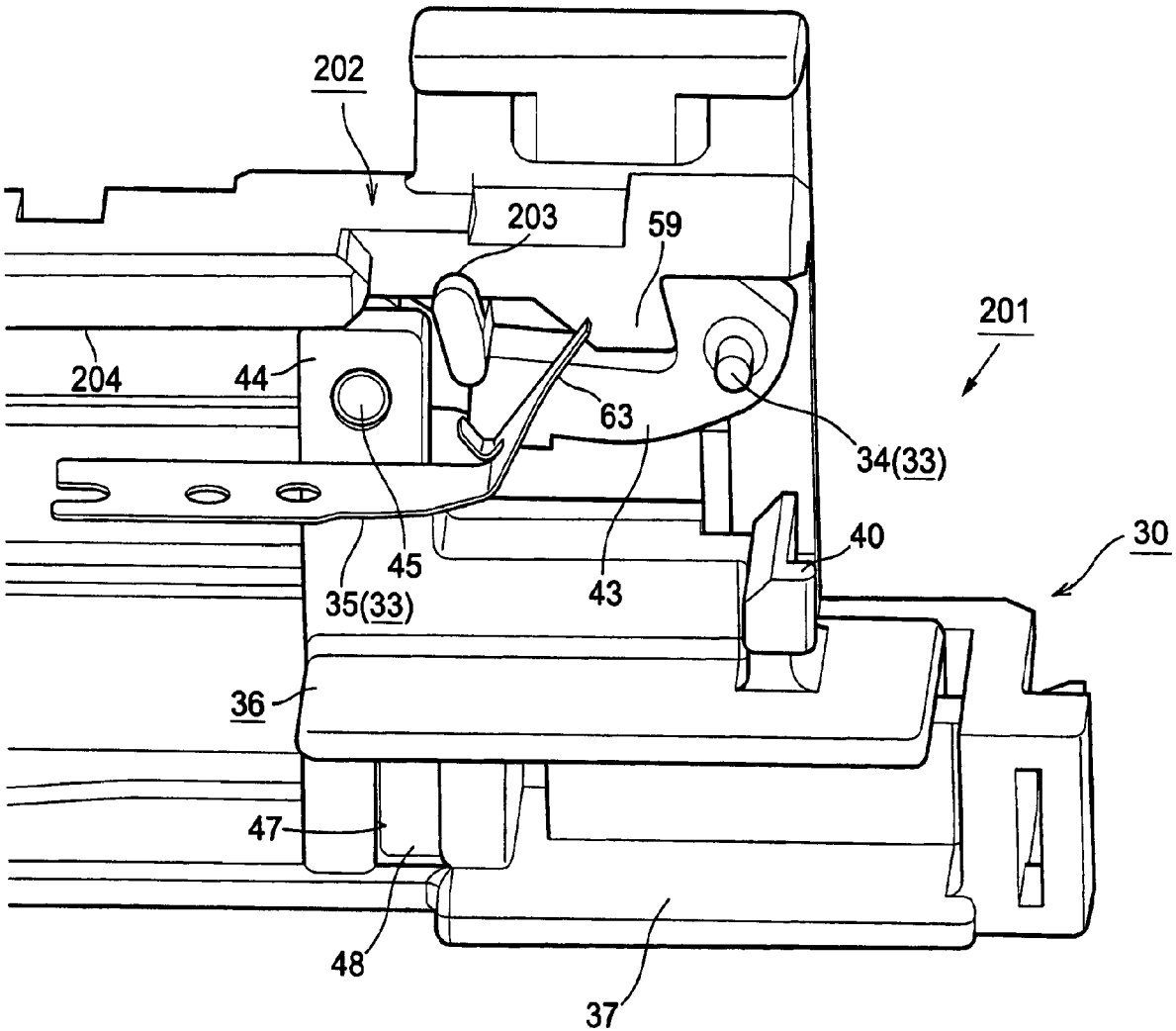
FIG. 23 is a perspective view of an ink cartridge insertion prevention unit that includes a collision avoiding unit.
Figure 26:
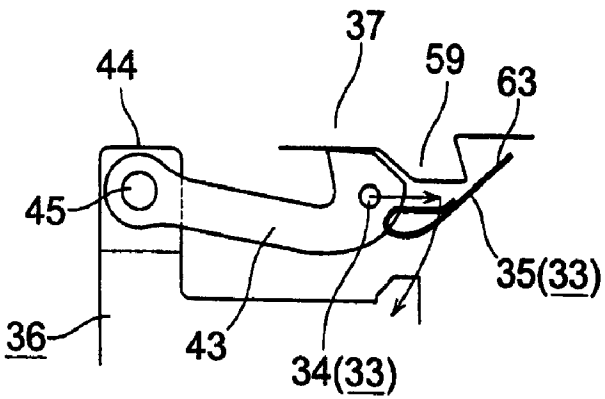
FIGS. 26A, 26B and 26C are side cross-sectional views of the operating state, of an ink cartridge erroneous insertion prevention unit that does not include a collision avoiding unit.
Figure 26:
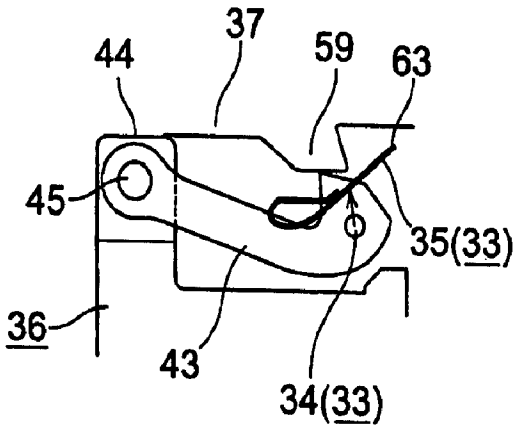
Figure 26:
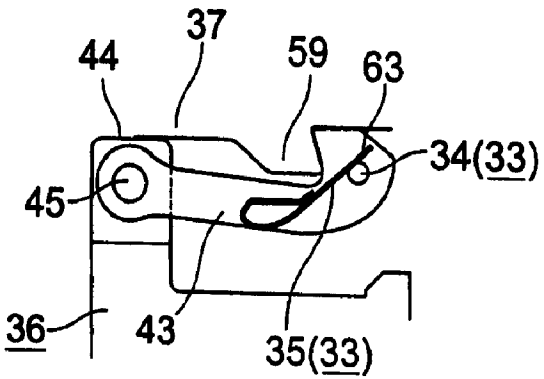
Figures 27, 27C:
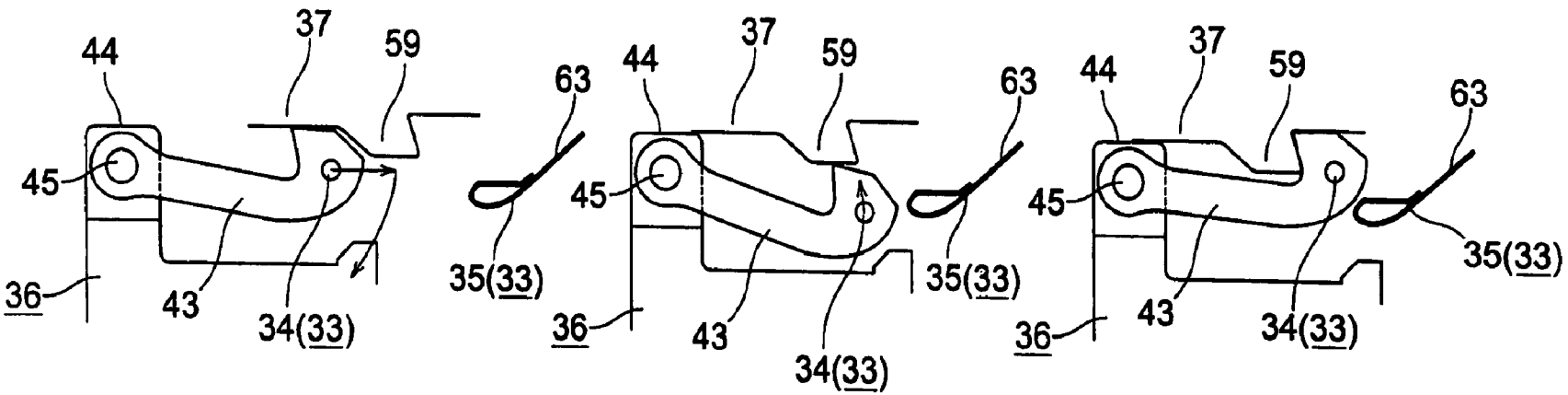

FIG. 23 is a perspective view of an ink cartridge erroneous insertion prevention unit including a collision avoiding unit. FIGS. 24A, 24B and 24C are side cross-sectional views of the operating state of the ink cartridge erroneous insertion prevention unit wherein an ink cartridge is erroneously inserted while a lever arm is located at a position other than a reset position. FIGS. 25A, 25B and 25C are side cross-sectional views of the operating state of the ink cartridge erroneous insertion prevention unit wherein an ink cartridge is inserted while the lever arm is located at the reset position. FIGS. 26A, 26B and 26C are side cross-sectional views of the operating state of an ink cartridge erroneous insertion prevention unit that does not include a collision avoiding unit, wherein an ink cartridge is erroneously inserted while the lever arm is located at a position other than the reset position. FIGS. 27A, 27B and 27C are side cross-sectional views of the operating state of the ink cartridge erroneous insertion prevention unit wherein an ink cartridge is inserted while the lever arm is located at the reset position.

In this modification, ink cartridge erroneous insertion prevention units 201 are provided for an ink cartridge attachment/detachment device 1. The ink cartridge erroneous insertion prevention units 201 basically have the same configuration as the ink cartridge erroneous insert ion prevention units 101 in the first modification, except in that collision avoiding units 202 are further provided.

When the ink cartridge 611 is inserted while the lever arm 31 is located at a position other than the reset position, the collision avoiding units 202 avoid a collision between the unlocking pins 34 and the flexible unlocking pieces 35, and prevent the unlocking pieces 35 from being bent by the collision. Specifically, the collision avoiding units 202 include: collision avoiding convex portions 203, which are rotated together with the engagement pawls 43; and contact faces 204, which are formed integrally with the engagement ribs 59 that engage the engagement pawls 43, and which are brought in contact with the collision avoiding convex portions 203.

Figure 24:
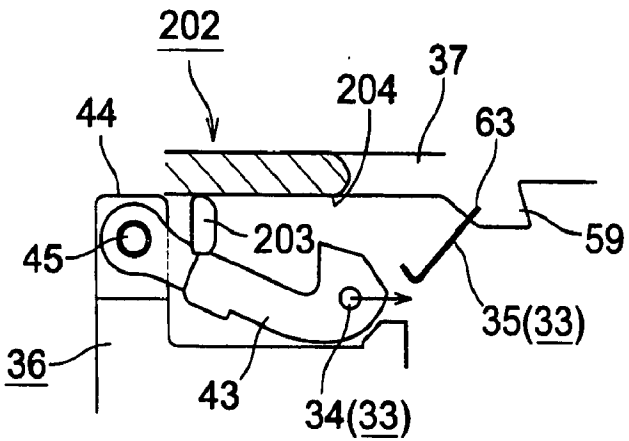
FIGS. 24A, 24B and 24C are side cross-sectional views of the operating state of the ink cartridge erroneous insertion prevention unit when erroneous insertion is performed while a lever arm is located at a position other than a reset position.
Figure 24:
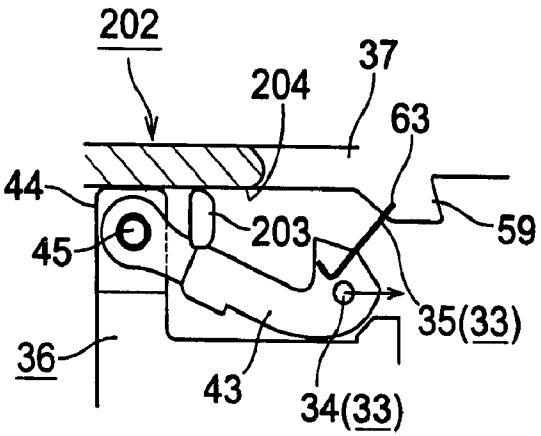
Figure 24:
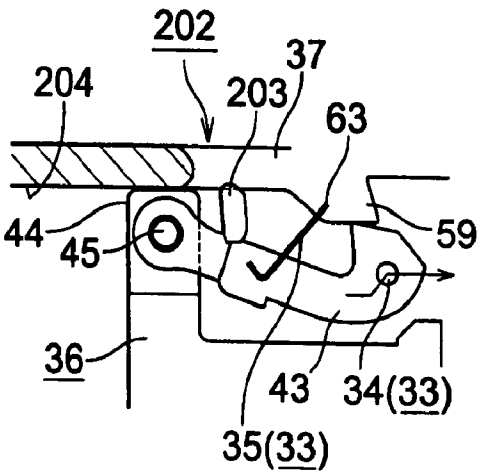
Figure 25:
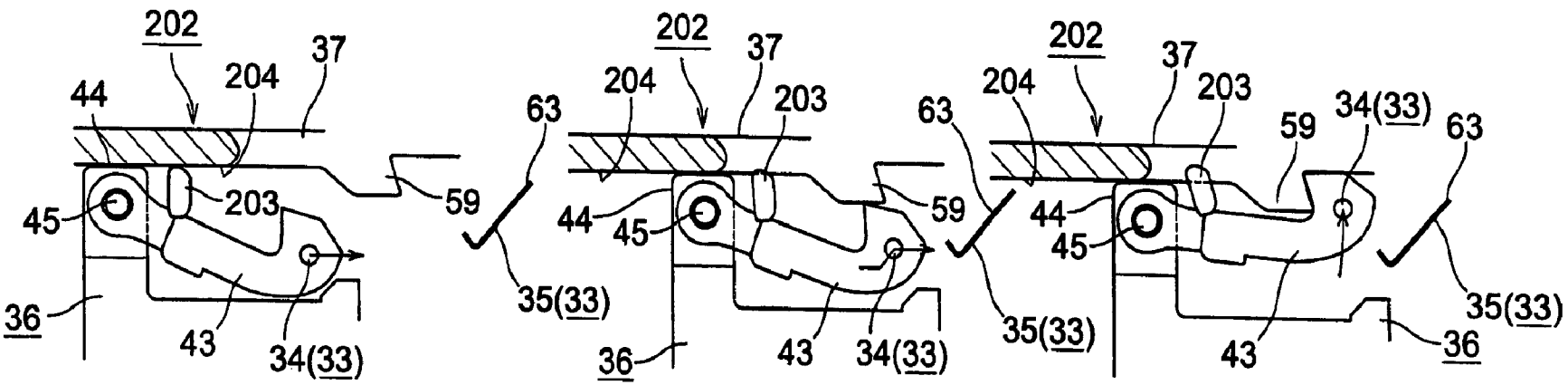
FIGS. 25A, 25D and 25C are side cross-sectional views of the operating state of the ink cartridge erroneous is insertion prevention unit when normal insertion is performed while the lever arm is located at the reset position.

As is shown in FIGS. 23 to 25, the collision avoiding convex portions 203 are formed at the engagement pawls 43 close to the rotary shafts 45, and have an elliptical shape in side view. When the collision avoiding convex portions 203 are in contact with the contact faces 204, the height of the unlocking pins 34 is smaller than the height of the flexible unlocking pieces 35. With this arrangement, as is shown in FIGS. 24A to 24C, when the ink cartridge 611 is inserted while the lever arm 31 is located at a position other than the reset position, the normal rotation locus of the engagement pawls 43, along which the unlocking pins 34 collide with the flexible unlocking pieces 35, is corrected, so that, as an example, the unlocking pins 34 take an avoiding rotation locus that passes under the flexible unlocking pieces 35.

When the lever arm 31 is located at the reset position, as is shown in FIGS. 25A to 25C, the state wherein the collision avoiding convex portions 203 are in contact with the contact faces 204 is terminated at an early stage. However, at a stage before the unlocking pins 34 collide with the flexible unlocking pieces 35, the engagement pawls 43 are already engaged with the engagement ribs 59, so that a collision between the unlocking pins 34 and the flexible unlocking pieces 35 can be avoided.

With this configuration, the following defect can be eliminated. Assume that the collision avoiding unit 202 is not provided. In this case, so long as the lever arm 31 in FIG. 27 is located at the reset position, the collision between the unlocking pins 34 and the unlocking pieces 35 can be avoided; however, when the lever arm 31 in FIG. 26 is located at a position other than the reset position, these components 34 and 35 collide with each other, and the unlocking pieces 35 are deformed.

(Third Modification)

Figure 28:
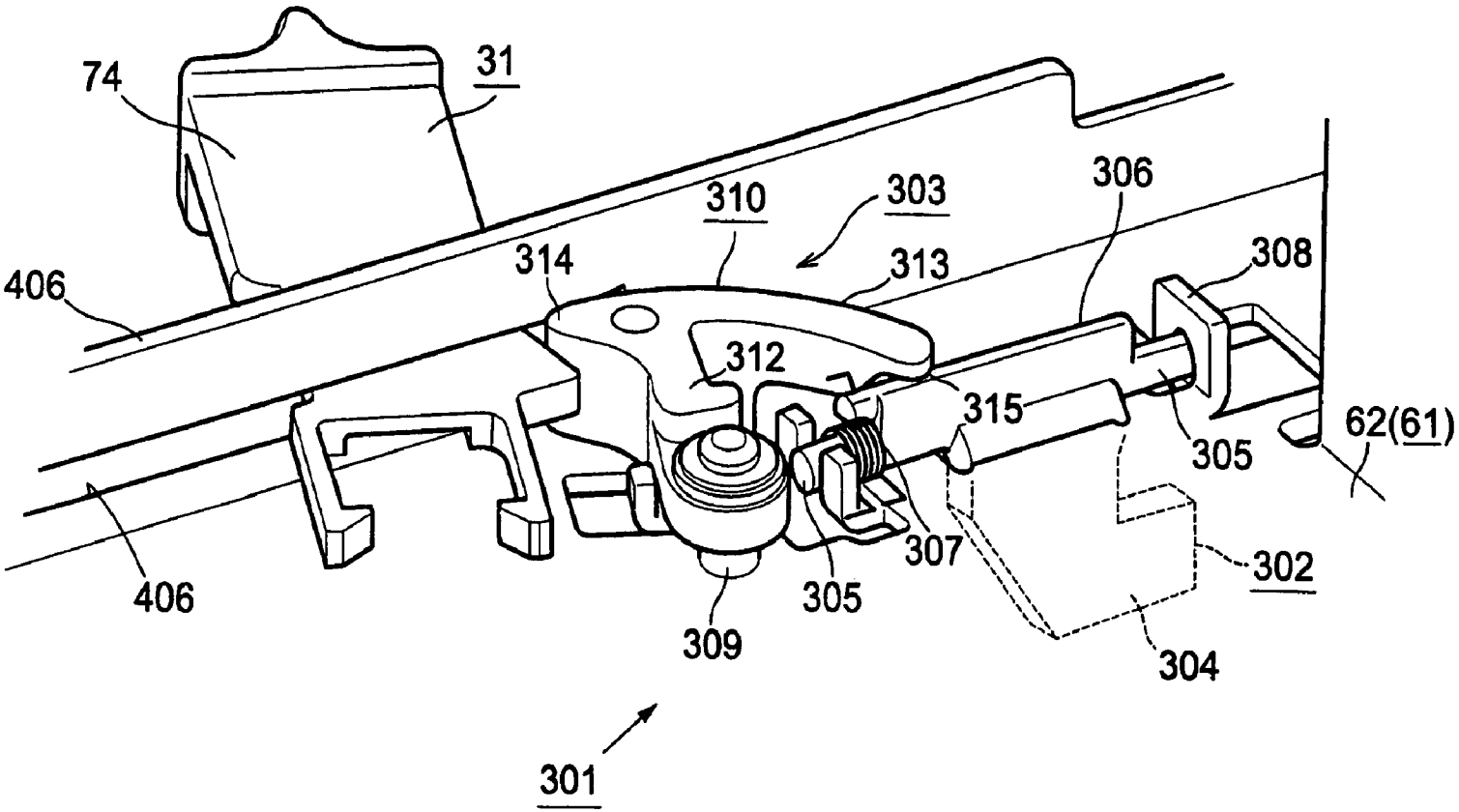
FIG. 28 is a perspective view of the operating state of the ink cartridge erroneous insertion prevention unit when the lever arm is located at a position other than the reset position.
Figure 29:
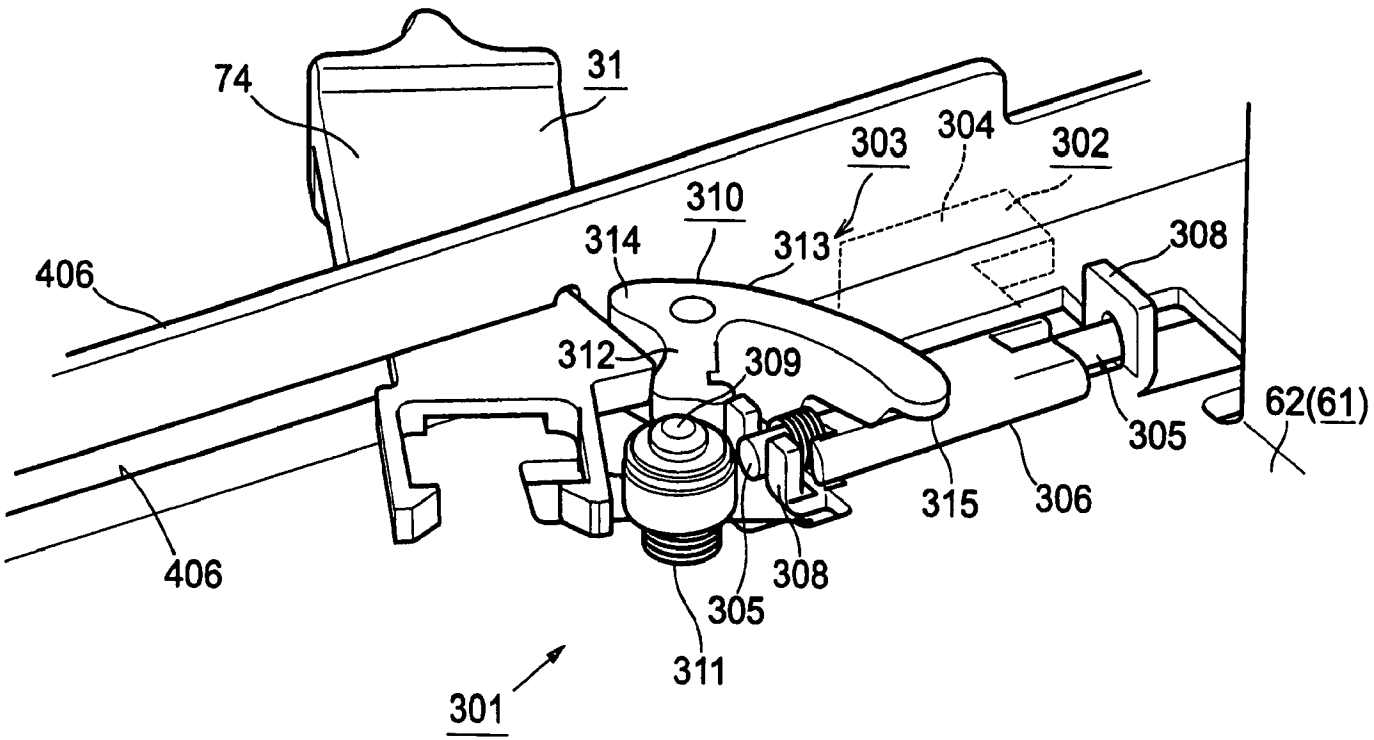
FIG. 29 is a perspective view of the operating state of the ink cartridge erroneous insertion prevention unit when the lever arm is located at the reset position.
Figure 30:
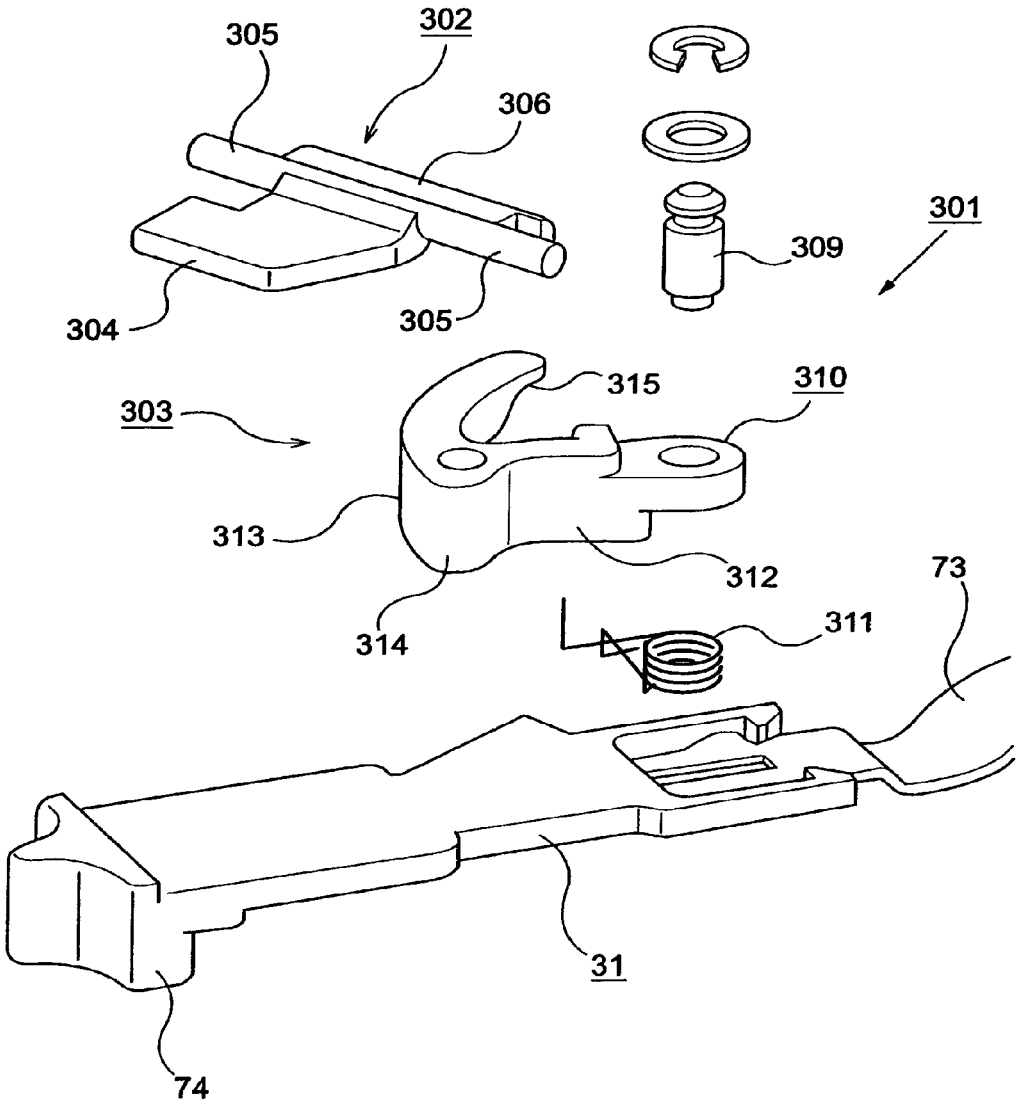
FIG. 30 is an exploded perspective view of the ink cartridge erroneous insertion prevention unit.
Figure 31:
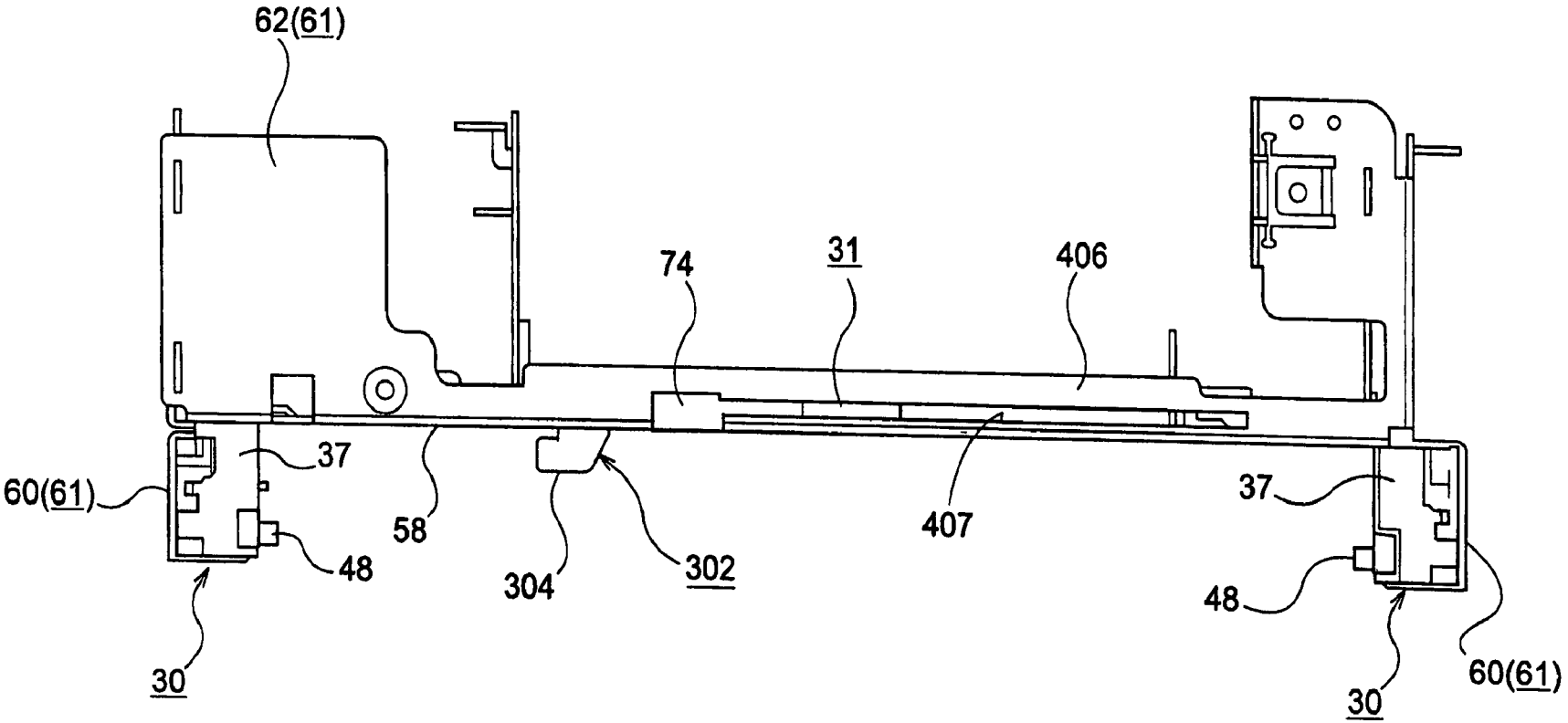
FIG. 31 is a rear view of the ink cartridge insertion prevention unit when the lever arm is located at a position other than the reset position.
Figure 32:
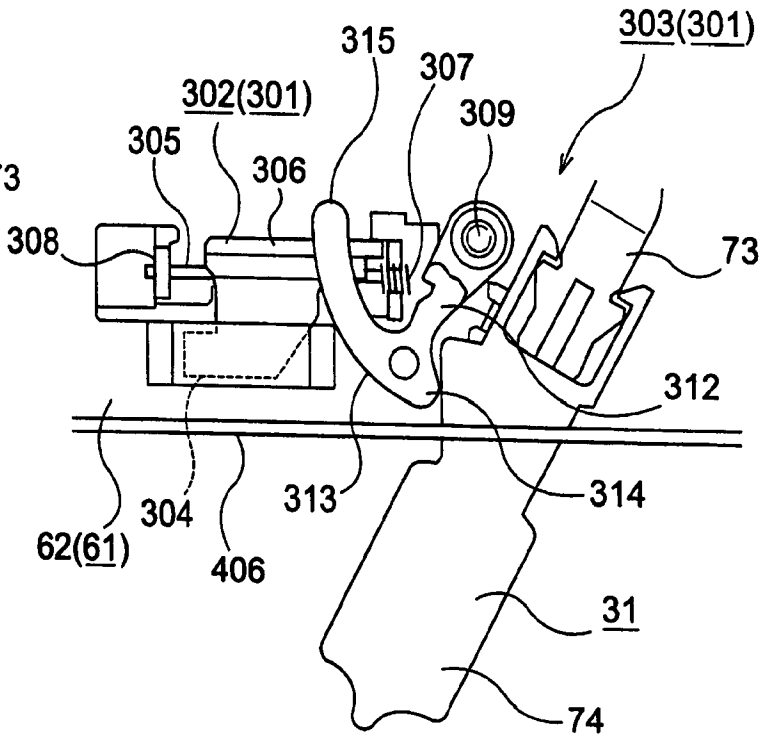
FIGS. 32A and 32B are plan views of the ink cartridge erroneous insertion prevention unit in the state wherein the lever arm is located at a position other than a release position, and in the state wherein the lever arm is located at the release position.
Figure 32:
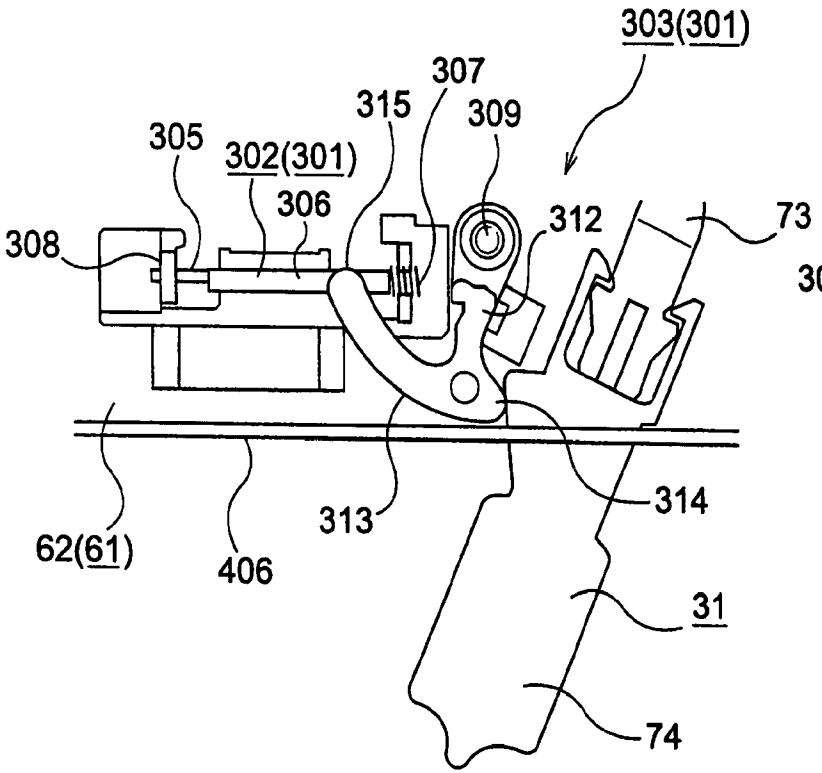
Figure 33:
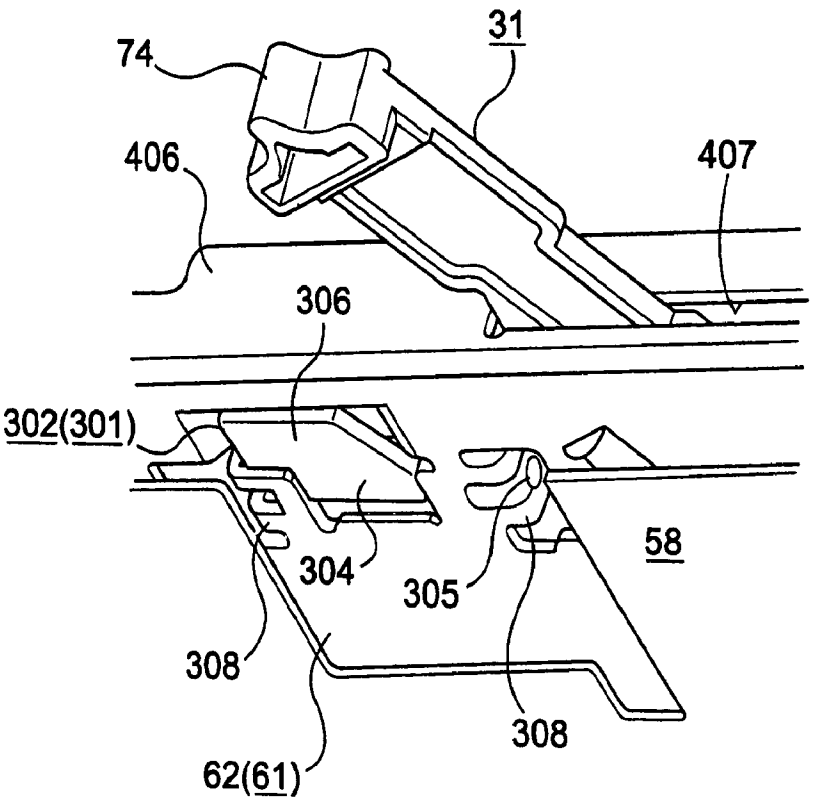
FIGS. 33A and 33B are obliquely bottom perspective views of the ink cartridge erroneous insertion prevention unit
Figure 33:
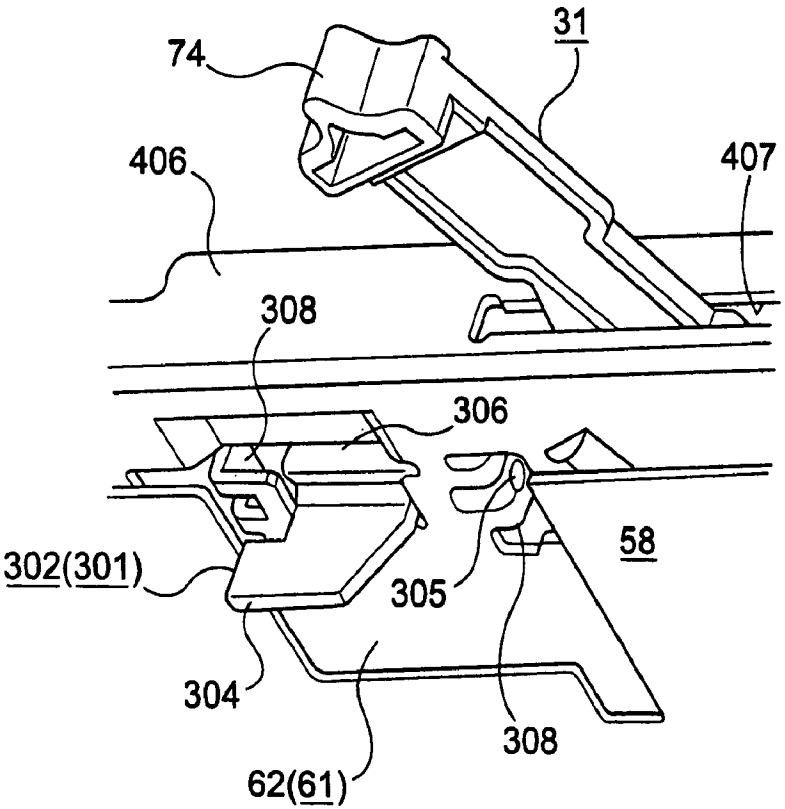

FIG. 28 is a perspective view of an ink cartridge erroneous insertion unit when a lever arm is located at a position other than the reset position. FIG. 29 is a perspective view of the ink cartridge erroneous insertion prevention unit when the lever arm is located at the reset position. FIG. 30 is an exploded perspective view of the ink cartridge erroneous insertion prevention unit. FIG. 31 is a rear view of the ink cartridge erroneous insertion prevention unit when the lever arm is located at a position other than the reset position. FIG. 32A is a plan view of the ink cartridge erroneous insertion prevention unit in the state wherein the lever arm is located at a position other than the reset position, and FIG. 32B is a plan view of the ink cartridge erroneous insertion prevention unit in the state wherein the lever arm is located at the reset position. FIGS. 33A and 33B are oblique perspective bottom view of the ink cartridge erroneous insertion prevention unit.

In this modification, ink cartridge erroneous insertion prevention units 301 are provided for an ink cartridge attachment/detachment device 1. Each of the ink cartridge erroneous insertion prevention units 301 includes: an erroneous insertion prevention flap 302 that adopts a retraction attitude, which permits the insertion of the ink cartridge 611, when the lever arm 31 is located at the reset position, or that adopts a projection attitude, which inhibits the insertion of the ink cartridge 611, when the lever arm 31 is located at a position other than the reset position. Each of the ink cartridge erroneous insertion prevention unit 301 also includes: a rotational direction changing mechanism 303, for converting the horizontal movement of the lever arm 31 into the vertical movement of the erroneous insertion prevention flap 302.

The erroneous insertion flap 302 includes a flap main body 304, a rotary shaft 305 and a conversion cam follower 306, and always adopts the projection attitude by the-urging force of a helical torsion spring 307 that functions as urging means. The flap main body 304 is a wing plate member that directly contacts the insertion end face of the ink cartridge 611 and prevents the erroneous insertion of the ink cartridge 611.

The rotary shaft 305 is provided for the base end of the flap main body 304. The rotary shaft 305 is rotatably connected to a bearing 308 that is formed for the main frame 62 of the fixed frame 61, and the axial direction of the rotary shaft 305 is set as a direction corresponding to the widthwise direction of the main frame 62. The conversion cam follower 306 is a member that is located on the output side of the rotational direction changing mechanism 303 that will be described next, and is provided for the end opposite to the flap main body 304 with the rotary shaft 305 in between.

The rotational direction changing mechanism 303 includes: a trigger 310, which is horizontally pivoted at a predetermined angle at a rotation pin 39 that is provided upright from the upper face of the main frame 62; the conversion cam follower 306 described above, which is provided relative to the erroneous insertion prevention flap 302; and a helical torsion spring 311 (shown in FIG. 29), which is urging means to push the trigger 310 to be constantly rotated toward the lever arm 31.

The trigger 310 includes: an arm 312, which is rotatably connected to the rotation pin 309 and is extended radially; and a conversion operating portion 313, which is extended circumferentially from the distal end of the arm 312 toward the lever arm 31 and the erroneous insertion prevention flap 302. An input contact portion 314 for contacting directly the lever arm 31 is provided for the input side of the conversion operating portion 313, while a conversion cam face 315, which contacts the conversion cam follower 306 of the erroneous insertion prevention flap 302, is provided for the output side.

The conversion cam face 315 contacts the conversion cam follower 306 to shift the erroneous insertion prevention flap 302 from the projection attitude to the retraction attitude. The conversion cam face 315 also functions as a rotation stopper for maintaining the projection attitude of the erroneous insertion prevention flap 302 when the ink cartridge 611 contacts the erroneous insertion prevention flap 302 at the projection attitude.

The thus arranged ink cartridge erroneous insertion prevention unit 301 is operated as follows. When the lever arm 31 is located at a position other than the reset position, as is shown in FIGS. 31, 32A and 33A, the erroneous insertion prevention flap 302 accepts the urging force of the helical torsion spring 307 and adopts the projection attitude that is perpendicular to the main frame 62. In this state, the user can visually understand that the insertion of the ink cartridge 611 is inhibited. Further, since the trigger 310 is held by the rotation stopper function of the conversion cam face 315, the erroneous insertion prevention flap 302 does not permit also physically the insertion of the ink cartridge 611.

When the lever arm 31 is located at the reset position, as is shown in FIGS. 32B and 33B, the trigger 310 is pivoted clockwise in FIG. 32B against the urging force of the helical torsion spring 311. Therefore, by the rotational direction changing function of the conversion cam face 315 and the conversion cam follower 306, the erroneous insertion prevention flap 302 is moved vertically to the front, and adopts the retraction attitude that is parallel to the main frame 62.

In this state, since there is no obstacle found visually and physically for the insertion of the ink cartridge 611, the insertion of the ink cartridge 611 is enabled. Therefore, the erroneous insertion of the ink cartridge 611, which is due to the difference in the position of the lever arm, can be prevented based on both the visual aspect and the physical aspect.

(Fourth Modification)

Figure 34:
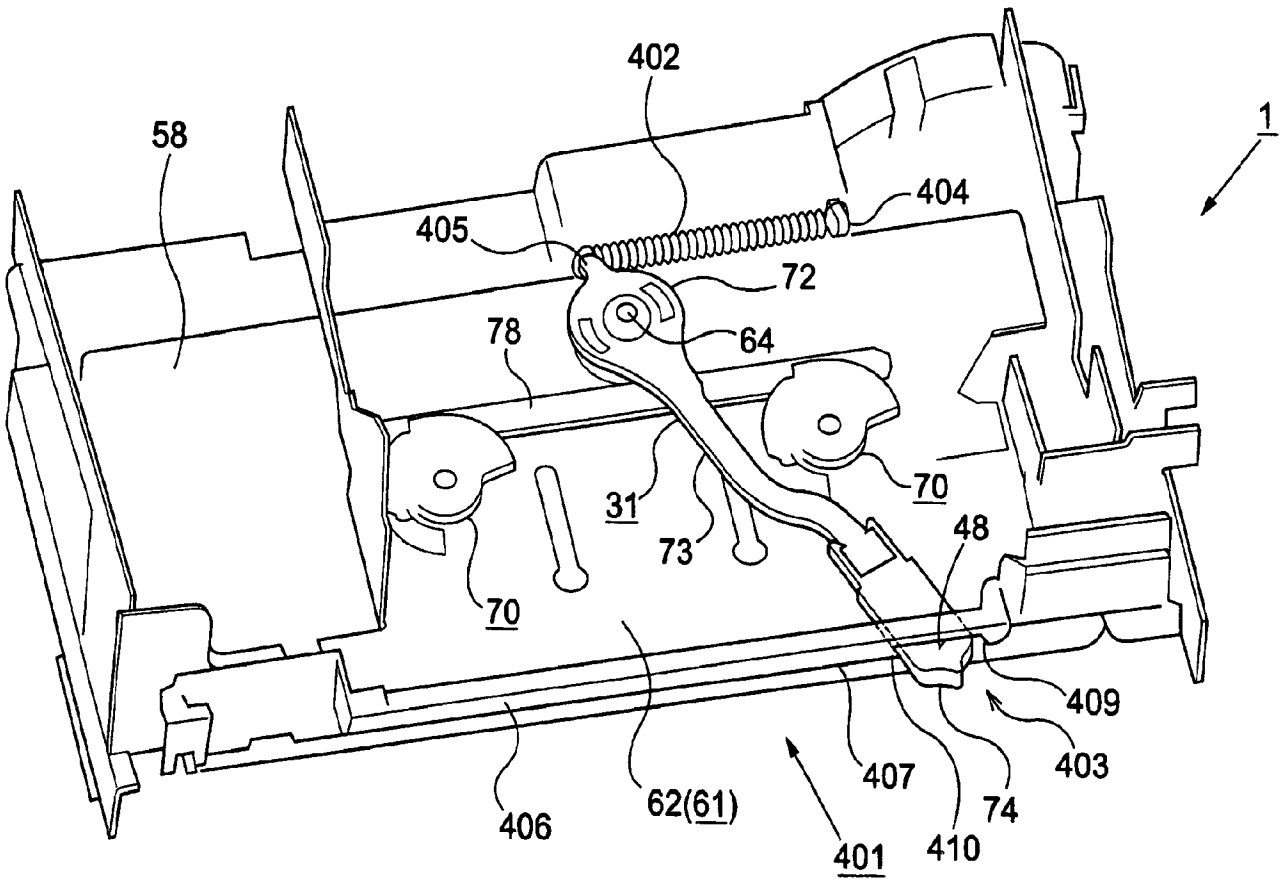
FIG. 34 is a perspective view of an ink cartridge attachment/detachment device comprising a creep load reduction unit.
Figure 35:
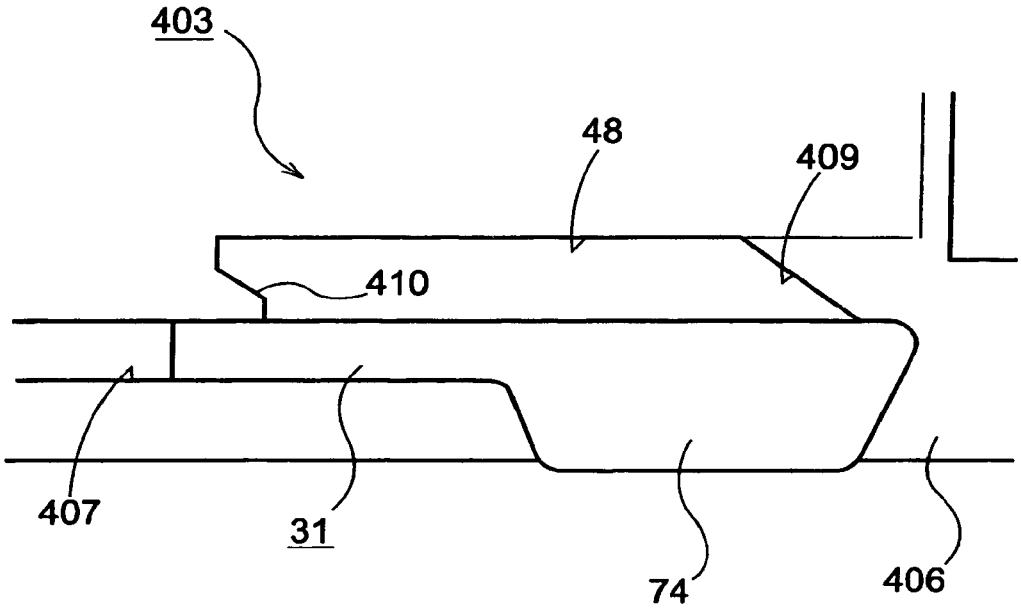
FIGS. 35A and 35B are rear views of the state wherein a lever arm is located at a set position and the state wherein the lever arm is located at a set standby position, respectively.
Figure 35:
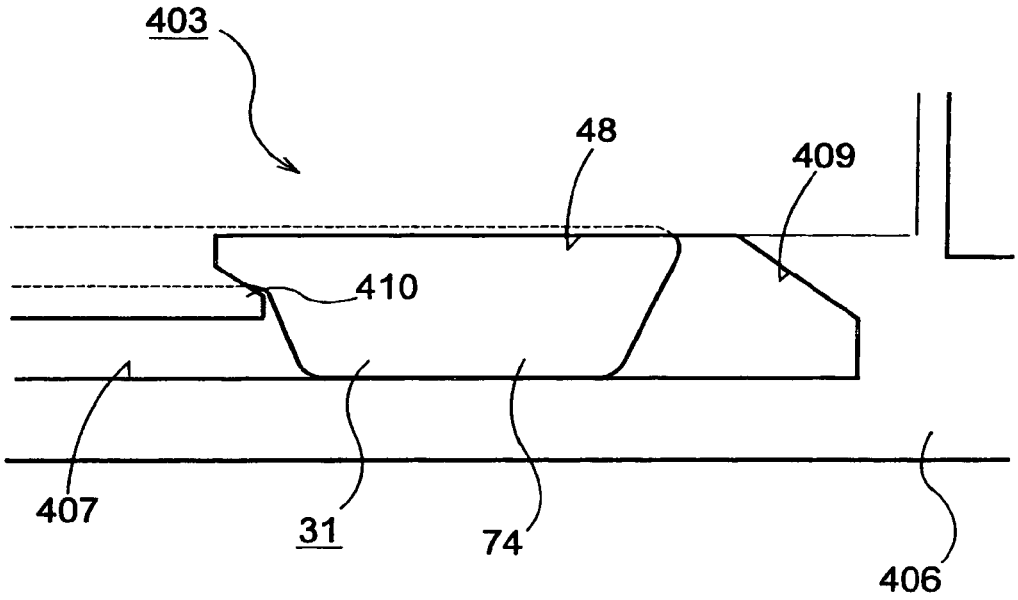
Figure 36:
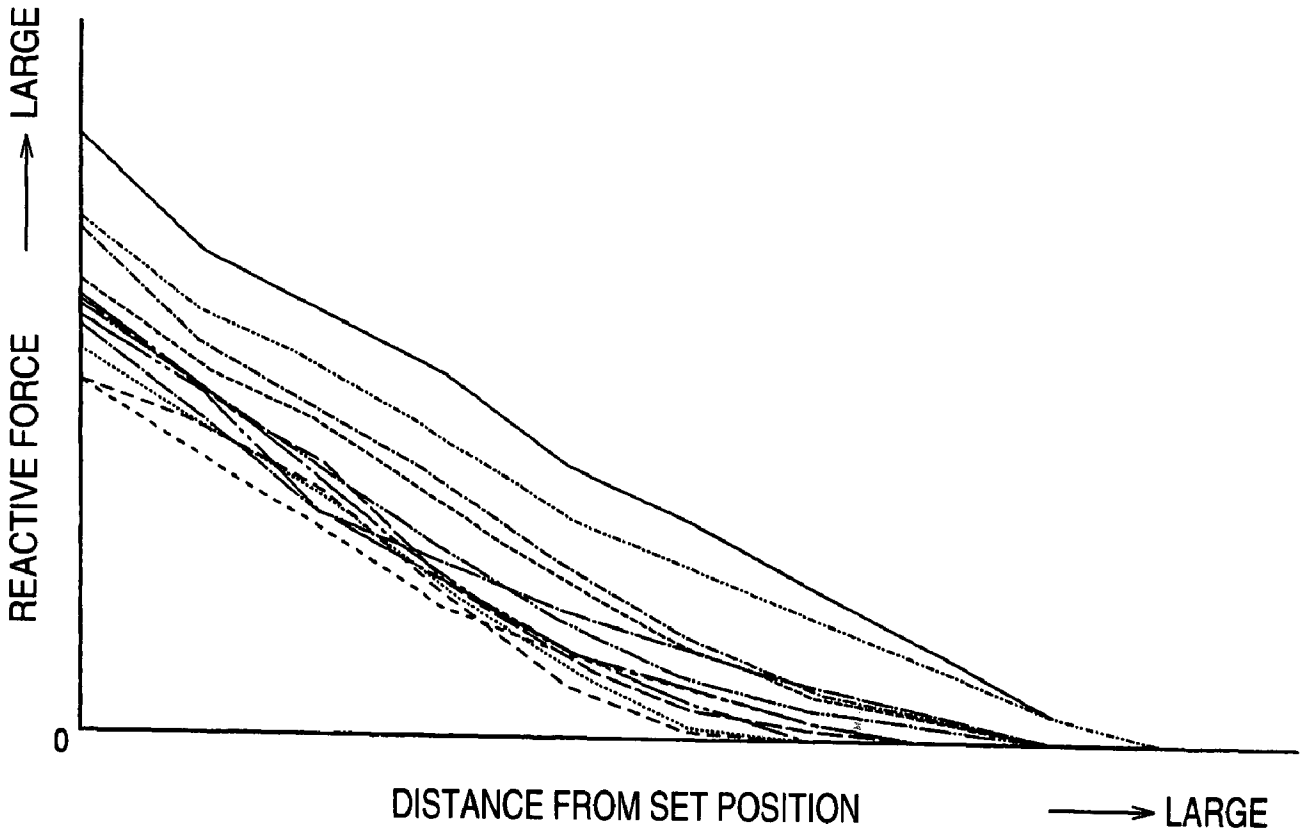
FIG. 36 is a graph showing the shift of a reactive force exerted to an ink cartridge by a flow path member.
Figure 37:
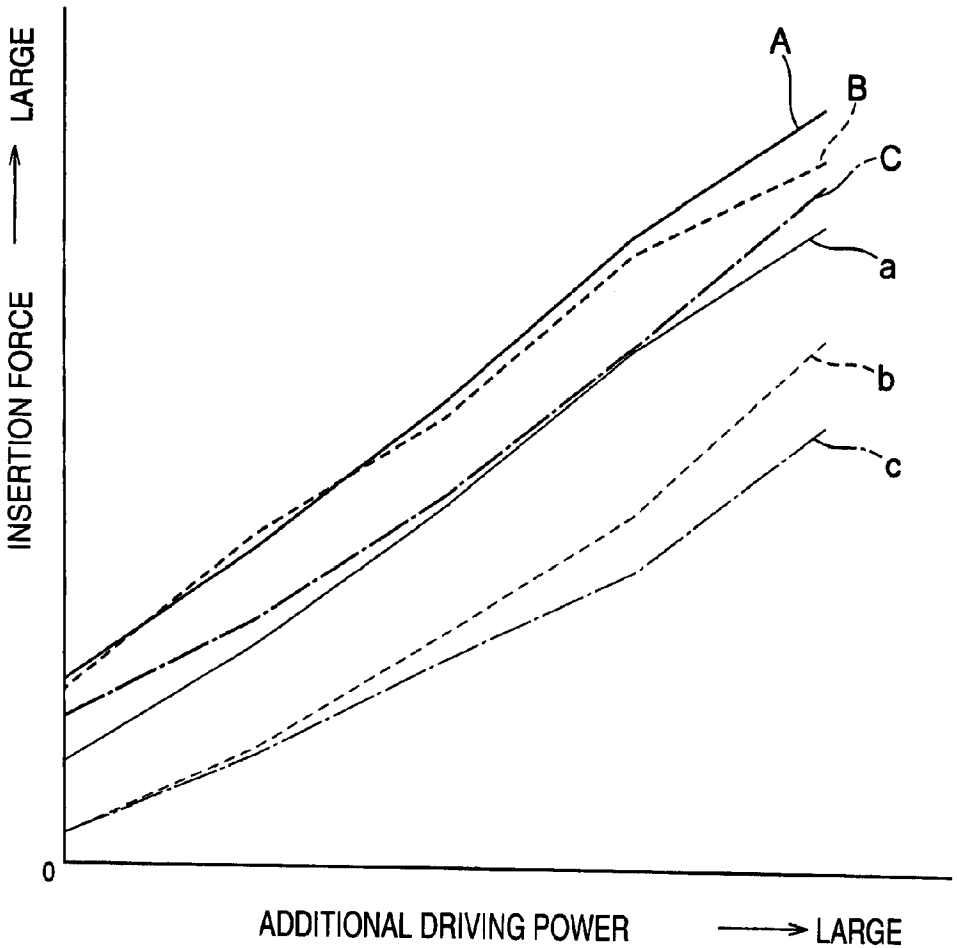
FIG. 37 is a graph showing the state wherein, after a creep occurs, the force for insertion of an ink cartridge is reduced.

FIG. 34 is a perspective view of an ink cartridge attachment/detachment device having a creep load reduction unit. FIG. 35 is a rear view of the state wherein a lever arm is located at a set position, and FIG. 35B is a rear view of the state wherein the lever arm is located at a set standby position. FIG. 36 is a graph showing the shift of a reactive force exerted to an ink cartridge by a flow path member. FIG. 37 is a graph showing the state where the insertion force of the ink cartridge after the creep occurs is reduced.

In this modification, a creep load reduction unit 401 is provided for the ink cartridge attachment/detachment device 1. The creep load reduction unit 401 has a function for reducing a creep load that is caused when the lever arm 31 continuously stays at the set position and that is imposed on the individual sections of the main body 3 of the recording apparatus. Specifically, the creep load reduction unit 401 includes: a tension coil spring 402, which is urging means for forcing the lever arm to be rotated from the set position to the reset position; and a lever arm stop mechanism 403, for halting the lever arm 31 at a set standby position that is located rearward from the set position to the reset position by a predetermined pitch.

Specifically, an arm main body 73 of the lever arm 31 is displaced so as to move a knob 74 upward. Then, as soon as the knob 74 is released, as is shown in FIGS. 35A and 35B, the lever arm 31 that has reached the set position is automatically turned upward by the action of the arm main body 73. Furthermore, the lever arm 31 turned upward is moved horizontally toward the set position by the urging force of the tension coil spring 402, along a guide slope 409 that is formed at the upper corner of an engagement notch 48. Then, the lever arm 31 is halted and held at the set standby position where an engagement pawl 410 is fitted to the engagement notch 48.

Therefore, it is possible to improve the state wherein, when the lever arm 31 continuously stays at the set position, a great load is imposed on the individual sections of the main body 3 to cause a creep. Further, when the lever arm 31 is moved from the set position to the set standby position, the ink cartridge 611 is slightly retracted from the flow path member 4; however, predetermined driving power required for loading of the ink cartridge 611 is obtained.

While referring to the graphs in FIGS. 36 and 37, a brief explanation will now be given for the shift of a reactive force that is exerted to the ink cartridge 611 by the flow path member 4, and for the state wherein the insertion force for the ink cartridge 611 is reduced. In FIG. 36 is shown the shift of the reactive force that is exerted to the ink cartridge 611 by the flow path member 4. The horizontal axis represents the distance from the set position of the lever arm 31, and the vertical axis represents the magnitude of the reactive force exerted by the flow path member 4. As is apparent from the graph, the reactive force becomes maximum at the set position, and is gradually reduced as the lever arm 31 is moved away from the set position.

In FIG. 37 is shown the state wherein the force for inserting the ink cartridge 611 is reduced after the creep occurs. The horizontal axis represents additional driving power that is additionally required due to the reduction of the insertion force of the ink cartridge 611, and the vertical axis represents the magnitude of the insertion force for the ink cartridge 611. A, B and C denote the states before the creep occurs, and a, b and c denote the states after the creep has occurred. As is apparent from the graph, the insertion force for the ink cartridge 611 is reduced after the creep occurs. It is also understood that, in order to obtain the original insertion force after the creep has occurred, considerably greater driving power than the original force must be obtained. It should be noted that, in this modification, since the creep load is considerably reduced, creep does not occur in the individual sections of the main body 3, and the satisfactory force for the insertion of the ink cartridge 611 is obtained even when the ink cartridge 611 is repetitively detached.

(Fifth Modification)

Figure 41:
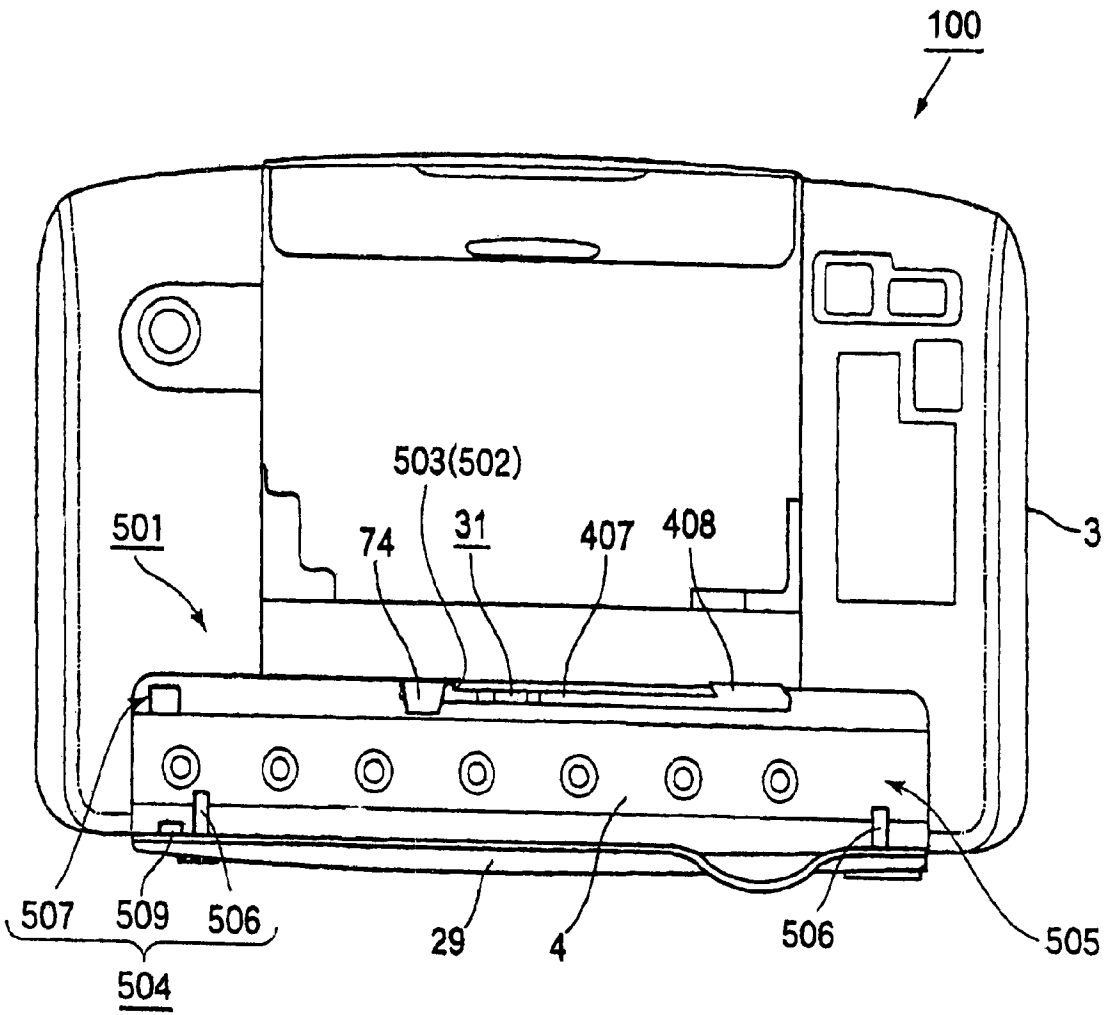
FIG. 41 is a rear view showing an ink cartridge attachment/detachment device provided with an ink cartridge insertion state judging unit and an ink cartridge erroneous load warning unit.
Figure 42:
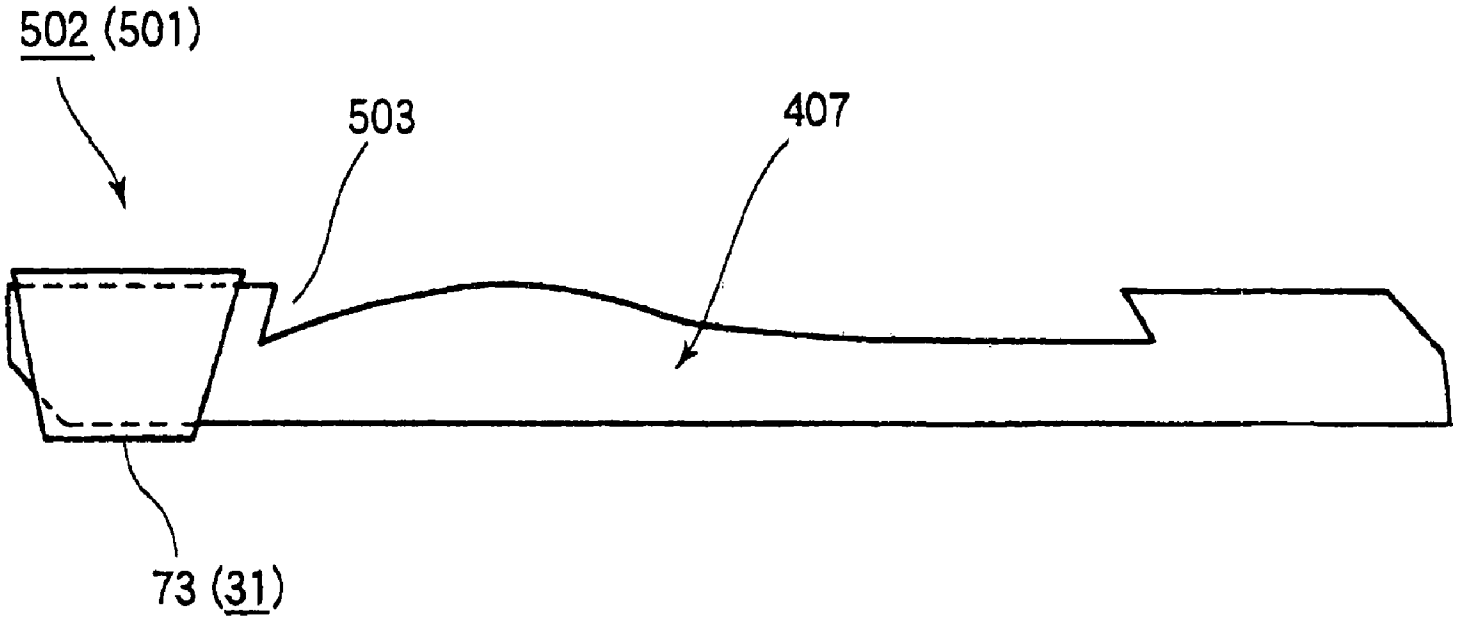
FIG. 42 is a rear view showing a lever arm rotation restricting mechanism at the time when a lever arm is located at a reset position.

FIG. 41 is a rear view showing an attachment/detachment device 1 for an ink cartridge 611, which device has an ink cartridge insertion state judging unit 501 and an ink cartridge erroneous load warning unit 504. FIG. 42 is a rear view showing a lever arm rotation restricting mechanism 502 at the time when a lever arm 31 is located at a rest position.

In this modification, the ink cartridge insertion state judging unit 501 is provided for the attachment/detachment device 1 for the ink cartridge 611. The ink cartridge insertion state judging unit 501 has such a function that when a user attempts to insert the ink cartridge 611 beyond a predetermined distance, the unit 501 stops the ink cartridge 611 at a predetermined position 500 (see FIG. 3) before ink cartridge loading so that the user can judge whether the insertion state of the ink cartridge is normal or not.

The ink cartridge insertion state judging unit 501 in this modification is constructed by having the lever arm rotation restricting mechanism 502 which restricts the rotation of the lever arm 31 from the reset position toward the set position to thereby stop the inserted ink cartridge 611 at the predetermined position 500.

The lever arm rotation restricting mechanism 502 has a restricting portion 503 which is located in the vicinity of the set position side of the rest position on the guide slit 407, i.e. a guide for guiding the rotation of the lever arm 31, and which restricts the rotation of the lever arm 31 toward the set position.

Figure 8:
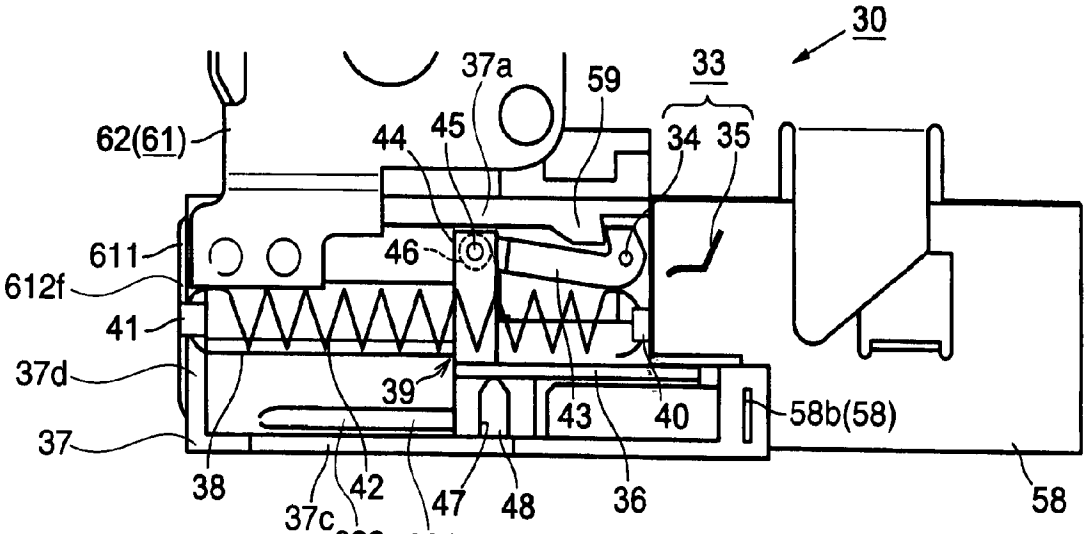
FIGS. 8A and 8B are a side view and a bottom view of the cartridge holding unit when insertion of an ink cartridge is completed.
Figure 8:
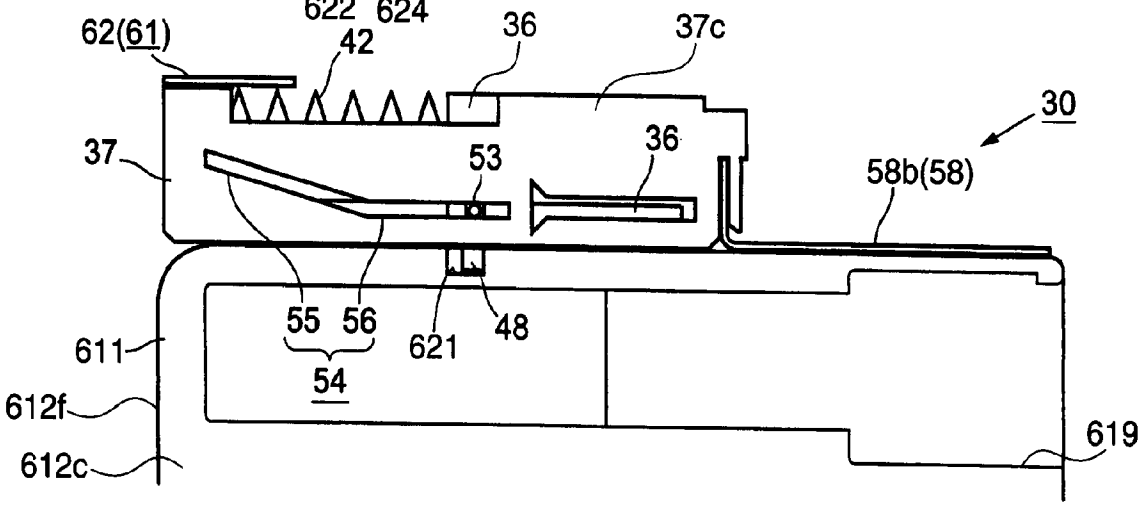

In general, a user attempts to insert the ink cartridge 611 deeply (beyond the predetermined distance). During this insertion, the ink cartridge 611 is first held by the cartridge holding unit 30 as shown in FIGS. 7 and 8. That is, the ink cartridge 611 is made integral with the slid holder 37 and the moveable frame 58. Thereafter, by the virtue of the user's insertion force, the ink cartridge 611 is inserted further: deeply, and therefore the ink cartridge 611 goes beyond the predetermined position 500. Therefore, the movable frame 58 integral with the ink cartridge 611 at this time rotates the lever arm 31 toward the set position via the combination pinion 70 and the slid bar 78. However, because the bi-stable spring 65 or the tension coil spring 402 biases the lever arm 31, the rotation of the lever arm 31 is suppressed. That is, the biasing force of the bi-stable spring 65 or the tension coil spring 402 bears against the user's ink cartridge insertion force via the movable frame 58. Consequently, as shown in FIGS. 9 and 10, the lever arm 31 is rotated toward the set position and the ink cartridge 611 is stopped at a position before the ink cartridge 611 is loaded.

When the ink cartridge 611 is inserted in this manner, the ink cartridge 611 does not receive any abutment feeling and the lever arm 31 is rotated toward the set position slightly. Therefore, there is a possibility that the rear face or rear end portion 612*f* of the ink cartridge 611 may be inserted into the interior of the recording apparatus main body 3, and in this case the user cannot visually confirm the state of the rear end portion 612*f*.

For this reason, it is difficult for the user to judge whether the insertion state of the ink cartridge 611 is normal or not even when the user has erroneously inserted the ink cartridge 611, and there is a possibility that the user may rotate the lever arm 31 toward the set position without correction. As a result, as shown in FIG. 22, there is a possibility that the ink cartridge 611 may be loaded in a state (the abnormal insertion state of the ink cartridge) in which only one side of the cartridge holding unit 30 is operated due to erroneous insertion of the ink cartridge 611 (hereafter referred to as "erroneous loading")

Accordingly, this embodiment is provided with the restricting portion 503 that is located at an upper side in the vicinity of the set position side of the reset position on the guide slit 407 for guiding the rotation of the lever arm 31, and that restricts the rotation of the lever arm 31 toward the set position. In this modification, since the arm main body 73 of the lever arm 31 flexures so that the knob 74 side is biased and moved upwardly (similarly to the fourth modification), the restricting portion 503 disposed at the upper side on the guide slit 407 can restrict the rotation of the lever arm 31 from the reset position toward the set position (see FIG. 42). Accordingly, the movement of the rotation slide mechanism 32 associated with the rotation of the lever arm 31 can be restricted. That is, the ink cartridge can be stopped with abutment feeling at the predetermined position 500 before the ink cartridge 611 is loaded.

At this time, the predetermined position 500 is such a position that the ink cartridge 611 is held by the cartridge holding unit 30 and before the ink cartridge 611 is loaded by the rotation of the lever arm 31. Accordingly, the predetermined position 500 can be set to establish such a state that the rear end portion 612*f* of the ink cartridge 611 is protruded outside the recording apparatus man body 3. As a result, the user can visually confirm the rear end portion 612*f* of the ink cartridge 611, and easily judge whether the insertion state of the ink cartridge 611 is normal or not.

In a case that the insertion state is not normal, the ink cartridge 611 can be correctly inserted again. Accordingly, it is possible to remarkably reduce a possibility that the ink cartridge 611 of the abnormal insertion state is erroneously loaded by the rotational operation of the lever arm 31.

In a case that the insertion state is normal, the knob 74 of the lever arm 31 is once lowered to release the restriction of the restricting portion 503, and then rotated to the set position to correctly and securely load the ink cartridge 611.

The restricting portion 503 can be formed to abut against the lever arm 31 when the lever arm 31 is slightly rotated toward the set position during insertion of the ink cartridge 611. That is, a play can be provided for the rotation restriction of the lever am 31 toward the set position. Accordingly, when the ink cartridge 611 is inserted and the abutment is caused, the lever arm 31 is rotated to the extent corresponding to the play. As a result, the user can easily recognize that the abutment during insertion of the ink cartridge 611 is caused by the restricting portion 503. Then, the user can readily release the lever arm 31 from the restriction caused by the restricting portion 503.

As described above, since only the restricting portion 503 is formed at the reset position on the guide slit 407 for guiding the rotation of the lever arm 31, the lever arm rotation restricting mechanism 502 can be constructed easily with low cost and without increased number of component parts.

(Sixth Modification)

Even if such a structure as to avoid the abnormal insertion state of the ink cartridge 611 is adopted as mentioned above, it is difficult to completely avoid the abnormal insertion state of the ink cartridge 611 because the insertion operation is made by human. Accordingly, there is a possibility that the ink cartridge 611 as it is may be moved to the loading position by rotation of the lever 31, and the ink cartridge 611 erroneously loaded may be left. As a result, there is a possibility that an incomplete sealing state between the ink supply needle and the sealing rubber may cause leakage of ink due to capillary action. FIG. 22 shows a state in which the ink cartridge 611 is erroneously loaded.

As shown in FIG. 22, in a case that the ink cartridge 611 is erroneously loaded in a state (abnormal insertion state of the ink cartridge) in which only one side of the cartridge holding unit 30 is operated due to erroneous insertion of the ink cartridge 611, the rear end portion 612*f* of the ink cartridge 611 is tilted. That is, the rear end portion 612*fb* of the ink cartridge 611 in a side where the cartridge holding unit 30 is not operated properly is protruded in a rear surface side (upwardly in FIG. 22) in comparison with the rear end portion 612*fa* of the ink cartridge 611 in a side where the cartridge holding unit 30 is operated properly. In this modification, a positional difference between the rear end portion 612*fa* in the side properly operated and the rear end portion 612*fb* in the side not properly operated is 4 mm.

This modification is provided with an ink cartridge erroneous load warning unit 504 which warns the erroneous load of the ink cartridge 611 using this positional difference between the rear end portions 612*fa* and 612*fb*. Hereafter, the ink cartridge erroneous load warning unit 504 will be discussed.

Figure 43:
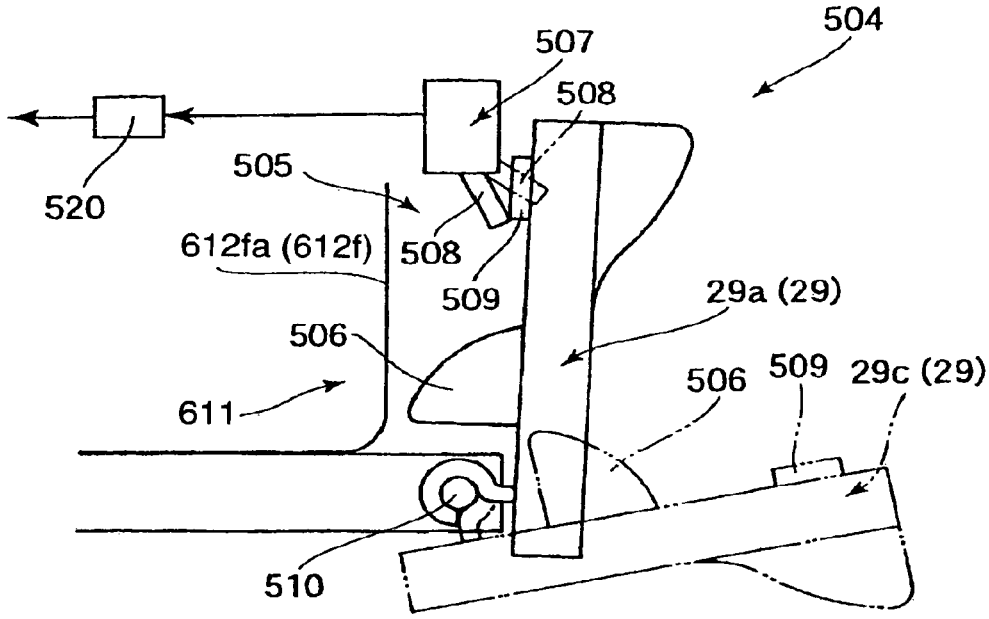
FIGS. 43A and 43B are sectional side views showing an operation mode of the ink cartridge erroneous load warning unit.
Figure 43:
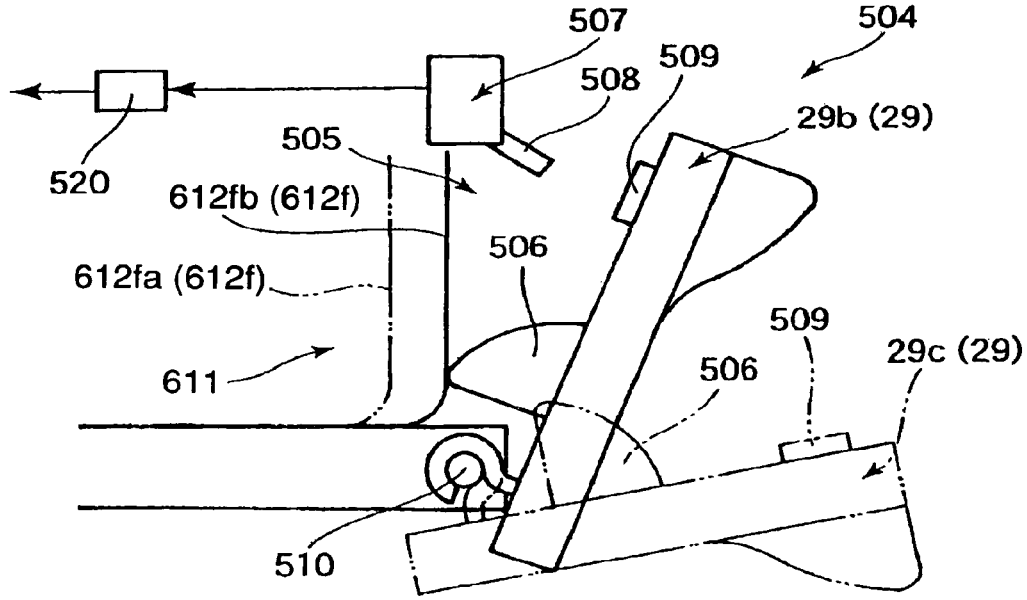

FIGS. 43A and 43B are sectional side views showing an operation mode of the ink cartridge erroneous load warning unit 540.

In this modification, the ink cartridge erroneous load warning unit 504 is provided for the attachment/detachment device 1 for the ink cartridge 611. The ink cartridge erroneous load warning unit 504 has such a function as to generate a warning to a user when the ink cartridge 611 is erroneously loaded. More specifically, the ink cartridge erroneous load warning unit 504 includes a lid member 29 rotatable about a lid open/close fulcrum 510 to close an insertion opening portion 505 for the ink cartridge 611, and ribs 506 formed on an inner side of the lid member 29.

The ribs 506 are respectively disposed at positions facing the rear end portions 612*fa* and 612*fb* in the vicinities of left and right ends of the lid member 29, so as to abut against the ink cartridge 611, restrict rotation of the lid member 29 and prevent the lid member 29 from being closed when the ink cartridge 611 is erroneously loaded.

The ink cartridge erroneous load warning unit 504 further includes a lid open/close detector 507 which detects an open/close of the lid member 29, and an ink cartridge erroneous loading state controller 520.

The lid member open/close detector 507 has a lever protruding piece 508 which abuts against a protruded portion 509 provided on the inner side of the lid member 29 when the lid member 29 is closed, to thereby detect the close of the lid member 29. The lid member open/close detector 507 in this modification is disposed in the insertion opening portion 505 to face a leading end side (an upper side in figure) of the lid member 29 in order to securely detect the open/close state of the lid member 29.

The ink cartridge erroneous loading state controller 520 has such a control function that the recording apparatus main body is not activated until the lid member open/close detector 507 detects the close of the lid member 29.

FIG. 43A shows a state in which the ink cartridge holding unit 30 is properly operated in both sides (normal insertion state of the ink cartridge) and then the ink cartridge 611 is properly loaded. First, the lid member 29*c* in open state is rotated about the lid open/close fulcrum 510 in a direction to close the insertion opening portion 505. At this time, the rear end portion 612*f* of the ink cartridge 611 is not tilted. That is, since the rear end portion 612*f* is located only at a position of the rear end portion 612*fa*, there is no possibility that the rib 506 abuts against the rear end portion 612*fa*. The lid member can be further rotated in the same direction so that the protruded portion 509 provided on the inner side of the lid member 29 pushes the lever protruded piece 508 of the lid member open/close detector 507. As a result, the lid member open/close detector 507 can detect the close of the lid member 29*a*.

FIG. 43B shows a state in which the cartridge holding unit 30 is not properly operated (abnormal insertion state of the ink cartridge), and then the ink cartridge 611 is erroneously loaded without correction. In FIG. 40B, reference numerals 612*fa* and 612*fb* respectively correspond to the rear end portion 612*fa* in a side where the cartridge holding unit 30 is properly operated and the rear end portion 612*fb* in a side where the cartridge holding unit 30 is not properly operated as shown in FIG. 22.

First, the lid member 29*c* in open state is rotated about the lid open/close fulcrum in a direction to close the insertion opening portion 505. Here, the ribs 506 are provided on the inner side of the lid member 29 in the vicinities of left and right ends (to face the rear end portions 612*fa* and 612*fb*) Therefore, since one of two ribs 506 abuts against the rear end portion 612*fb* during the course of rotation of the lid member 29, the rib 506 hinders the rotation of the lid member 29 and stops the lid member 29*b* at that position. As a result, the protruded portion 509 cannot press the lever protruded piece 508. That is, the lid member open/close detector 507 do not detect close of the lid member 29.

Further, the lid member open/close detector 507 can convert a fact that the lid member 29 is not closed, into an electric signal to notify a user of a warning displayed on an operation panel or the like (not shown).

Moreover, using the ink cartridge erroneous loading state controller 520 (see FIGS. 43A and 43B), the recording apparatus main body 3 cannot be activated until the lid member open/close detector 507 detects close of the lid member 29. Accordingly, there is no possibility that an initial filling step in which the recording apparatus main body 3 fills ink into ink supply passages provided within the recording head 13 is executed when the ink cartridge 611 is erroneously loaded. Accordingly, even if the ink cartridge 611 is erroneously loaded, there is no possibility that waste ink is leaked to the outside of the apparatus due to the initial filling step or the like.

In the above embodiment and modifications, the ink cartridge 611 of single package type, wherein a plurality of color ink cartridges are integrally formed, has been employed. However, ink cartridges provided respectively for the individual colors may be employed, or ink cartridge packages for two or three colors each may be employed as the ink cartridge 611.

Further, two sets of the second pinions 79, the third pinions 80 and the third racks 81 maybe arranged symmetrically at the lever arm 31. Further, instead of the slide bar 78, an appropriate train of gears may be provided to transmit the rotation of the first pinion 75 to the second pinions 79. In addition, a stopper may be provided that permits the insertion of the ink cartridge 611 only when the lever arm 31 is located at the position shown in FIG. 3.

The stopper includes not only the ink cartridge erroneous insertion prevention unit 101, 201 or 301 described above, but also includes a unit for electrically detecting the erroneous insertion of the ink cartridge 611 to inhibit the insertion, or a unit for preventing the erroneous insertion of the ink cartridge 611 by employing the engagement structure formed both for the ink cartridge 611 and the fixed frame 61.

What is claimed is:

1. An ink cartridge attachment/detachment device, which loads an ink cartridge into a main body of a recording apparatus by sliding the ink cartridge, comprising:

a cartridge holding mechanism for holding the ink cartridge upon insertion of the ink cartridge by a predetermined stroke; and a rotating and sliding mechanism for producing pressing force required for loading the ink cartridge by using rotation of a lever arm and leverage principle, and for converting the rotation of the lever arm into movement of another predetermined stroke required for loading the ink cartridge, the rotating and sliding mechanism comprising a rack and pinion mechanism which comprises a first pinion, which is attached to a base end of the lever arm to rotate together with the lever arm;

a slide bar, which has a first rack meshing with the first pinion and a second rack for transmitting movement of the first rack downstream along a transmission path;

a combination pinion, which has a second pinion meshing with the second rack and a third pinion for transmitting rotation of the second pinion downstream along the transmission path; and a third rack, which is provided on a movable frame slidably attached to a fixed frame and meshes with the third pinion.

2. An ink cartridge attachment/detachment device according to claim 1, wherein the cartridge holding mechanism includes:

an unlocking mechanism that can remove the ink cartridge from the main body of the recording apparatus by merely rotating the lever arm.

3. An ink cartridge attachment/detachment device according to claim 2, wherein the unlocking mechanism includes:

an unlocking pin that is moved together with the ink cartridge as the lever arm is rotated; and an elastic unlocking piece for releasing a locked state of the ink cartridge by differentiating travel loci of the unlocking pin in a direction in which the ink cartridge is inserted and in a direction in which the ink cartridge is removed.

4. An ink cartridge attachment/detachment device according to claim 1, wherein the cartridge holding mechanism includes:

a lock slider, which is slid against an urging force exerted by an extraction spring by contacting a pressing rib projecting from one of two opposite sides of the ink cartridge;

a slider holder, which is moved together with a movable frame while slidably holding the lock slider;

an engagement pawl, which is rotatably connected to the lock slider and which engages an engagement rib formed on the slider holder to combine the lock slider and the slider holder together;

a lock spring for urging the engagement pawl toward the engagement rib; and a slide lock piece, which slides, relative to the lock slider, in a direction perpendicular to a loading direction in which the ink cartridge is loaded and which has a guide protrusion that engages a guide groove formed in the slider holder.

5. An ink cartridge attachment/detachment device according to claim 1, wherein the lever arm includes:

a base end, which is rotatably connected to an upright rotation pin provided on a fixed frame;

an arm main body, which extends from the base end toward a rear face of the main body of the recording apparatus; and a knob, which is attached to a distal end of the arm main body, wherein a bi-stable spring is suspended between the base end and the fixed frame and urges the lever arm to be positioned at either one of right and left rotation ends.

6. An ink cartridge attachment/detachment device according to claim 5, wherein a transmission member that is rotated together with the lever arm is connected through a pressure increase spring to the base end of the lever arm; and wherein, when the lever arm is rotated in a predetermined direction to load the ink cartridge, an urging force exerted by the pressure increase spring presses and holds the ink cartridge so that the ink cartridge closely contacts a flow path member.

7. An ink cartridge attachment/detachment device according to claim 1, wherein the transmission path provided by the second rack, the second pinion, the third pinion and the third rack is arranged in each of right and left sides of the lever arm.

8. An ink cartridge attachment/detachment device according to claim 1, further comprising:

an ink cartridge erroneous insertion prevention mechanism for preventing the insertion of the ink cartridge when the lever arm is located at a set position at which the lever arm is supposed to be when loading of the ink cartridge is completed, or when the lever arm is located at a position other than a reset position at which loading of the ink cartridge is enabled, or when the ink cartridge is to be inserted while the ink cartridge is not held by the cartridge holding mechanism.

9. An ink cartridge attachment/detachment device according to claim 8, wherein the ink cartridge erroneous insertion prevention mechanism includes:

an erroneous insertion prevention protrusion protruded from a fixed frame of the recording apparatus toward a lock slider;

a slide lock piece sliding, relative to the lock slider, in a direction perpendicular to a direction in which the ink cartridge is inserted; and a guide groove, which is formed in a slider holder moved together with a movable frame of the recording apparatus, and which is engaged with a guide protrusion provided on the slide lock piece, wherein the guide groove is shaped so that, when the ink cartridge is to be inserted while the lever arm is located at the set position, the slide lock piece takes a traveling locus to be brought in contact with the erroneous insertion prevention protrusion and to prevent the insertion of the ink cartridge.

10. An ink cartridge attachment/detachment device according to claim 8, wherein the ink cartridge erroneous insertion prevention mechanism includes:

an erroneous insertion prevention protrusion protruded from a fixed frame of the recording apparatus toward a lock slider;

a slide lock piece sliding, relative to the lock slider, in a direction perpendicular to a direction in which the ink cartridge is inserted; and a guide groove, which is formed in a slider holder moved together with a movable frame of the recording apparatus, and which is engaged with a guide protrusion provided on the slide lock piece, wherein the guide groove is shaped so that, when the lever arm is pivoted from the reset position to the set position while the ink cartridge is not held by the cartridge holding mechanism, the slide lock piece takes a traveling locus to be brought into contact with the erroneous insertion prevention protrusion and to prevent the insertion of the ink cartridge.

11. An ink cartridge attachment/detachment device according to claim 8, wherein the ink cartridge erroneous insertion prevention mechanism includes:

a collision avoiding mechanism for, when the ink cartridge is inserted while the lever arm is located at a position other than the reset position, preventing deformation of an elastic unlocking piece which is caused by a collision to an unlocking pin provided on an engagement pawl.

12. An ink cartridge attachment/detachment device according to claim 11, wherein the collision avoiding mechanism includes:

a collision avoiding convex portion rotating together with the engagement pawl; and a sliding face slidably contacting the collision avoiding convex portion and being integrally formed in an engagement rib to be engaged with the engagement pawl, wherein a rotating locus for the engagement pawl is set so that, when the lever arm is located at a position other than the reset position and when the ink cartridge is inserted, a normal rotating locus of the engagement pawl by which the unlocking pin collides with the elastic unlocking piece is corrected and an avoiding rotating locus by which the unlocking pin do not collide with the elastic unlocking piece is selected.

13. An ink cartridge attachment/detachment device according to claim 8, wherein the ink cartridge erroneous insertion prevention mechanism includes:

an erroneous insertion prevention flap which adopts a retraction attitude when the lever arm is located at the reset position, and adopts a projection attribute when the lever arm is located at a position other than the reset position; and a rotational direction changing mechanism for converting movement of the lever arm into movement of the erroneous insertion prevention flap.

14. An ink cartridge attachment/detachment device according to claim 13, wherein the erroneous insertion prevention flap includes:

a flap main body directly contacting an insertion end face of the ink cartridge to prevent the erroneous insertion of the ink cartridge;

a rotary shaft rotatably connected to a fixed frame so that an axial direction of the rotary shaft is set in a widthwise direction of the fixed frame; and a conversion cam follower provided to an end face of the flap opposite to the flap main body so that the rotary shaft is located between the flap main body and the conversion cam follower, wherein the erroneous insertion prevention flap always adopts the projection attitude by receiving an urging force from an urging member that is arranged between the fixed frame and the flap.

15. An ink cartridge attachment/detachment device according to claim 13, wherein the rotational direction changing mechanism includes:

a trigger which pivots in a direction of the movement of the lever arm by a predetermined angle about a rotation pin provided upright on an upper face of a fixed frame;

a conversion cam follower provided to the erroneous insertion prevention flap; and an urging member for urging the trigger in a direction to rotate toward the lever arm.

16. An ink cartridge attachment/detachment device according to claim 15, wherein the trigger includes:

an arm rotatably connected to the rotation pin, and extending in a radial direction; and a conversion operating portion extending in a circumferential direction from a distal end of the arm toward the lever arm and the erroneous insertion prevention flap, wherein the conversion operating portion has, at its input side, an input contact portion that directly contacts the lever arm, and, at its output side, a conversion cam face, which slides and contacts the conversion cam follower of the erroneous insertion prevention flap.

17. An ink cartridge attachment/detachment device according to claim 1, further comprising:

an ink cartridge insertion state judging mechanism, which, when a user attempts to insert the ink cartridge beyond a predetermined distance, stops the ink cartridge at a predetermined position before the loading of the ink cartridge, and makes judging whether the insertion state of the ink cartridge is normal or not, possible for the user.

18. An ink cartridge attachment/detachment device according to claim 17, wherein the ink cartridge insertion state judging mechanism includes:

a lever arm rotation restricting mechanism which restricts rotation of the lever arm from a reset position toward a set position so as to stop the inserted ink cartridge at the predetermined position.

19. An ink cartridge attachment/detachment device according to claim 18, wherein the lever arm rotation restricting mechanism includes:

a restricting portion which is disposed at the reset position on a guide for guiding the rotation of the lever arm and which restricts the rotation of the lever arm toward the set position.

20. A recording apparatus comprising:

an ink cartridge attachment/detachment device according to claim 1, which slides an ink cartridge to load into a main body of the recording apparatus.

21. An ink cartridge attachment/detachment device, which loads an ink cartridge into a main body of a recording apparatus by sliding the ink cartridge, comprising:

a cartridge holding mechanism for holding the ink cartridge upon insertion of the ink cartridge by a predetermined stroke;

a rotating and sliding mechanism for producing pressing force required for loading the ink cartridge by using rotation of a lever arm and leverage principle, and for converting the rotation of the lever arm into movement of another predetermined stroke required for loading the ink cartridge; and a creep load reduction mechanism for reducing a creep load, which is imposed on individual sections in the main body of the recording apparatus, that is caused when the lever arm continuously stays at the set position at which the lever arm is supposed to be when loading of the ink cartridge is completed.

22. An ink cartridge attachment/detachment device according to claim 21, wherein the creep load reduction mechanism includes:

an urging member for urging the lever arm located at the set position to rotate toward the reset position; and a lever arm stop mechanism for halting the lever arm at a set standby position that is located backward from the set position toward the reset position by a predetermined pitch.

23. A recording apparatus comprising:

an ink cartridge attachment/detachment device according to claim 21, which slides an ink cartridge to load into a main body of the recording apparatus.

24. An ink cartridge attachment/detachment device, which loads an ink cartridge into a main body of a recording apparatus by sliding the ink cartridge, comprising:

a cartridge holding mechanism for holding the ink cartridge upon insertion of the ink cartridge by a predetermined stroke;

a rotating and sliding mechanism for producing pressing force required for loading the ink cartridge by using rotation of a lever arm and leverage principle, and for converting the rotation of the lever arm into movement of another predetermined stroke required for loading the ink cartridge an ink cartridge erroneous load warning mechanism, which, when the ink cartridge is erroneously loaded in an abnormal insertion state, notifies a user of the erroneous loading of the ink cartridge and the ink cartridge erroneous load warning mechanism includes:

a rotatable lid member capable of closing an insertion opening portion for the ink cartridge; and a rib formed on an inner side of the lid member, wherein when the ink cartridge is erroneously loaded, the rib abuts against the ink cartridge and restricts rotation of the lid member, to thereby prevent the lid member from being closed.

25. An ink cartridge attachment/detachment device according to claim 24, wherein the ink cartridge erroneous load warning mechanism further includes:

a lid member open/close detector which detects open/close of the lid member.

26. An ink cartridge attachment/detachment device according to claim 25, wherein the ink cartridge erroneous load warning mechanism further includes:

an ink cartridge erroneous loading state controller which prevents the recording apparatus main body from being activated until the lid member open/close detector detects close of the lid member.

27. A recording apparatus comprising:

an ink cartridge attachment/detachment device according to claim 24, which slides an ink cartridge to load into a main body of the recording apparatus.

28. A liquid ejection apparatus comprising:

a liquid container attachment/detachment device which loads, a liquid container into a main body of the liquid ejection apparatus by sliding the liquid container;

a cartridge holding mechanism for holding the liquid container upon insertion of the liquid container by a predetermined stroke;

a rotation and sliding mechanism for producing pressing force required for loading the liquid container by using rotation of a lever arm and leverage principle, and for converting the rotation of the lever arm into movement of another predetermined stroke required for loading the liquid container, the rotating and sliding mechanism comprising a rack and pinion mechanism which comprises a first pinion, which is attached to a base end of the lever arm to rotate together with the lever arm;

a slide bar, which has a first rack meshing with the first pinion and a second rack for transmitting movement of the first rack downstream along a transmission path;

a combination pinion, which has a second pinion meshing with the second rack and a third pinion for transmitting rotation of the second pinion downstream along the transmission path; and a third rack, which is provided on a movable frame slidably attached to a fixed frame and meshes with the third pinion.

29. A liquid ejection apparatus of claim 28, comprising a creep load reduction mechanism for reducing a creep load, which is imposed on individual sections in the main body of the liquid ejection apparatus, that is caused when the lever arm continuously stays at the set position at which the lever arm is supposed to be when loading of the liquid container is completed.

30. A liquid ejection apparatus according to claim 28, further comprising:

a liquid container erroneous load warning mechanism, which, when the liquid container is erroneously loaded in an abnormal insertion state, is constructed and adapted to notify a user of the erroneous loading of the liquid container and wherein the erroneous load warning mechanism includes:

a rotatable lid member capable of closing an insertion opening portion for the liquid container; and a rib formed on an inner side of the lid member, wherein when the liquid container is erroneously loaded, the rib abuts against the liquid container and restricts rotation of the lid member, to thereby prevent the lid member from being closed.

31. An ink cartridge attachment/detachment device comprising:

a stationary frame unit having a flow path member defining an ink flow path;

a movable frame unit supported by the stationary frame unit and movable between a first position and a second position relative to the stationary frame unit;

a slider unit supported by the movable frame unit and movable between a third position and a fourth position relative to the movable frame unit;

a first fixing mechanism for fixing an ink cartridge relative to the slider unit when the slider unit into which the ink cartridge is fully inserted is moved from the fourth position and located at the third position relative to the movable frame unit;

a second fixing mechanism for fixing the slider unit relative to the movable frame unit when the slider unit into which the ink cartridge is fully inserted is moved from the fourth position and located at the third position relative to the movable frame unit;

a power supply for generating rotational torque; and a converter unit for converting the rotational torque into linear motion of the movable frame unit relative to the stationary frame unit, wherein:

when the power supply is activated to generate the rotational torque in a first direction after the slider unit into which the ink cartridge is fully inserted is moved from the fourth position and located at the third position relative to the movable frame unit, the movable frame unit to which the slider unit and the ink cartridge are fixed by the first and second fixing mechanisms is moved from the second position toward the first position relative to the stationary frame unit; and when the movable frame unit to which the slider unit and the ink cartridge are fixed by the first and second fixing mechanism is located at the first position relative to the stationary frame unit, the ink flow path of the ink flow member is brought into fluid communication with an interior of the ink cartridge.

32. An ink attachment/detachment device according to claim 31, wherein the power supply includes a manually operable lever arm.

33. An ink attachment/detachment device according to claim 31, further comprising:

an unlocking mechanism which acts on the second fixing mechanism so that the slider unit is movable from the third position toward the fourth position relative to the movable frame unit when the movable frame unit to which the slider unit and the ink cartridge are fnced by the first and second fixing mechanisms is moved from the first position toward the second position relative to the stationary frame unit by activating the power supply to generate the rotational torque in a second direction opposite the first direction.

* * * * *